US010426192B2

(12) United States Patent
Blick et al.

(10) Patent No.: US 10,426,192 B2
(45) Date of Patent: Oct. 1, 2019

(54) SMOKING ARTICLE

(75) Inventors: Kevin Blick, London (GB); Mike Simpson, Shibuya-ku (HK); James Allerton, Middlesex (GB); Dan White, Middlesex (GB); Keith Herbert, Darenth (GB)

(73) Assignees: BRITISH AMERICAN TOBACCO (INVESTMENTS) LIMITED, London (GB); BRITISH AMERICAN TOBACCO JAPAN, LTD., Tokyo (JP)

( * ) Notice: Subject to any disclaimer, the term of this patent is extended or adjusted under 35 U.S.C. 154(b) by 767 days.

(21) Appl. No.: 13/637,981

(22) PCT Filed: Mar. 14, 2011

(86) PCT No.: PCT/GB2011/050500
§ 371 (c)(1),
(2), (4) Date: Feb. 19, 2013

(87) PCT Pub. No.: WO2011/121328
PCT Pub. Date: Oct. 6, 2011

(65) Prior Publication Data

US 2013/0139836 A1 Jun. 6, 2013

(30) Foreign Application Priority Data

Mar. 29, 2010 (JP) ..... 2010-074234
Dec. 21, 2010 (GB) ..... 1021544.0

(51) Int. Cl.
*A24D 1/00* (2006.01)
*A24C 5/10* (2006.01)
*A24D 3/04* (2006.01)

(52) U.S. Cl.
CPC ..... *A24D 1/008* (2013.01); *A24D 3/041* (2013.01); *A24D 3/043* (2013.01)

(58) Field of Classification Search
CPC ..... A24D 3/041; A24D 3/043; A24D 1/008
See application file for complete search history.

(56) References Cited

U.S. PATENT DOCUMENTS

| | | | |
|---|---|---|---|
| 2,820,462 | A | 1/1958 | Fleischer |
| 3,503,406 | A | 3/1970 | Riegel et al. |
| 3,512,537 | A | 5/1970 | Pelletier |
| 4,593,707 | A | 6/1986 | Seidel et al. |
| 4,601,298 | A | 7/1986 | Nichols et al. |
| 4,611,607 | A | 9/1986 | Reynolds et al. |

(Continued)

FOREIGN PATENT DOCUMENTS

| | | |
|---|---|---|
| CL | 1722-2004 | 7/2005 |
| CL | 1291-2009 | 10/2010 |

(Continued)

OTHER PUBLICATIONS

English translation of Chinese office action dated Aug. 27, 2013 for Chinese patent application No. 201180026698.9.

(Continued)

*Primary Examiner* — Michael H. Wilson
*Assistant Examiner* — Dionne W. Mayes
(74) *Attorney, Agent, or Firm* — Cantor Colburn LLP

(57) ABSTRACT

A smoking article (130) comprises a variable flow system configured to vary gaseous flow into or through the smoking article.

22 Claims, 38 Drawing Sheets

(56) References Cited

U.S. PATENT DOCUMENTS

| | | | | |
|---|---|---|---|---|
| 4,649,945 | A | 3/1987 | Norman et al. | |
| 4,687,008 | A | 8/1987 | Houck et al. | |
| 4,700,725 | A * | 10/1987 | Geiszler, Jr. | 131/336 |
| 4,727,892 | A | 3/1988 | Abdelgawad | |
| 2007/0095357 | A1 | 5/2007 | Besso et al. | |

FOREIGN PATENT DOCUMENTS

| | | | |
|---|---|---|---|
| CL | 1292-2009 | | 10/2010 |
| CL | 2697-2012 | | 1/2013 |
| CN | 2371818 | | 4/2000 |
| CN | 1709169 | | 12/2005 |
| CN | 2935843 | | 8/2007 |
| DE | 3904948 | C1 | 5/1990 |
| EP | 0189980 | A1 | 8/1986 |
| EP | 0105682 | B1 | 11/1986 |
| EP | 0476969 | A1 | 3/1992 |
| JP | 61166387 | A | 7/1986 |
| JP | 2002147671 | A | 5/2002 |
| WO | 84/01272 | A1 | 4/1984 |
| WO | 2005/023026 | A1 | 3/2005 |
| WO | 2009/144496 | A1 | 12/2009 |
| WO | 2009/144499 | A2 | 12/2009 |
| WO | 2011/121327 | A1 | 10/2011 |

OTHER PUBLICATIONS

Partial International Search Report, dated Jul. 15, 2011, for PCT International Application No. PCT/GB2011/050500, filed Mar. 14, 2011.

International Search Report and Written Opinion, dated Nov. 18, 2011, for PCT International Application No. PCT/GB2011/050500, filed Mar. 14, 2011.

International Preliminary Report on Patentability, dated Oct. 11, 2012, for PCT International Application No. PCT/GB2011/050500, filed Mar. 14, 2011.

Examination Report issued for Chilean Application No. 2698-2012, filed Sep. 27, 2012 [including Machine Translation].

Office Action for Japanese Patent Application No. 2013-501939 dated Feb. 24, 2015 [with English machine translation], citing Japanese Patent publication No. 47-18639 (corresponding to U.S. Pat. No. 3,503,406), Japanese patent laid open publication No. 2002-147671, and Japanese patent laid-open publication No. 61-166387 (corresponding to EP0189980).

Office Action for Australian Patent Application No. 2011234202 dated Jun. 18, 2015.

Office Action for Korean Patent Application No. 2012-7028350 dated Jul. 28, 2015 (with English translation).

* cited by examiner

SMOKING ARTICLE

CLAIM FOR PRIORITY

This application is a National Stage Entry entitled to and hereby claims priority under 35 U.S.C. §§ 365 and 371 to corresponding PCT Application No. PCT/GB2011/050500, filed Mar. 14, 2011, which in turn claims priority to Japanese Application Serial No. JP 2010-(74234, filed Mar. 29, 2010 and British Application Serial No. GB 1021544.0, filed Dec. 21, 2010. The entire contents of the aforementioned applications are herein expressly incorporated by reference.

The present invention relates to a smoking article. In particular, the invention relates to a smoking article whose ventilation or gaseous flow into or through the smoking article can be varied.

An extendable cigarette is known from U.S. Pat. No. 2,820,462. The cigarette is telescopic, with a tobacco rod slidable within a tube having a filter at the mouthpiece end. The tobacco rod can be slid within the tube to vary the size of an internal chamber.

WO 84/01272 discloses variable air dilution in a filter cigarette.

The present invention provides a smoking article as claimed in claim 1.

Thus, the smoking article has an amount of gaseous flow through or into the smoking article which can be selected or varied.

Embodiments of the present invention will now be described, by way of example only, with reference to the accompanying drawings, in which.

Figure 6:
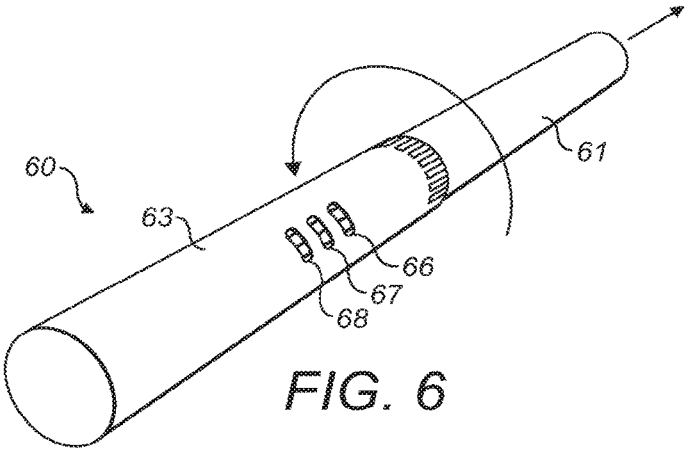
FIG. 6 is a perspective view of a smoking article with a first embodiment of a variable ventilation system.
Figure 8:
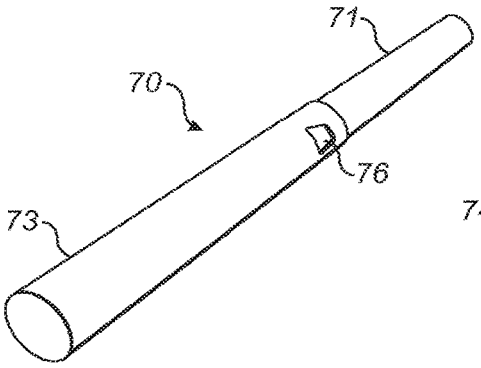
Figure 9A:
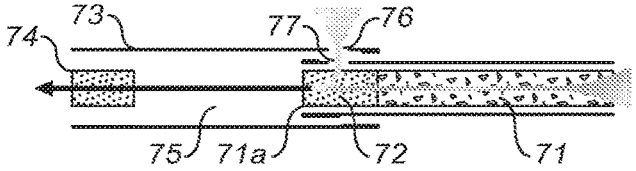
Figure 9B:
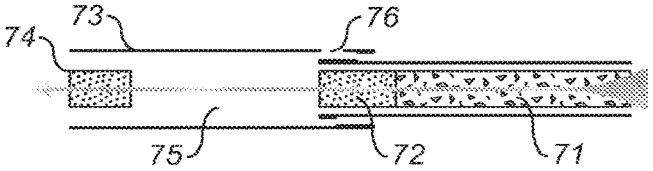
Figure 10:
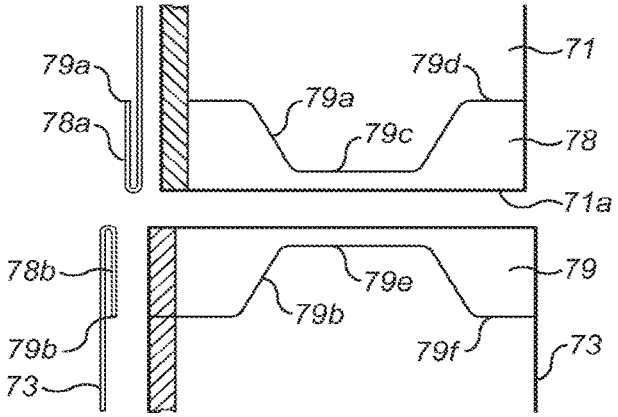
Figure 11A:
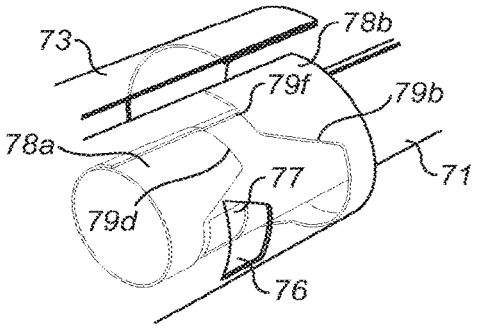
Figure 11B:
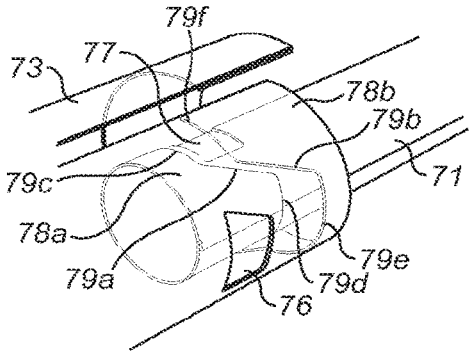
Figure 12:
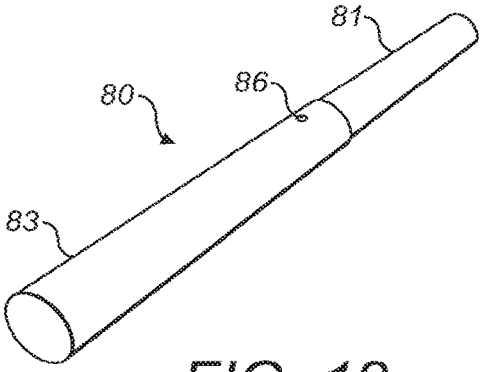
Figure 13A:
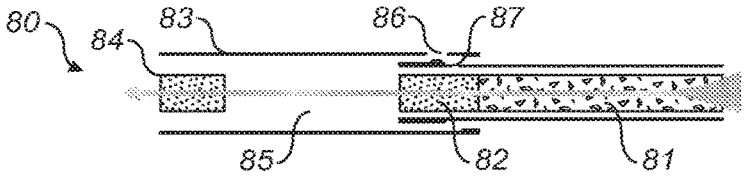
Figure 13B:
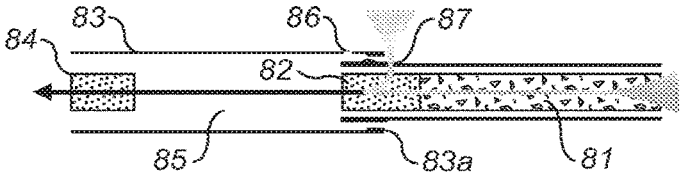
Figure 14A:
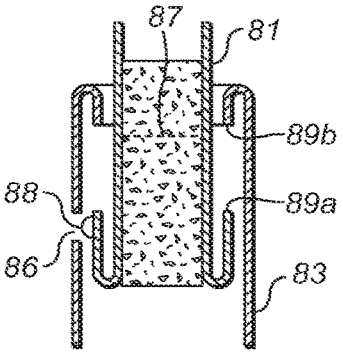
Figure 14B:
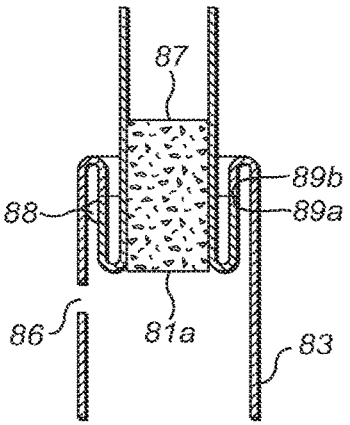
Figure 15:
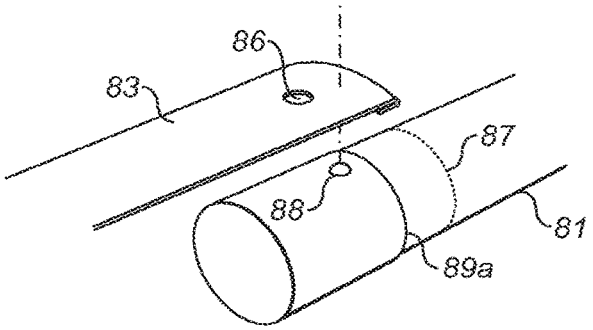
Figure 16:
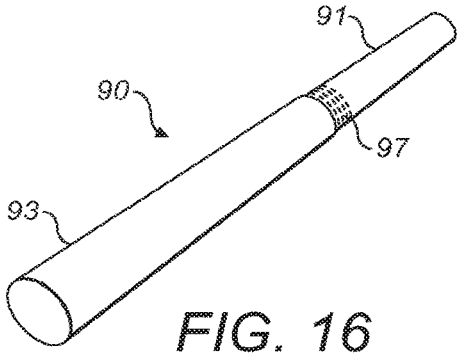
Figure 17A:
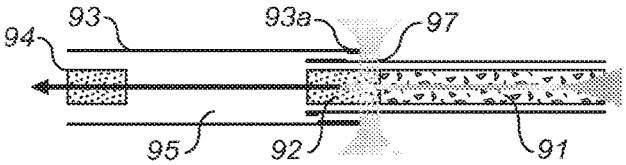
Figure 17B:
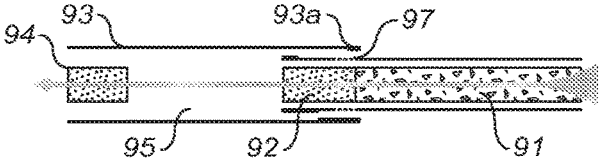
Figure 18:
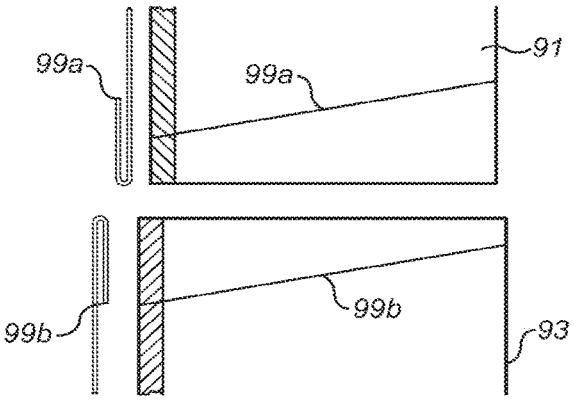
Figure 19:
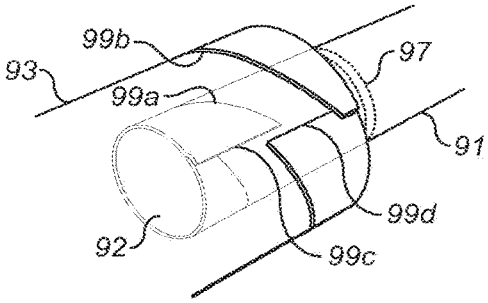
Figure 20:
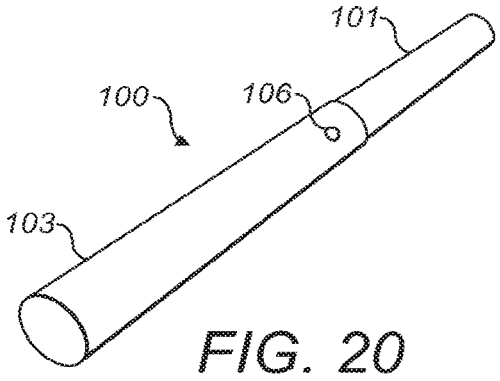
Figure 21A:
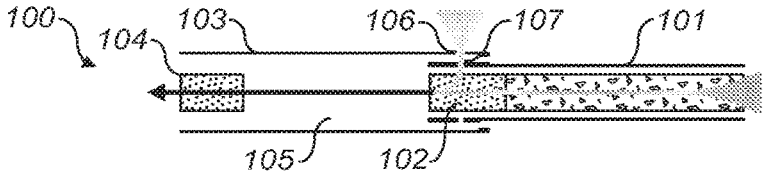
Figure 21B:
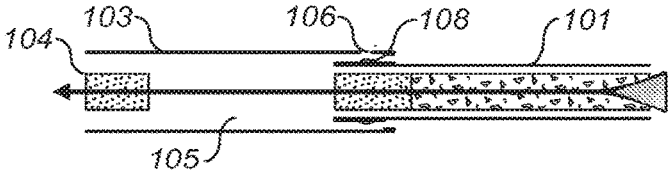
Figure 22:
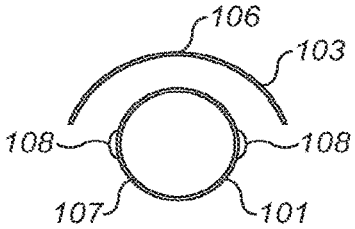
Figure 23:
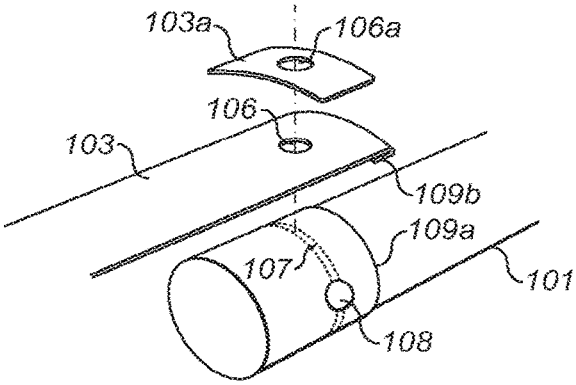
Figure 24:
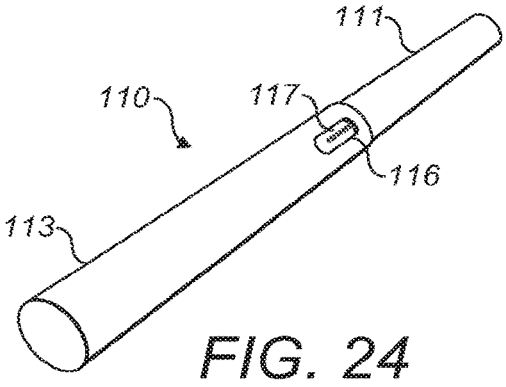
Figure 25A:
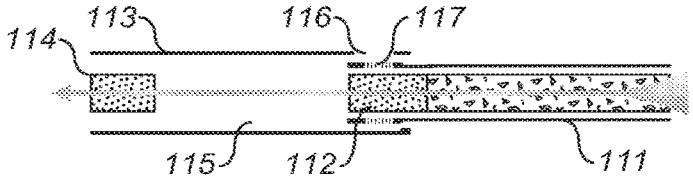
Figure 25B:
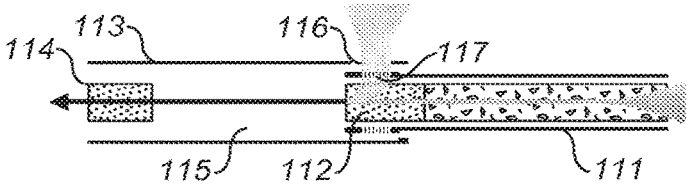
Figure 26:
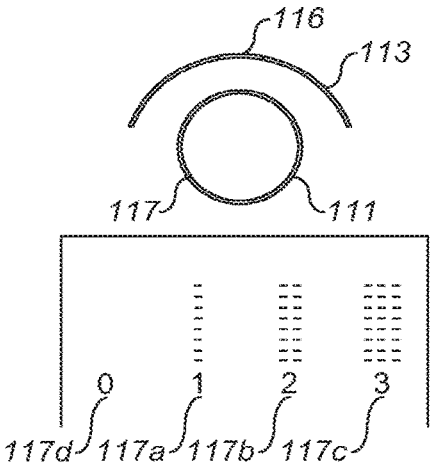
Figure 27:
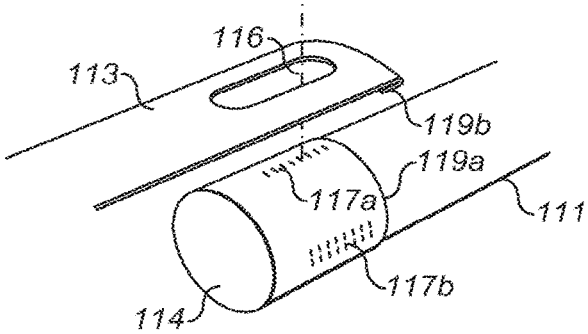
Figure 28:
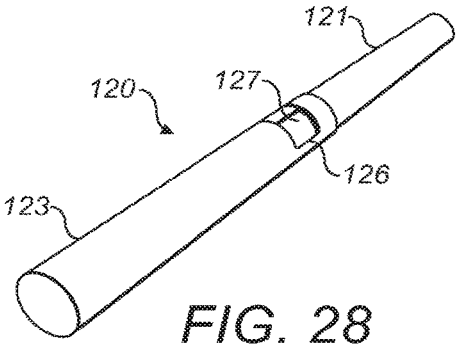
Figure 29A:
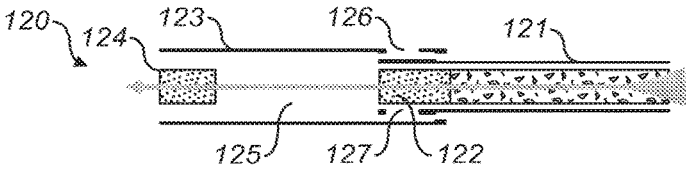
Figure 29B:
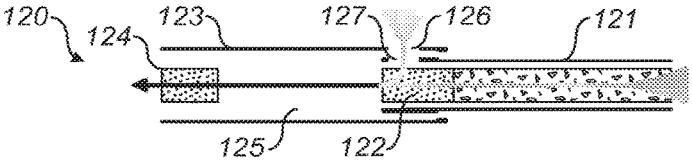
Figure 30:
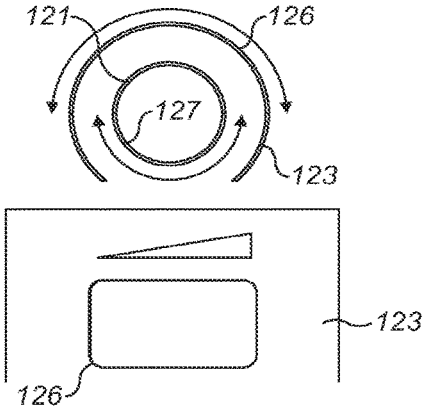
Figure 31:
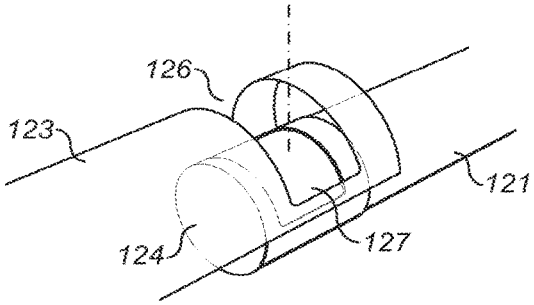

FIGS. 7*a* to 7*d* are side elevation views of the smoking article of FIG. 6 in first to fourth states respectively;

FIG. 8 is a perspective view of a smoking article with a second embodiment of a variable ventilation system;

FIG. 9*a* is a cross-section through the smoking article of FIG. 8, in a first state;

FIG. 9*b* is a cross-section through the smoking article of FIG. 8, in a second state;

FIG. 10 is a schematic plan view of part of the smoking article of FIG. 8;

FIG. 11*a* is an exploded perspective view of part of the smoking article of FIG. 8, in a first state;

FIG. 11*b* is an exploded perspective view of part of the smoking article of FIG. 8, in a second state;

FIG. 12 is a perspective view of a smoking article with a third embodiment of a variable ventilation system;

FIG. 13*a* is a cross-section through the smoking article of FIG. 12, in a first state;

FIG. 13*b* is a cross-section through the smoking article of FIG. 12, in a second state;

FIG. 14*a* is a cut-away plan view of part of the smoking article of FIG. 12, in the first state;

FIG. 14*b* is a cut-away plan view of part of the smoking article of FIG. 12, in the second state;

FIG. 15 is a partial cut-away perspective view of part of the smoking article of FIG. 12, in a second state;

FIG. 16 is a perspective view of a smoking article with a fourth embodiment of a variable ventilation system;

FIG. 17*a* is a cross-section through the smoking article of FIG. 16, in a first state;

FIG. 17*b* is a cross-section through the smoking article of FIG. 16, in a second state;

FIG. 18 is a schematic plan view of part of the smoking article of FIG. 16;

FIG. 19 is an exploded perspective view of part of the smoking article of FIG. 16;

FIG. 20 is a perspective view of a smoking article with a fifth embodiment of a variable ventilation system;

FIG. 21*a* is a cross-section through the smoking article of FIG. 20, in a first state;

FIG. 21*b* is a cross-section through the smoking article of FIG. 20, in a second state;

FIG. 22 is a cut-away end view of part of the smoking article of FIG. 20;

FIG. 23 is an exploded perspective view of part of the smoking article of FIG. 20, in a first state;

FIG. 24 is a perspective view of a smoking article with a sixth embodiment of a variable ventilation system;

FIG. 25*a* is a cross-section through the smoking article of FIG. 24, in a first state;

FIG. 25*b* is a cross-section through the smoking article of FIG. 24, in a second state;

FIG. 26 is a cut-away end view and extended plan view of part of the smoking article of FIG. 24;

FIG. 27 is an exploded perspective view of part of the smoking article of FIG. 24, FIG. 28 is a perspective view of a smoking article with a seventh embodiment of a variable ventilation system;

FIG. 29*a* is a cross-section through the smoking article of FIG. 28, in a first state;

FIG. 29*b* is a cross-section through the smoking article of FIG. 28, in a second state;

FIG. 30 is a cut-away end view and extended plan view of part of the smoking article of FIG. 28;

FIG. 31 is an exploded perspective view of part of the smoking article of FIG. 28.

Figure 32A:
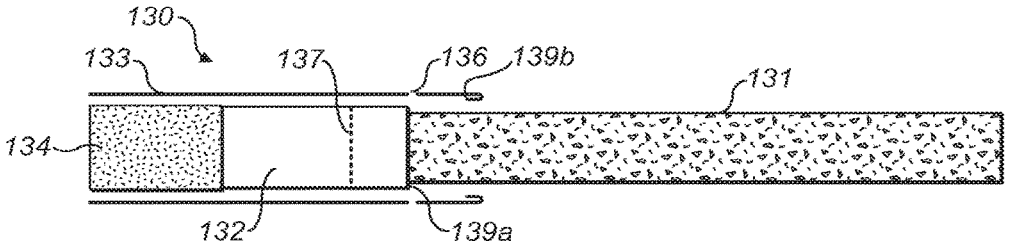
Figure 32B:
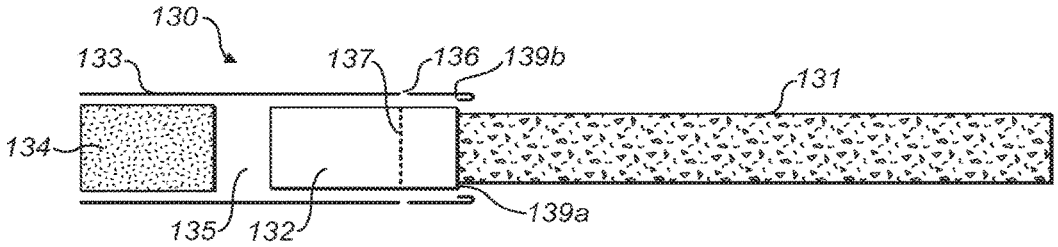
Figure 33:
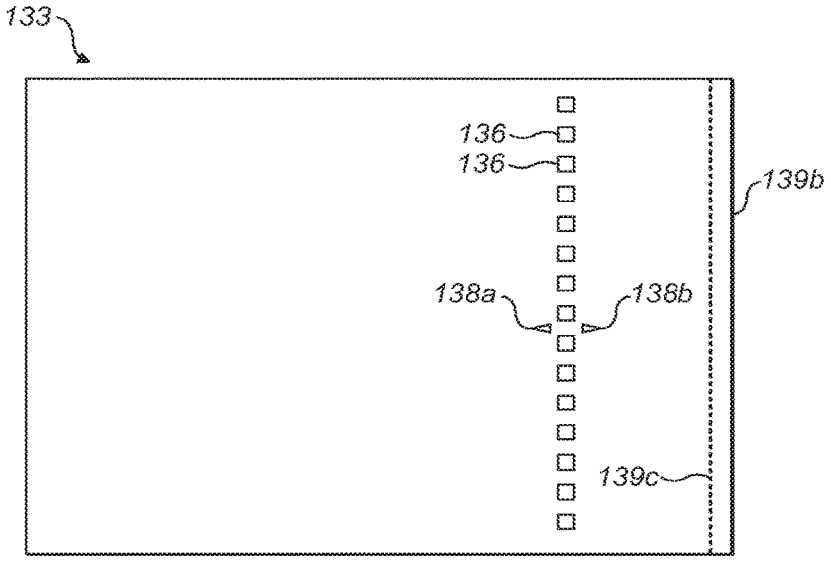
Figure 34A:
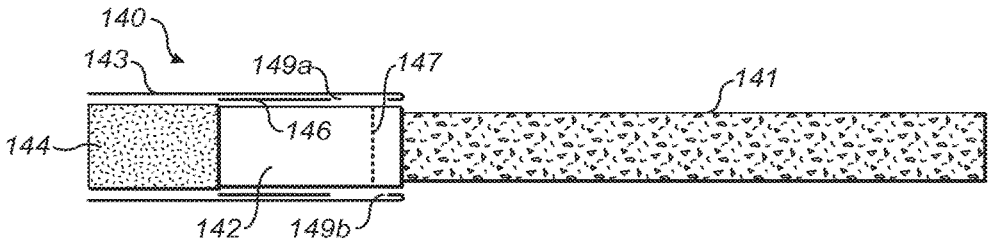
Figure 34B:
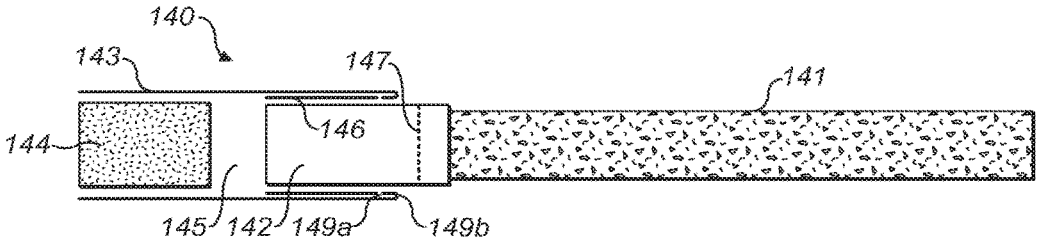
Figure 35:
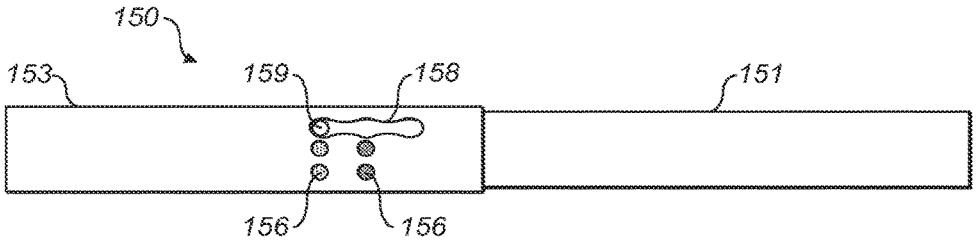
Figure 36A:
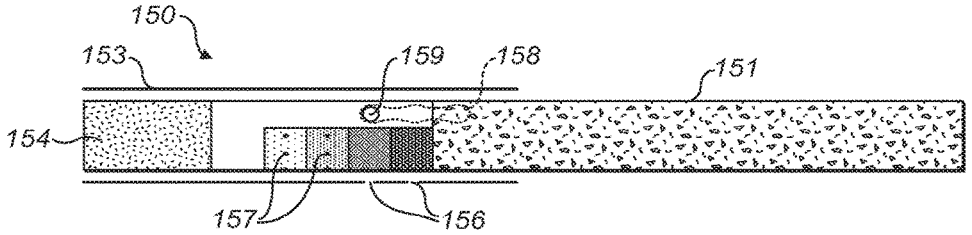
Figure 36B:
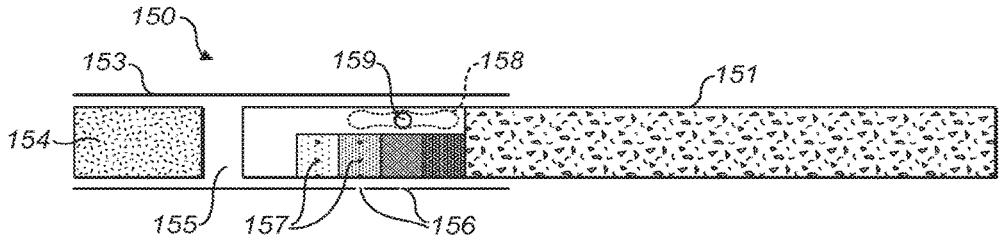
Figure 36C:
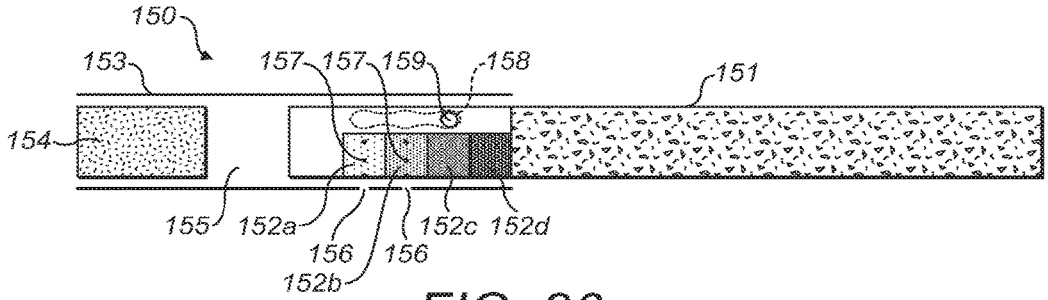
Figure 37:
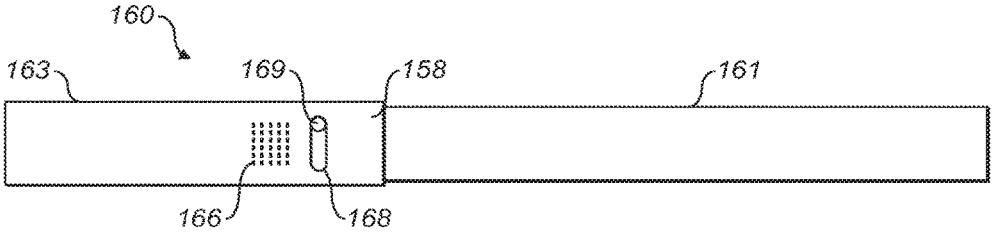
Figure 38A:
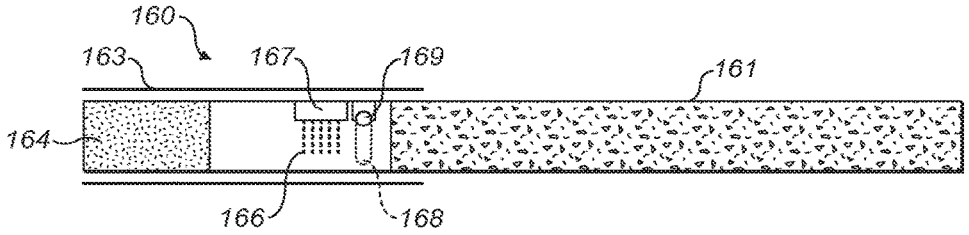
Figure 38B:
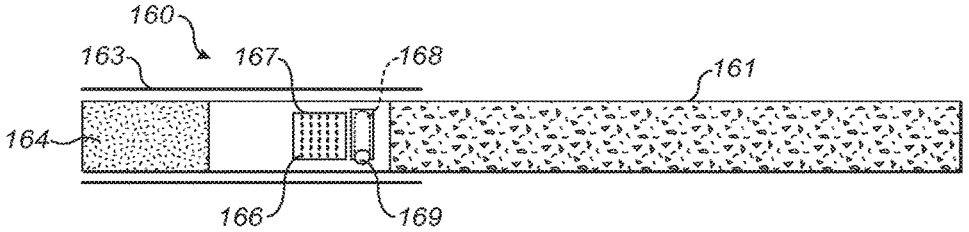
Figure 39:
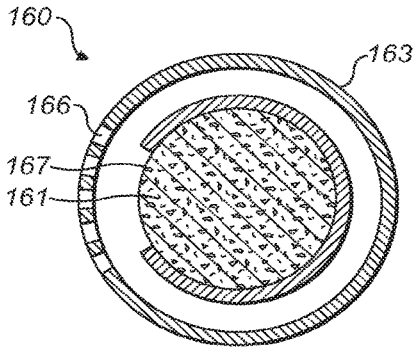
Figure 40:
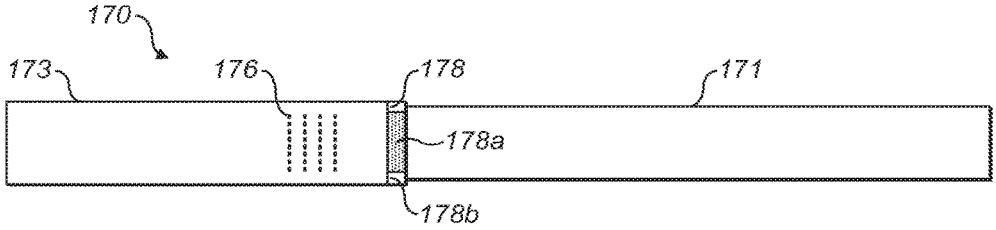
Figure 41A:
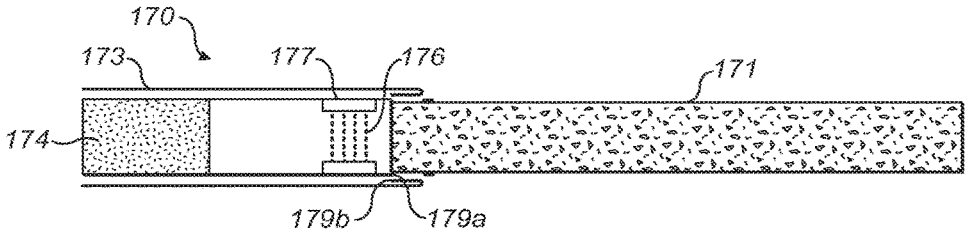
Figure 41B:
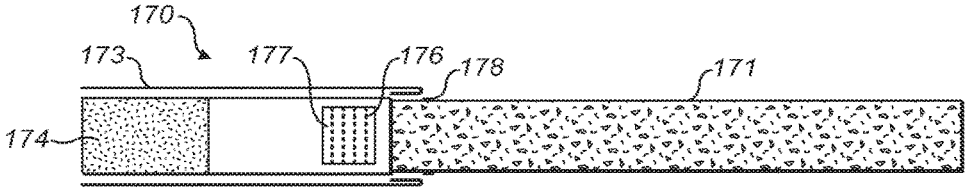
Figure 42:
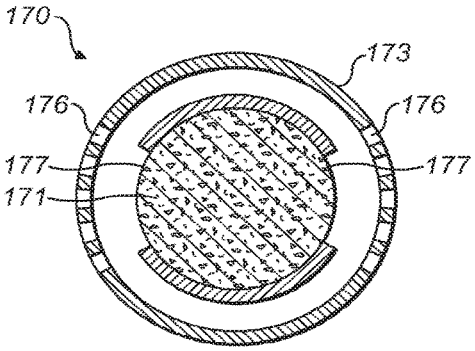
Figure 43A:
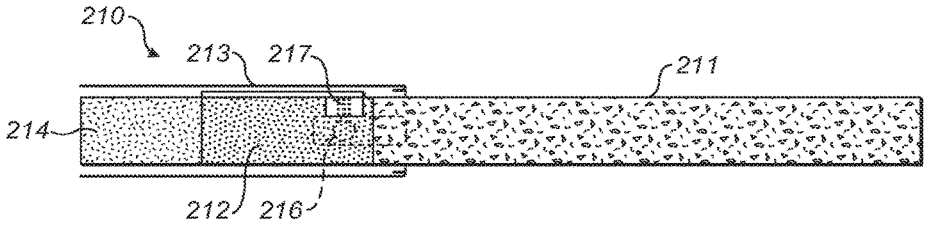
Figure 43B:
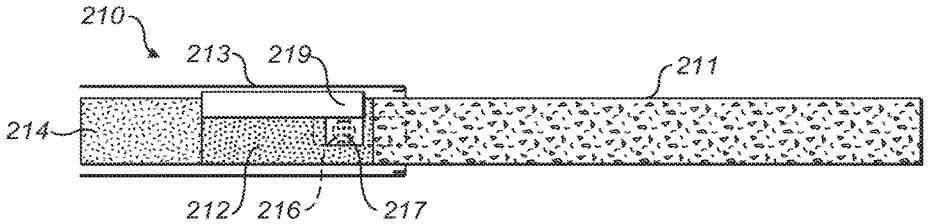
Figure 44:
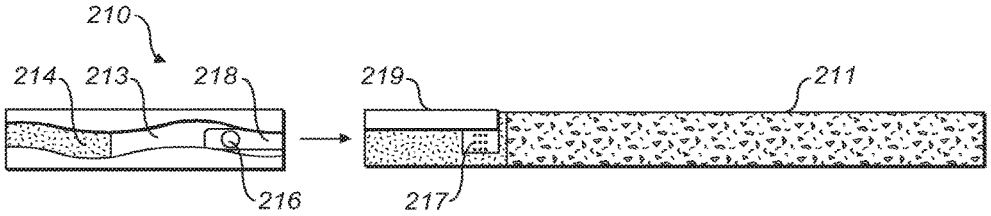
Figure 45:
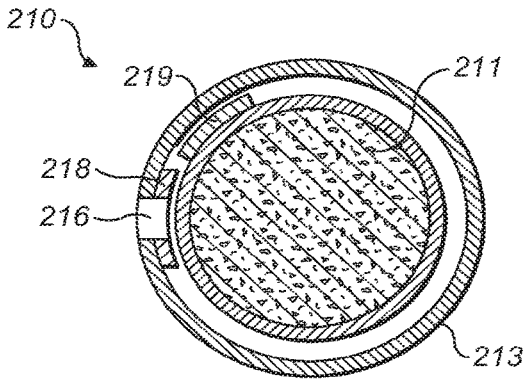
Figure 46:
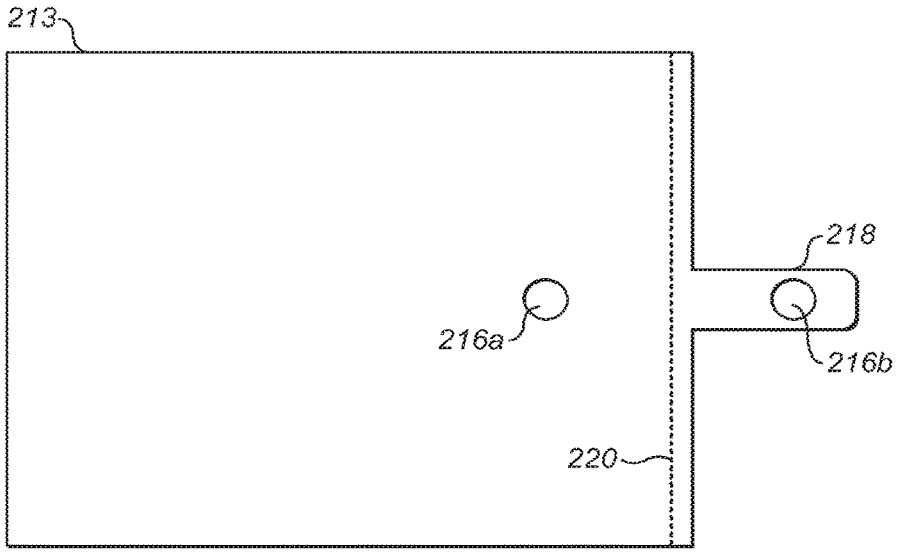
Figure 47:
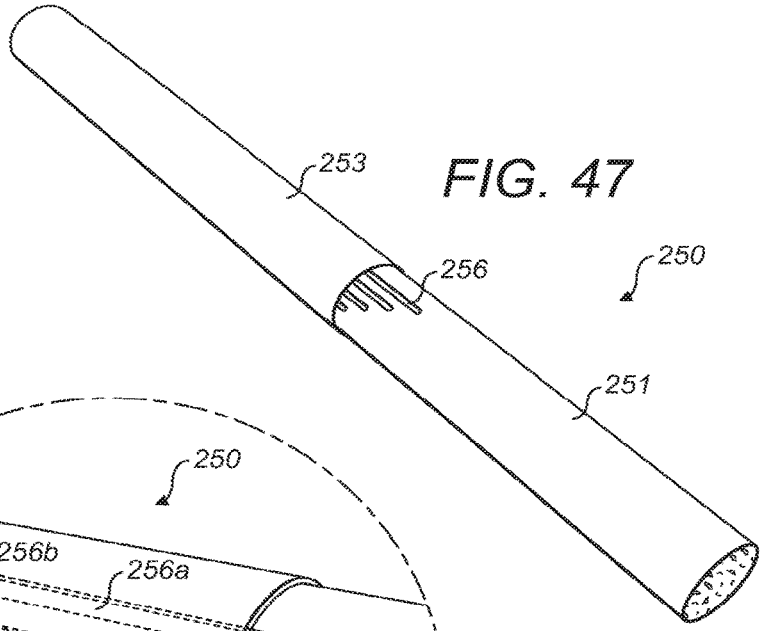
Figure 48:
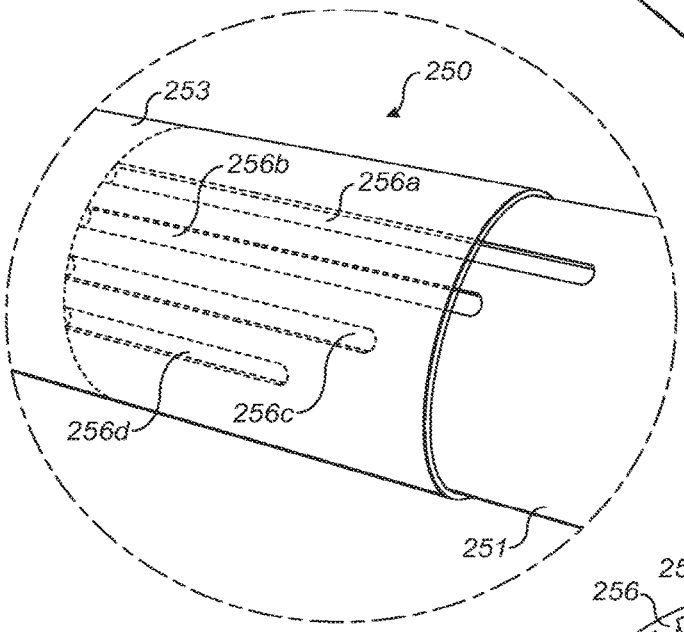
Figure 49:
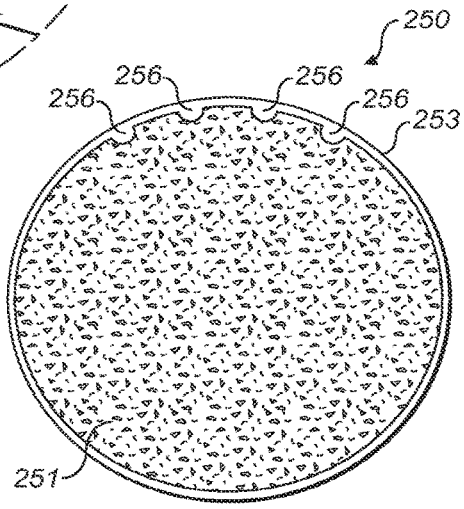
Figure 50:
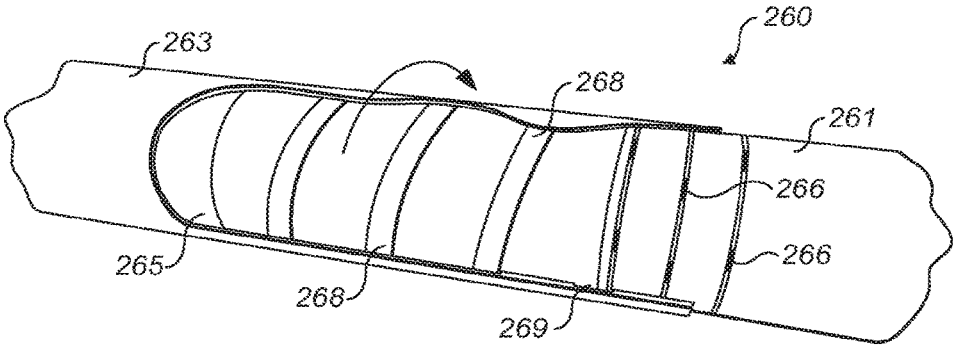
Figure 51A:
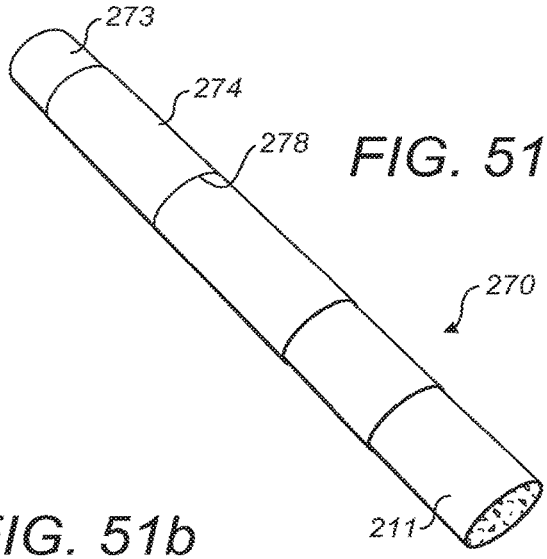
Figure 51B:
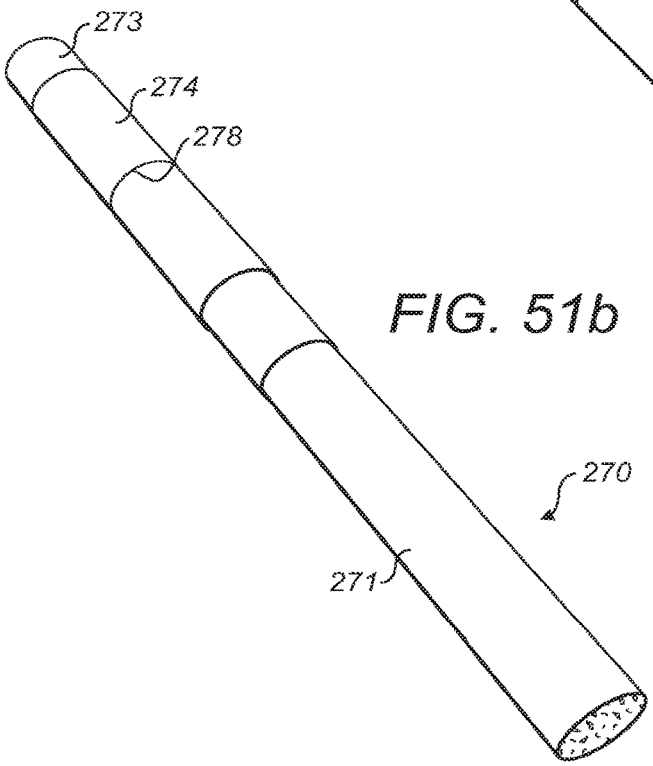
Figure 52:
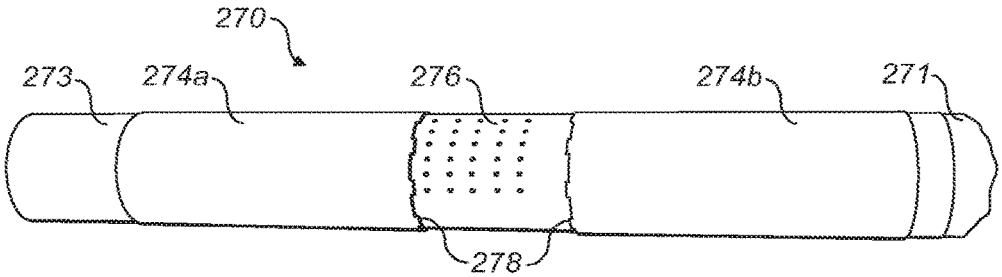
Figure 53:
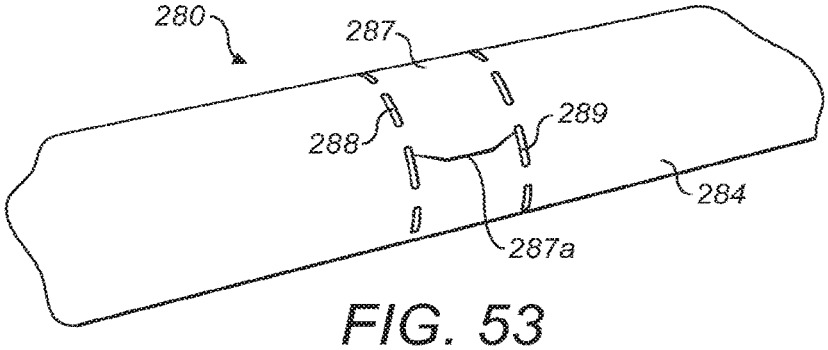
Figure 54:
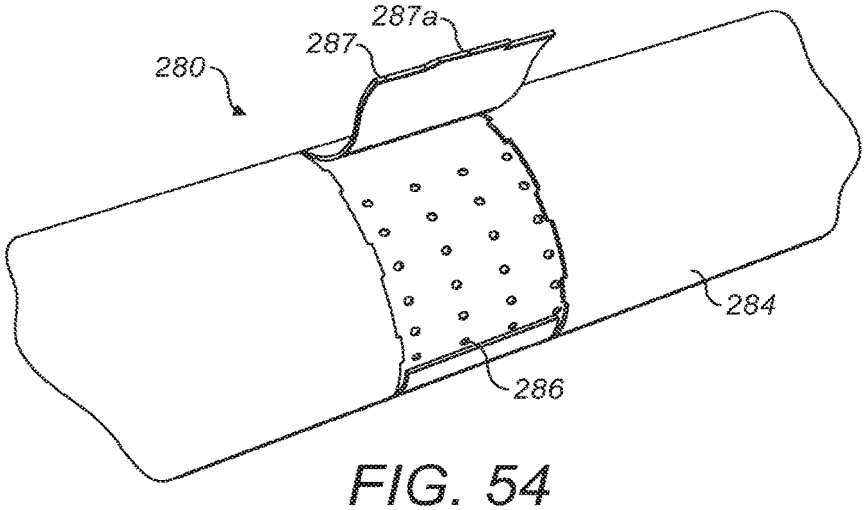
Figure 55:
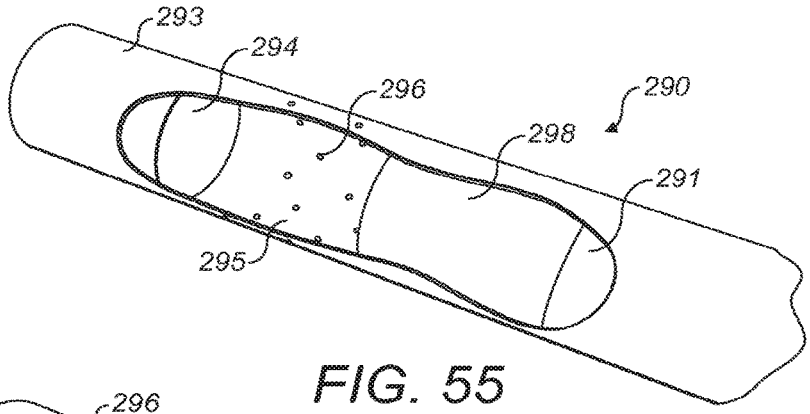
Figure 56:
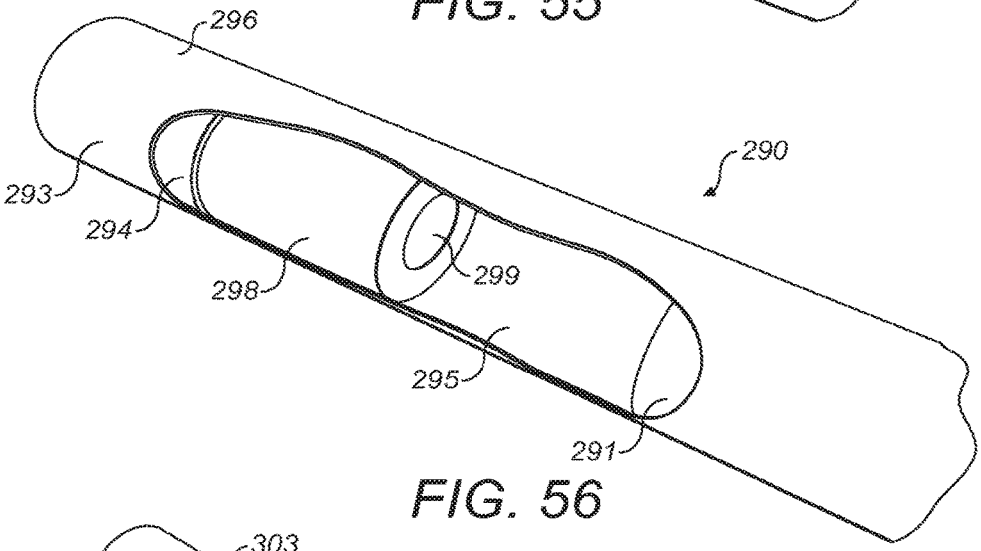
Figure 57:
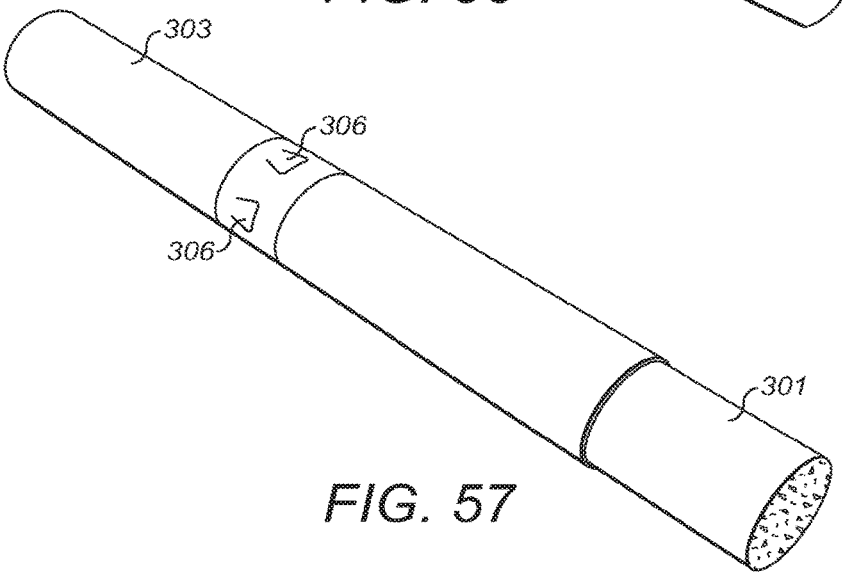
Figure 58:
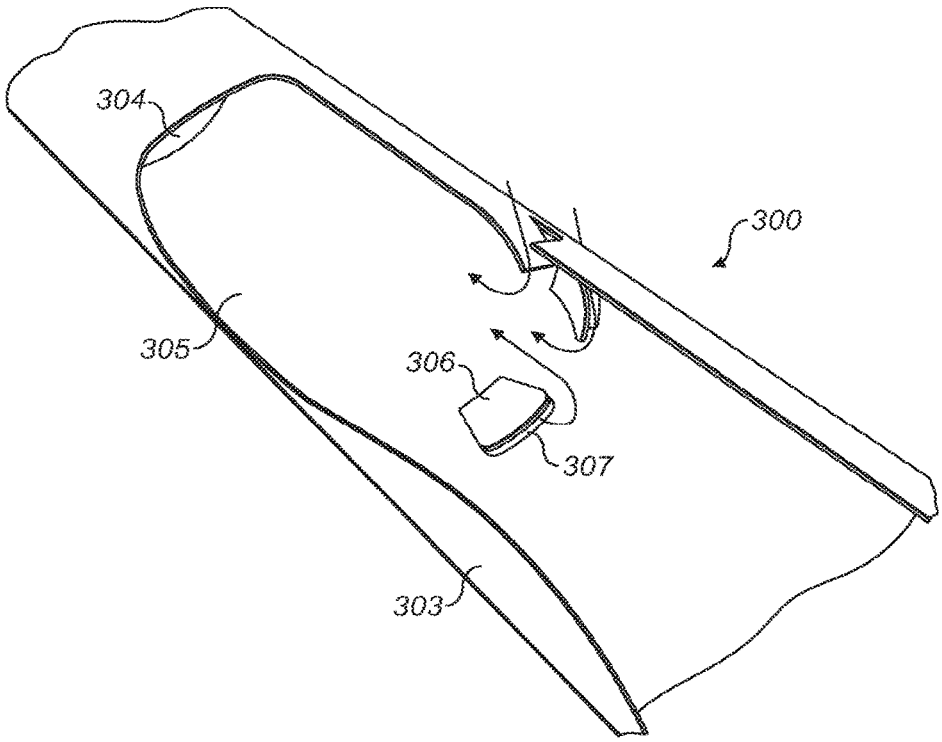
Figure 59:
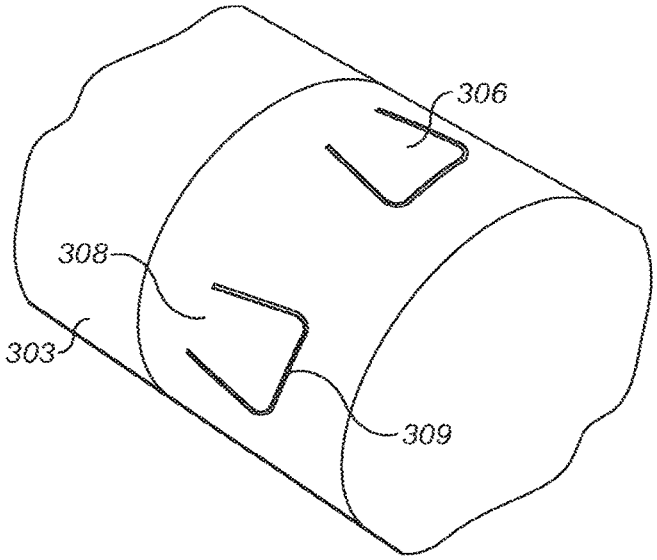
Figure 60A:
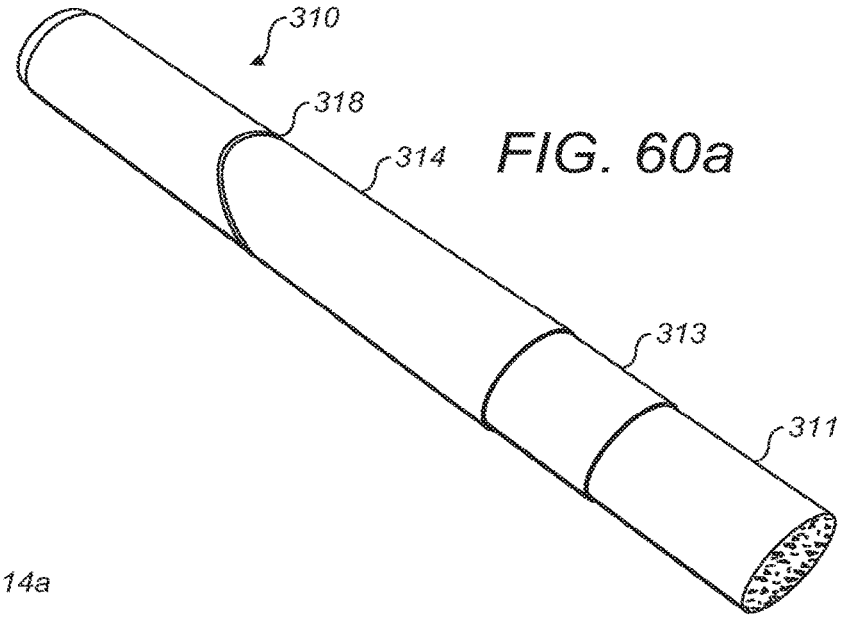
Figure 60B:
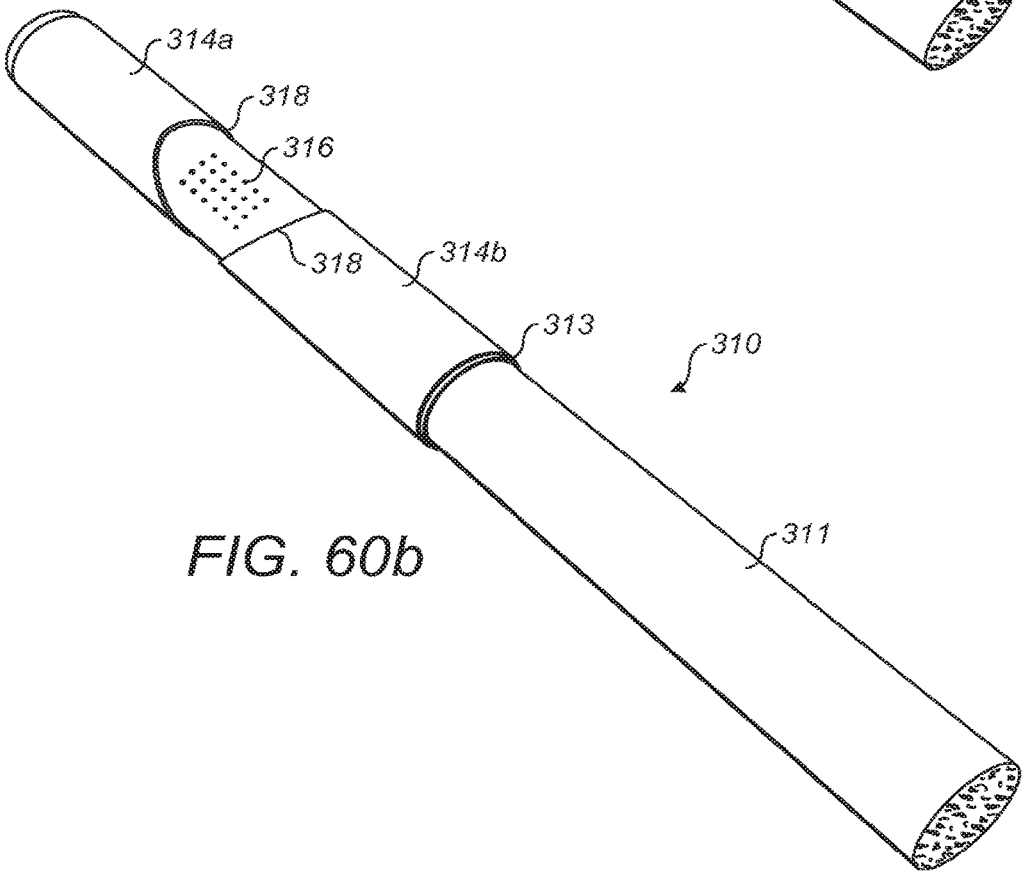
Figure 61A:
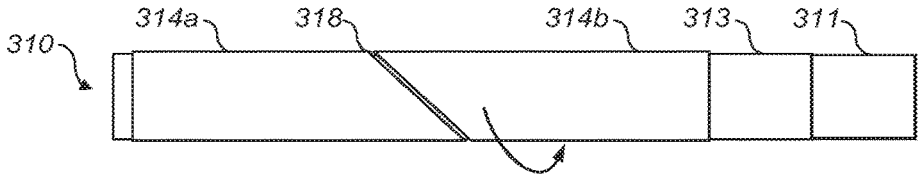
Figure 61B:
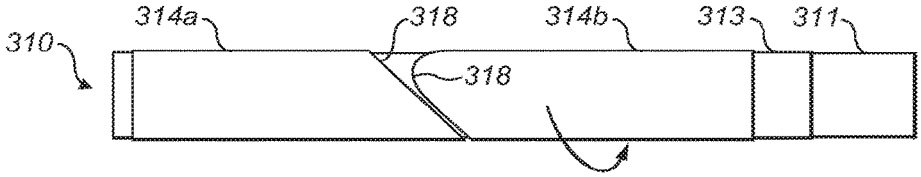
Figure 61C:
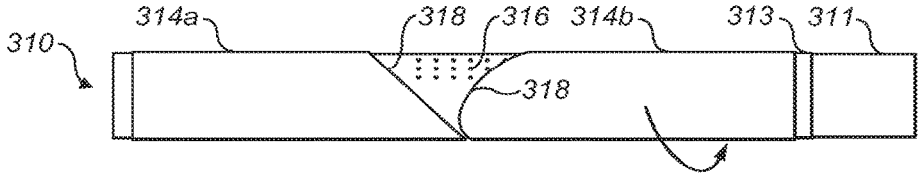
Figure 61D:
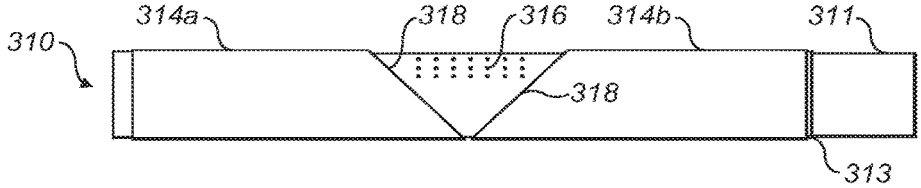
Figure 62:
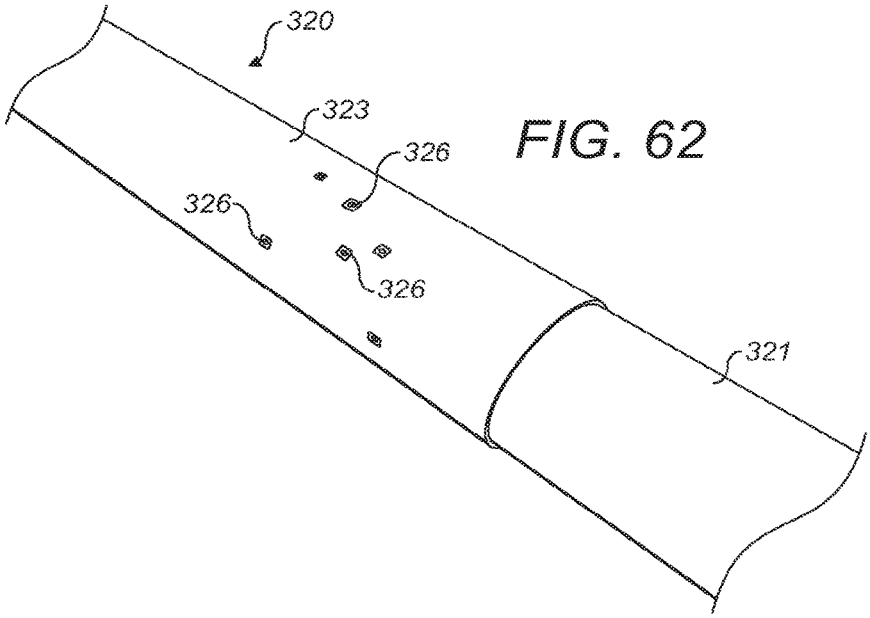
Figure 63A:
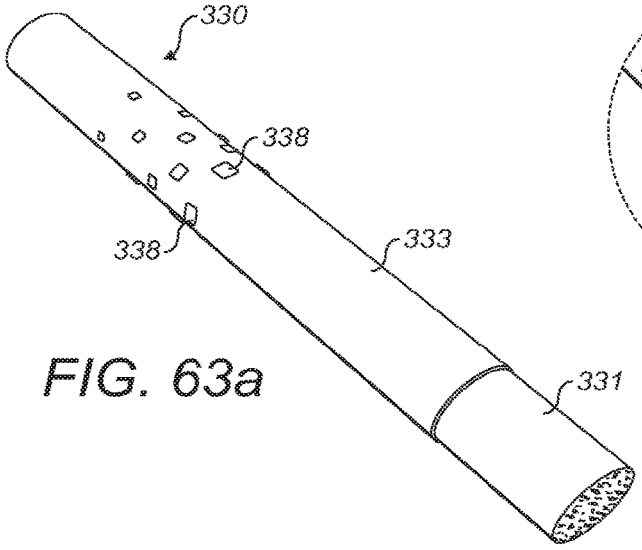
Figure 63B:
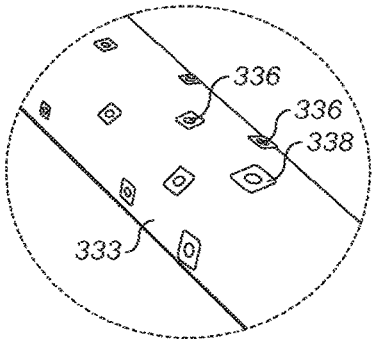
Figure 64:
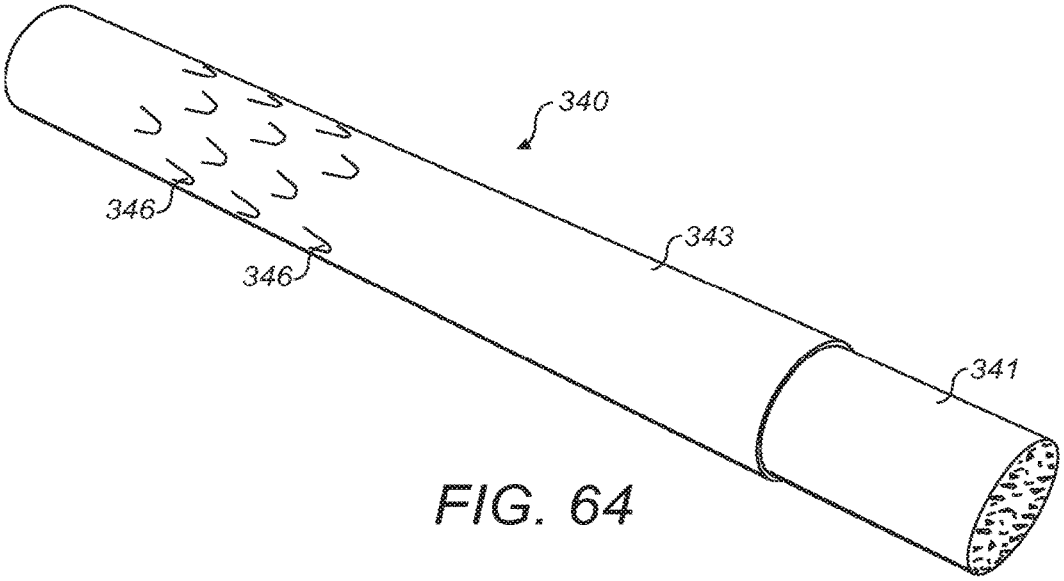
Figure 65:
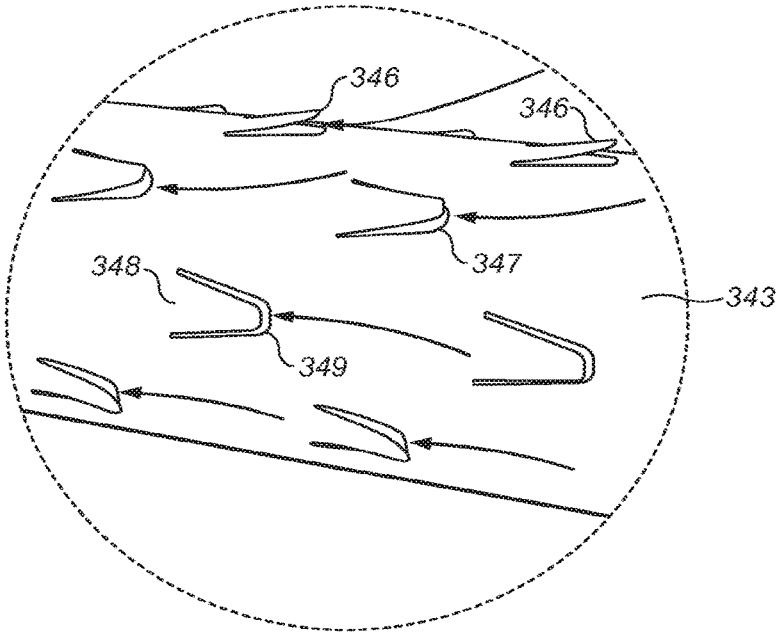
Figure 66:
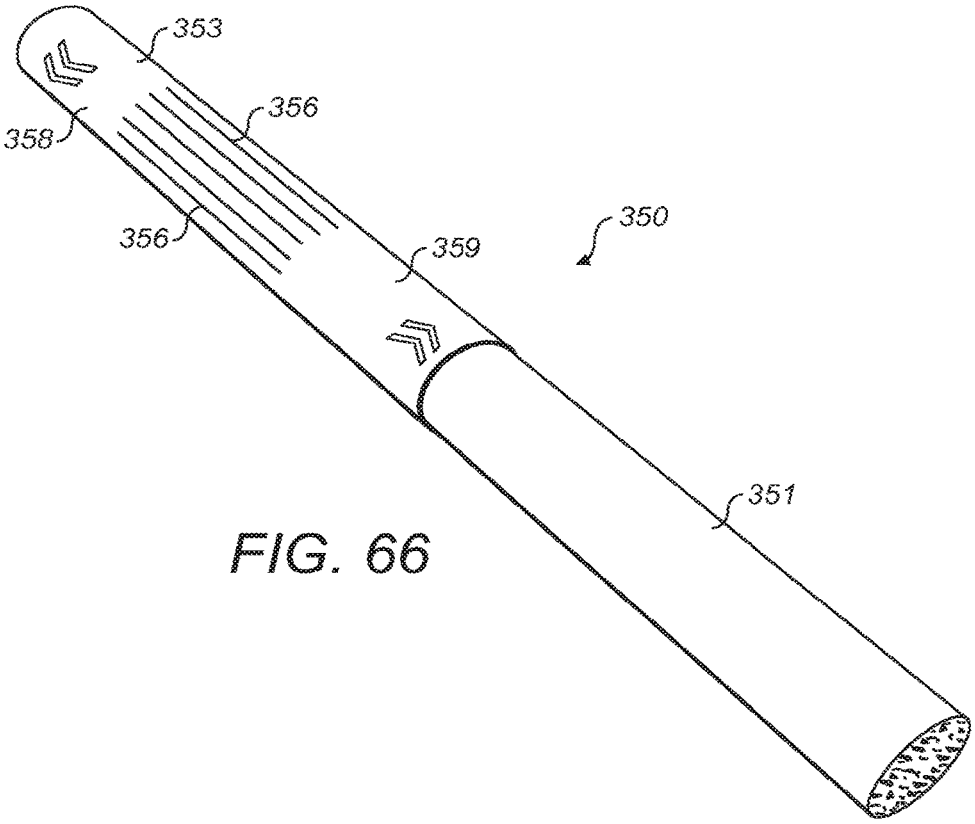
Figure 67:
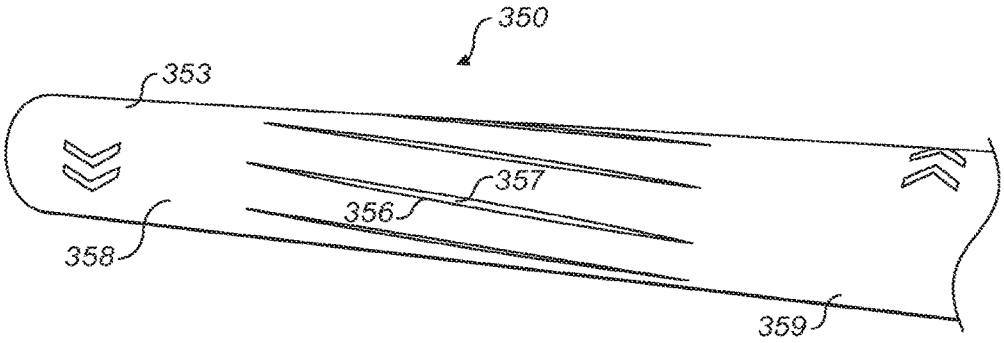
Figure 68:
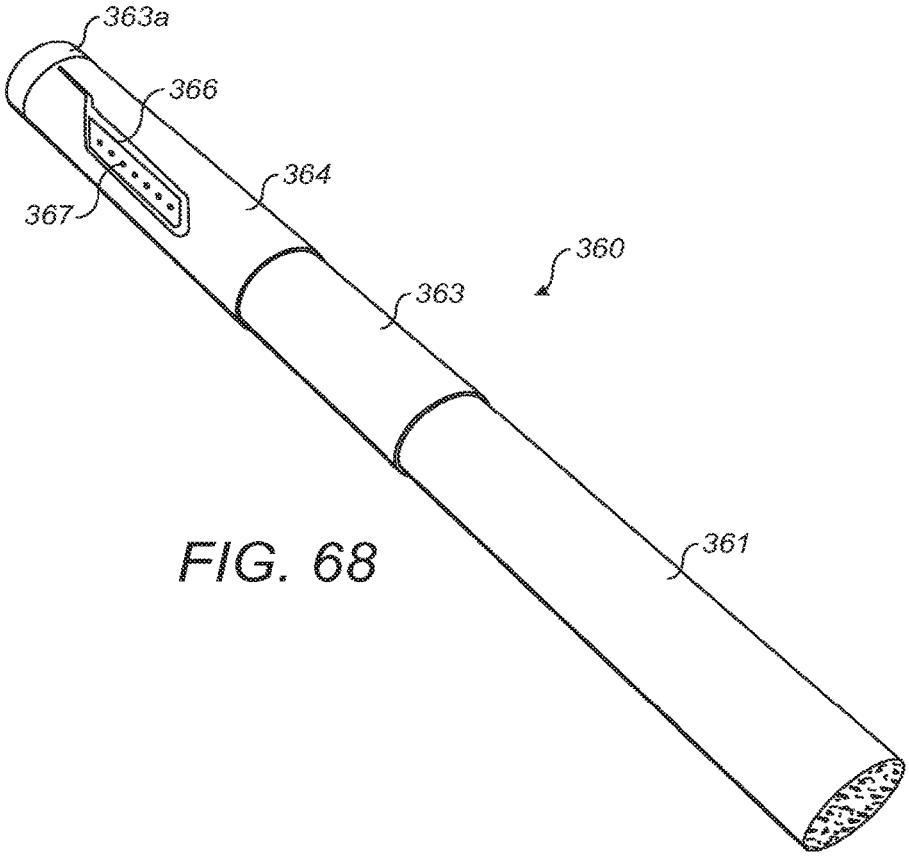
Figure 69:
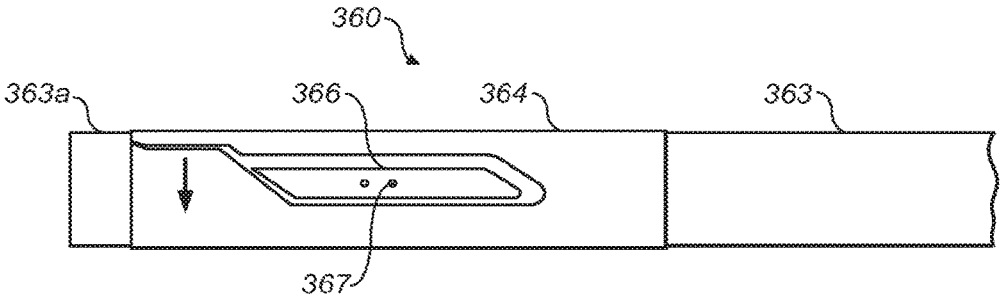
Figure 70:
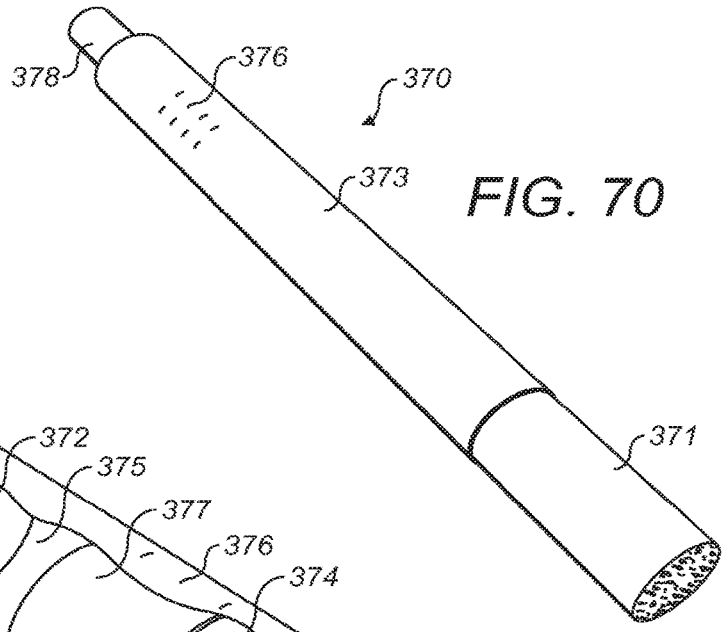
Figure 71A:
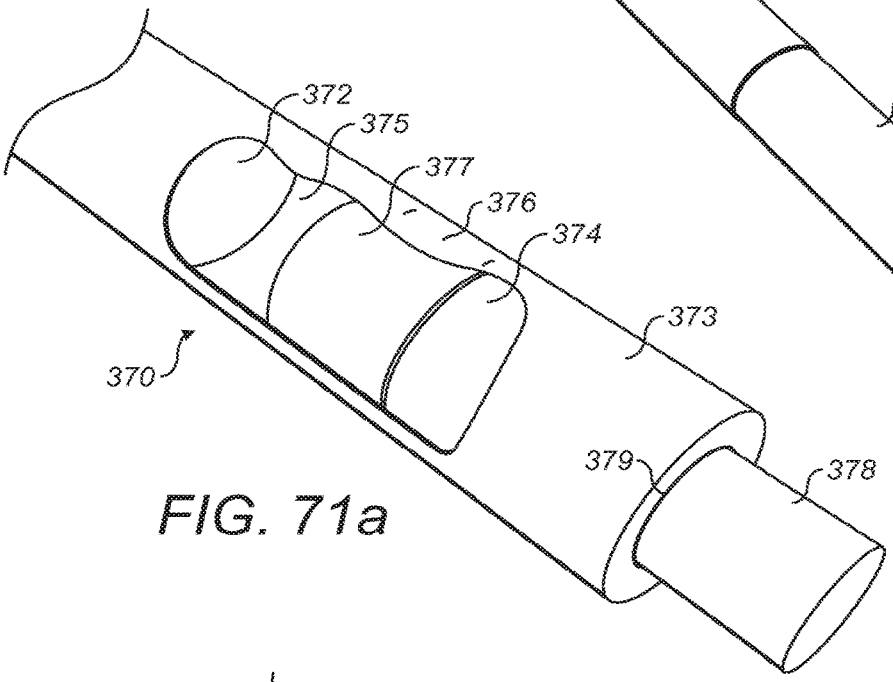
Figure 71B:
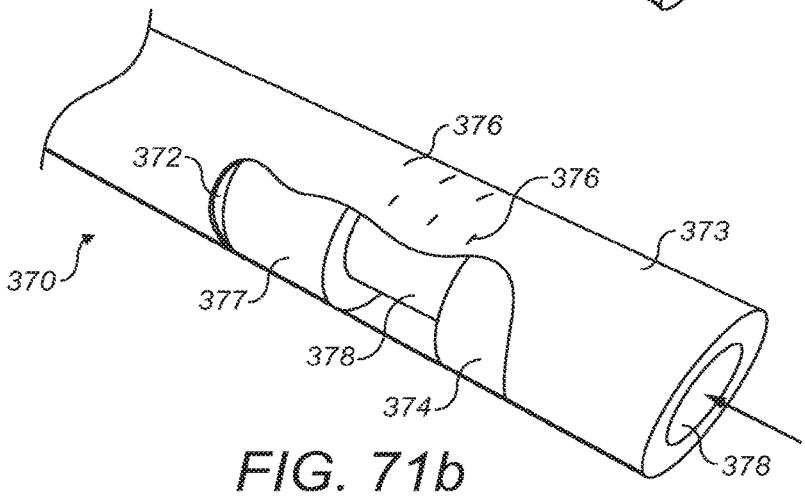
Figure 72:
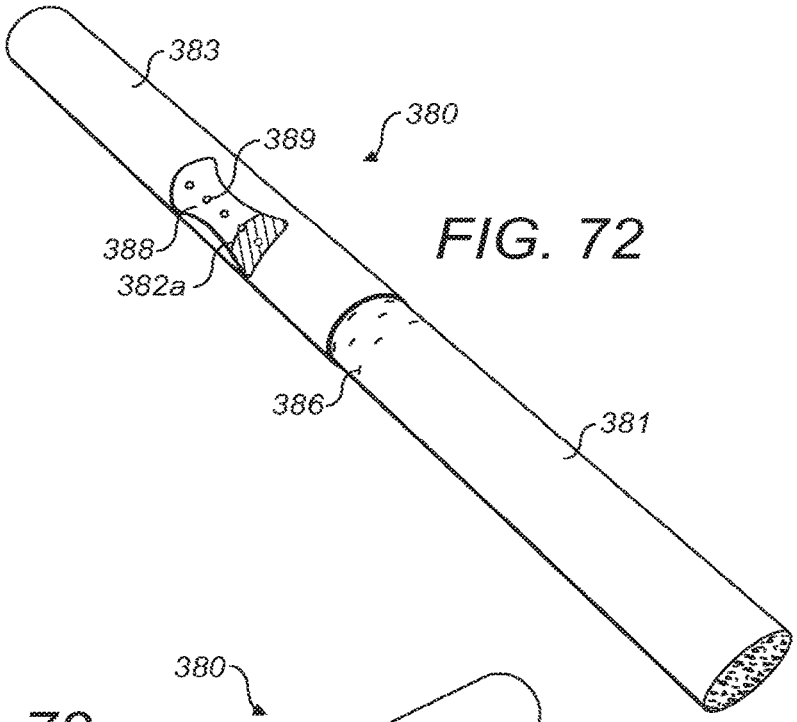
Figure 73:
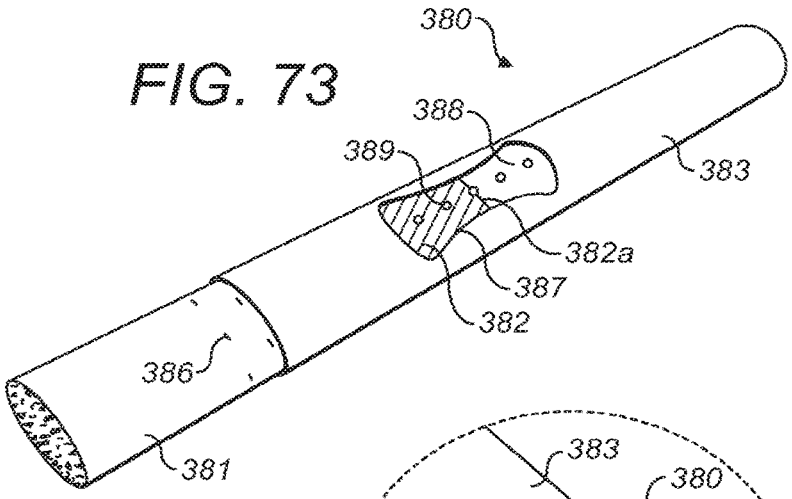
Figure 74:
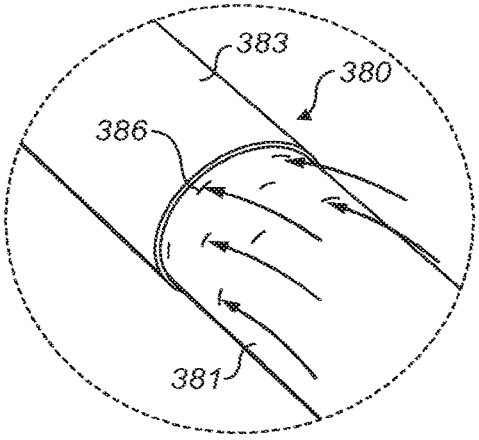
Figure 75:
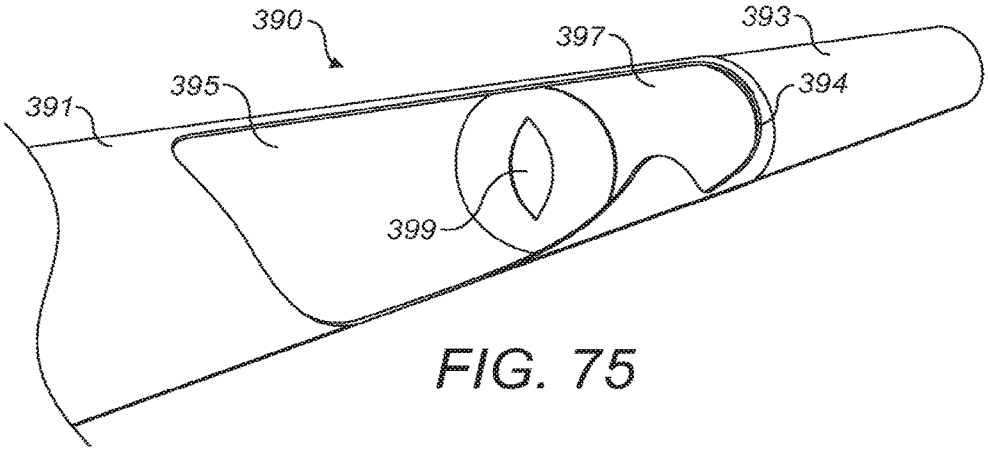
Figure 76A:
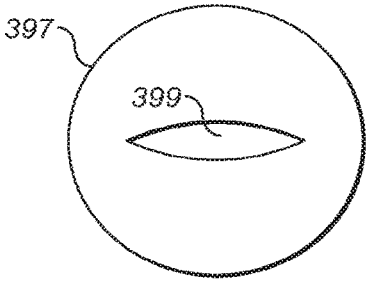
Figure 76B:
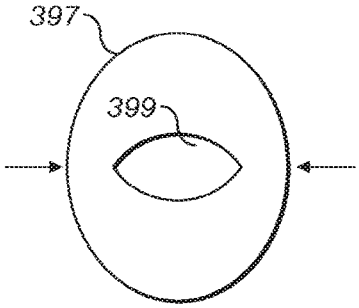
Figure 76C:
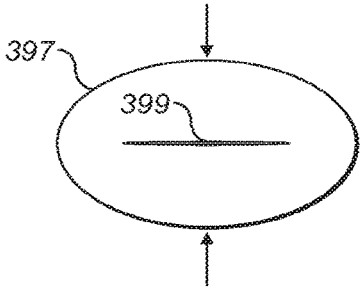

FIG. 32*a* is a cut-away side elevation view of a smoking article with an eighth embodiment of a variable flow system in a first state;

FIG. 32*b* is a cut-away side elevation view of a smoking article with the eighth embodiment of a variable flow system in a second state;

FIG. 33 is a plan view of a part of the smoking article with the eighth embodiment of a variable flow system;

FIG. 34*a* is a cut-away side elevation view of a smoking article with a ninth embodiment of a variable flow system in a first state;

FIG. 34*b* is a cut-away side elevation view of a smoking article with the ninth embodiment of a variable flow system in a second state;

FIG. 35 is a side elevation view of a smoking article with a tenth embodiment of a variable flow system in a first state;

FIG. 36*a* is a cut-away side elevation view of a smoking article with the tenth embodiment of a variable flow system in the first state;

FIG. 36*b* is a cut-away side elevation view of a smoking article with the tenth embodiment of a variable flow system in a second state;

FIG. 36*c* is a cut-away side elevation view of a smoking article with the tenth embodiment of a variable flow system in a third state;

FIG. 37 is a side elevation view of a smoking article with an eleventh embodiment of a variable flow system in a first state;

FIG. 38*a* is a cut-away side elevation view of a smoking article with the eleventh embodiment of a variable flow system in the first state;

FIG. 38*b* is a cut-away side elevation view of a smoking article with the eleventh embodiment of a variable flow system in a second state;

FIG. 39 is a cross-sectional front elevation view of a smoking article with the eleventh embodiment of a variable flow system in the second state;

FIG. 40 is a side elevation view of a smoking article with a twelfth embodiment of a variable flow system in a first state;

FIG. 41*a* is a cut-away side elevation view of a smoking article with the twelfth embodiment of a variable flow system in the first state;

FIG. 41*b* is a cut-away side elevation view of a smoking article with the twelfth embodiment of a variable flow system in a second state;

FIG. 42 is a cross-sectional front elevation view of a smoking article with the twelfth embodiment of a variable flow system in the second state;

FIG. 43*a* is a cut-away side elevation view of a smoking article with a thirteenth embodiment of a variable flow system in a first state;

FIG. 43*b* is a cut-away side elevation view of a smoking article with the thirteenth embodiment of a variable flow system in a second state;

FIG. 44 is an exploded cut-away side elevation view of a smoking article with the thirteenth embodiment of a variable flow system in the second state;

FIG. 45 is a cross-sectional front elevation view of a smoking article with the thirteenth embodiment of a variable flow system in the second state;

FIG. 46 is a plan view of a part of the smoking article with the thirteenth embodiment of variable flow system;

FIG. 47 is a perspective view of a smoking article with a fourteenth embodiment of a variable flow system in a first state;

FIG. 48 is a perspective view of a smoking article with the fourteenth embodiment of a variable flow system in a second state;

FIG. 49 is a front elevation cross-sectional view of the smoking article with the fourteenth embodiment of variable flow system;

FIG. 50 is a perspective view of a smoking article with a fifteenth embodiment of a variable flow system;

FIG. 51*a* is a perspective view of a smoking article with a sixteenth embodiment of a variable flow system in a first state;

FIG. 51*b* is a perspective view of a smoking article with a sixteenth embodiment of a variable flow system in a second state;

FIG. 52 is a side elevation view of a smoking article with the sixteenth embodiment of a variable flow system in a second state;

FIG. 53 is a perspective view of a smoking article with a seventeenth embodiment of a variable flow system in a first state;

FIG. 54 is a perspective view of a smoking article with the seventeenth embodiment of a variable flow system in a second state;

FIG. 55 is a perspective view of a smoking article with an eighteenth embodiment of a variable flow system in a first state;

FIG. 56 is a perspective view of a smoking article with an eighteenth embodiment of a variable flow system in a second state;

FIG. 57 is a perspective view of a smoking article with a nineteenth embodiment of a variable flow system in a first state;

FIG. 58 is a cut-away perspective view of a smoking article with the nineteenth embodiment of a variable flow system in a second state;

FIG. 59 is a perspective view of a smoking article with the nineteenth embodiment of a variable flow system in the first state;

FIG. 60*a* is a perspective view of a smoking article with a twentieth embodiment of a variable flow system in a first state;

FIG. 60*b* is a perspective view of a smoking article with a twentieth embodiment of a variable flow system in a second state;

FIG. 61*a* is a side elevation view of a smoking article with a twentieth embodiment of a variable flow system in the first state;

FIG. 61*b* is a side elevation view of a smoking article with a twentieth embodiment of a variable flow system in a third state;

FIG. 61*c* is a side elevation view of a smoking article with a twentieth embodiment of a variable flow system in a fourth state;

FIG. 61*d* is a side elevation view of a smoking article with a twentieth embodiment of a variable flow system in the second state;

FIG. 62 is a perspective view of a smoking article with a twenty-first embodiment of a variable flow system;

FIG. 63*a* is a perspective view of a smoking article with a twenty-second embodiment of a variable flow system in a first state;

FIG. 63*b* is a perspective view of a smoking article with a twenty-second embodiment of a variable flow system in a second state;

FIG. 64 is a perspective view of a smoking article with a twenty-third embodiment of a variable flow system in a first state;

FIG. 65 is a perspective view of a smoking article with a twenty-third embodiment of a variable flow system in a second state;

FIG. 66 is a perspective view of a smoking article with a twenty-fourth embodiment of a variable flow system in a first state;

FIG. 67 is a perspective view of a smoking article with a twenty-fourth embodiment of a variable flow system in a second state;

FIG. 68 is a perspective view of a smoking article with a twenty-fifth embodiment of a variable flow system in a first state;

FIG. 69 is a side elevation view of a smoking article with a twenty-fifth embodiment of a variable flow system in a second state;

FIG. 70 is a perspective view of a smoking article with a twenty-sixth embodiment of a variable flow system;

FIG. 71*a* is a cut-away perspective view of a smoking article with a twenty-sixth embodiment of a variable flow system in a first state;

FIG. 71*b* is a cut-away perspective view of a smoking article with a twenty-sixth embodiment of a variable flow system in a second state;

FIG. 72 is a perspective view of a smoking article with a twenty-seventh embodiment of a variable flow system in a first state;

FIG. 73 is a side elevation view of a smoking article with a twenty-seventh embodiment of a variable flow system in a second state;

FIG. 74 is a perspective view of a smoking article with a twenty-seventh embodiment of a variable flow system in a third state;

FIG. 75 is a cut-away perspective view of a smoking article with a twenty-eighth embodiment of a variable flow system in a first state;

FIG. 76*a* is a front elevation cross-sectional view of a smoking article with a twenty-eighth embodiment of a variable flow system in the first state;

FIG. 76*b* is a front elevation cross-sectional view of a smoking article with a twenty-eighth embodiment of a variable flow system in a second state;

FIG. 76*c* is a front elevation cross-sectional view of a smoking article with a twenty-eighth embodiment of a variable flow system in a third state.

Figure 77:
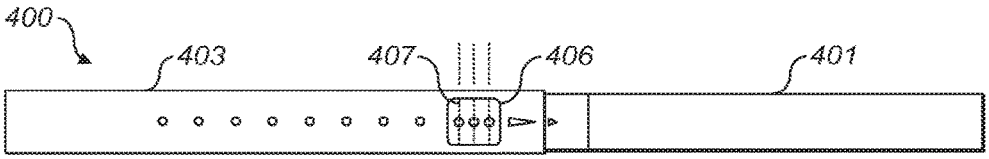
Figure 78:
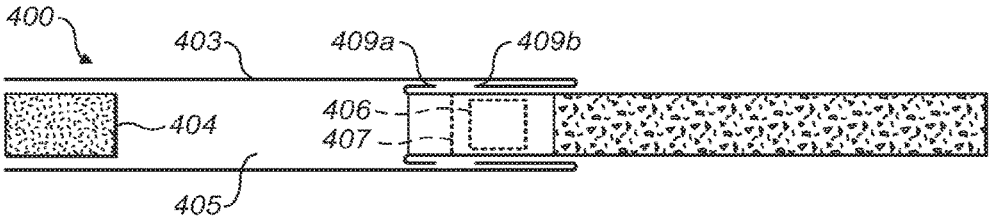
Figure 79:
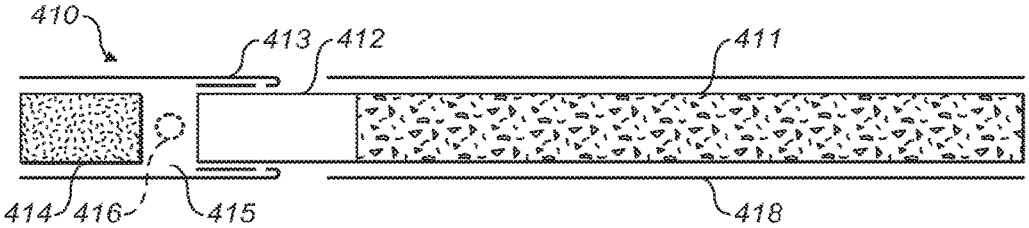
Figure 80:
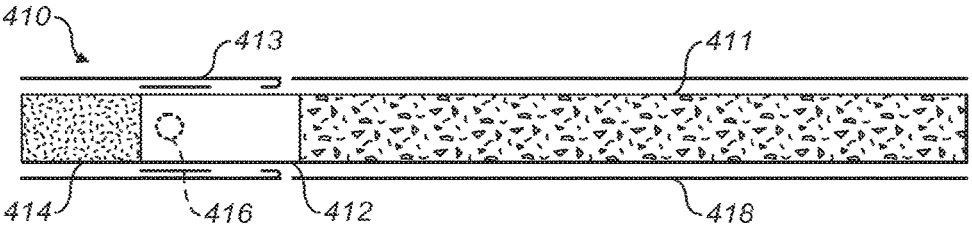
Figure 81:
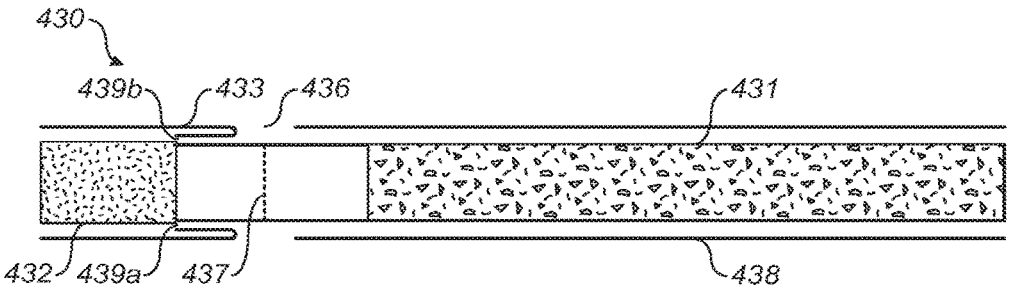
Figure 82:
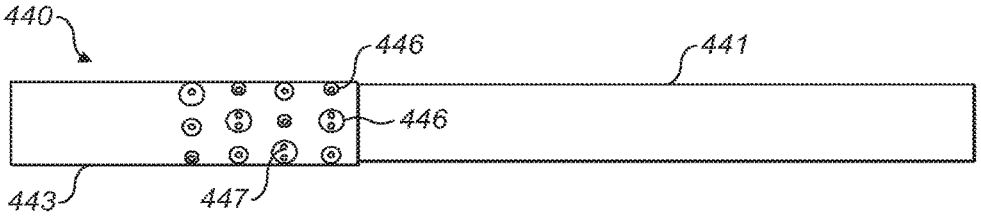
Figure 83:
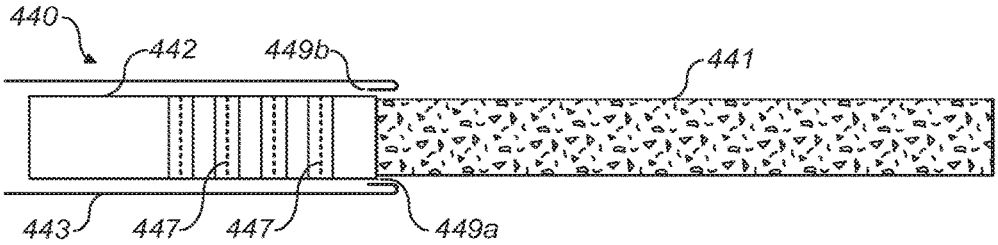
Figure 84:
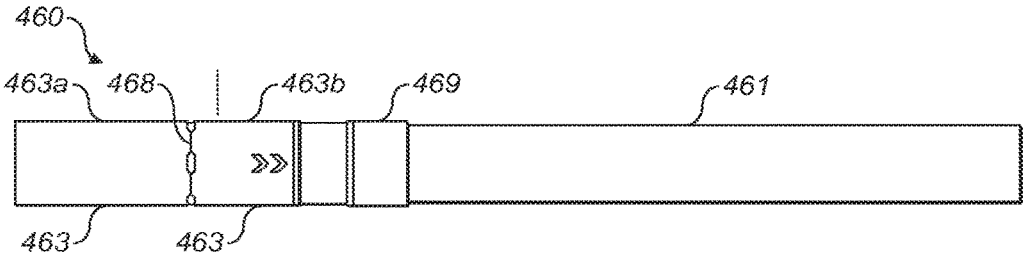
Figure 85:
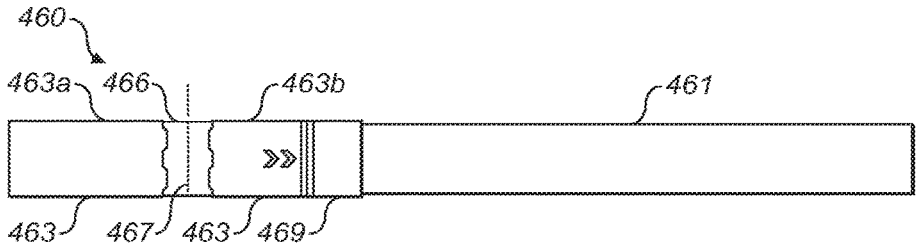
Figure 86:
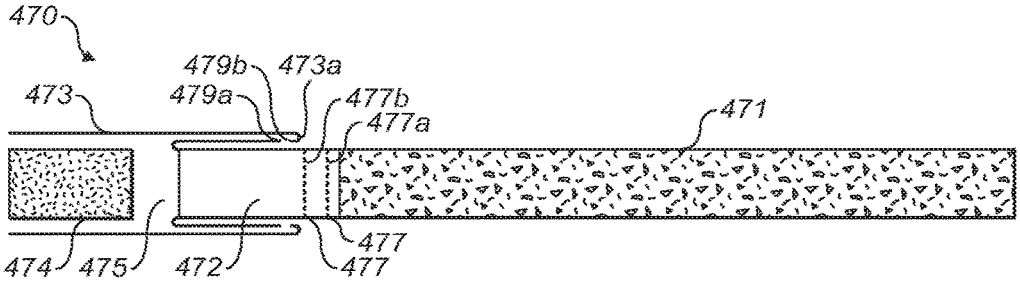
Figure 87:
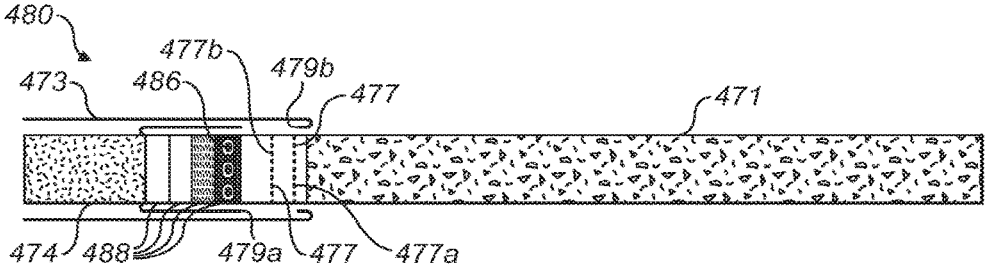
Figure 88:
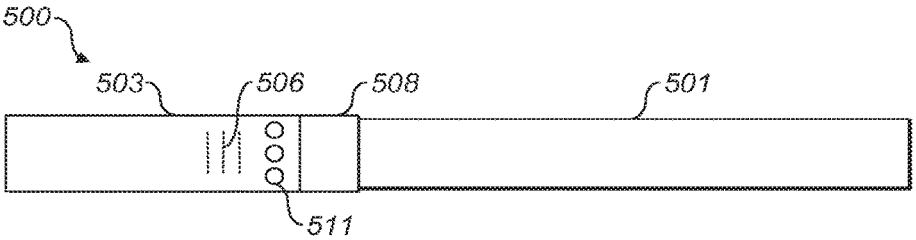
Figure 89:
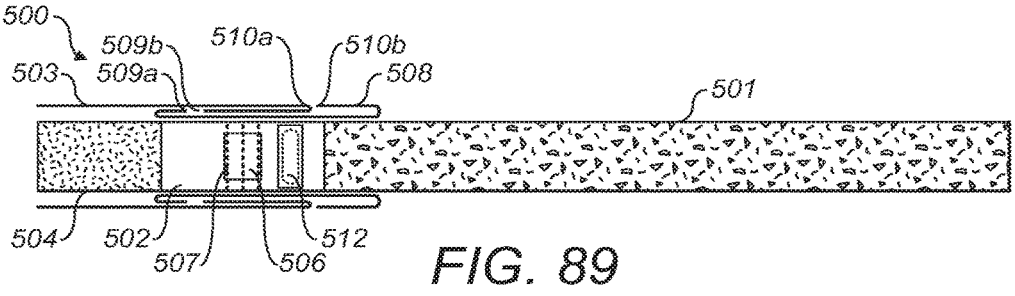
Figure 90A:
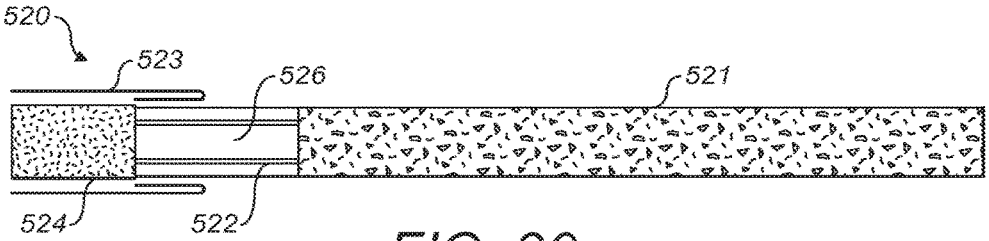
Figure 90B:
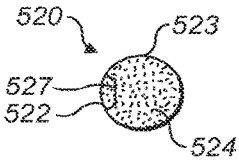
Figure 91A:
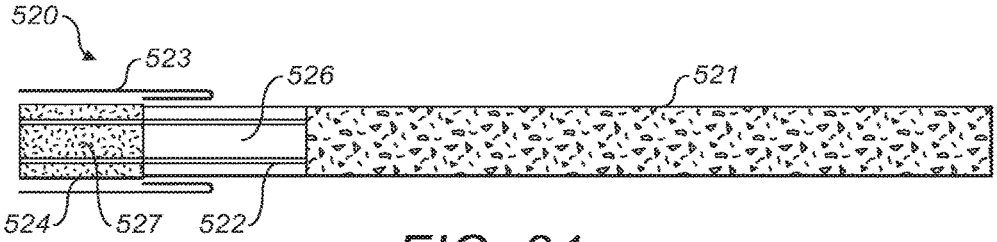
Figure 91B:
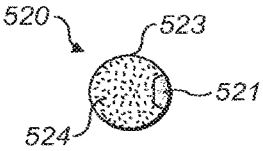
Figure 92:
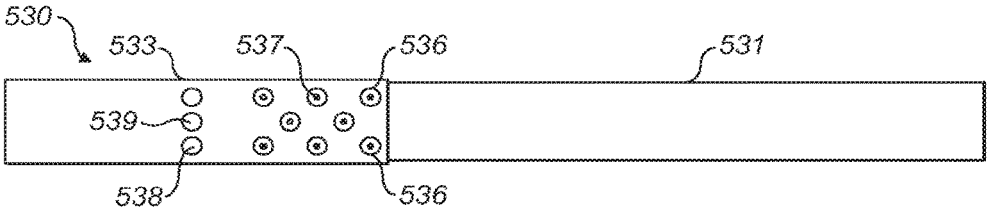
Figure 93:
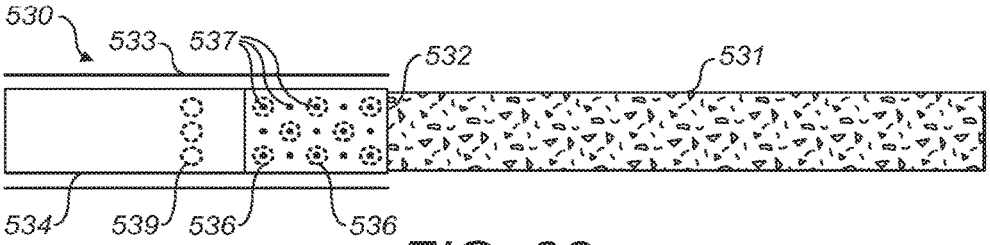
Figure 94:
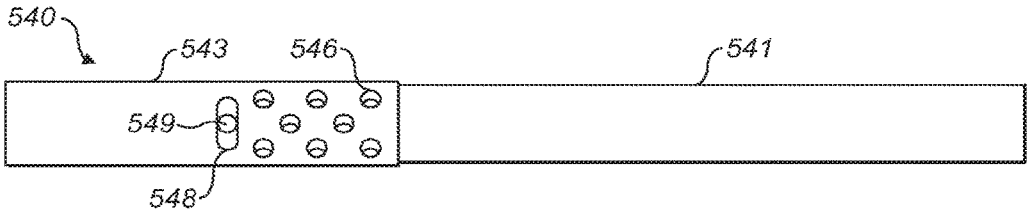
Figure 95:
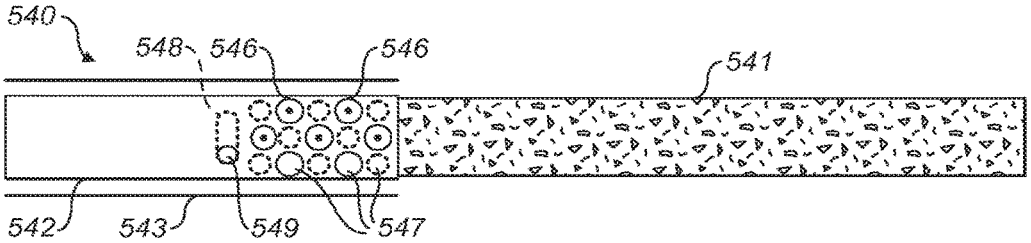
Figure 96:
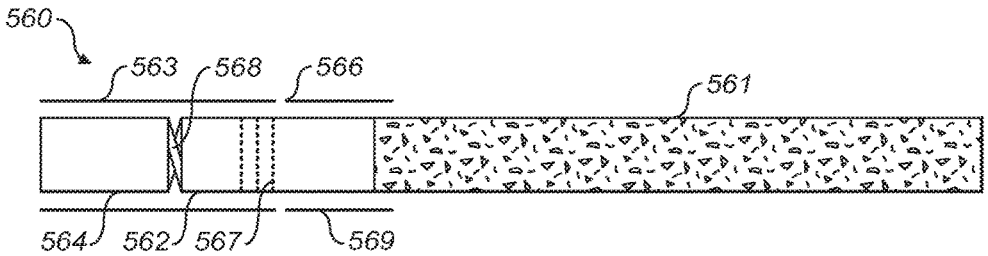
Figure 97:
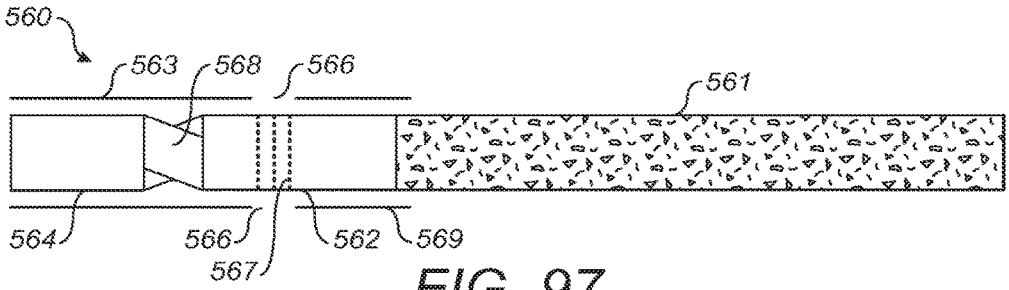
Figure 98:
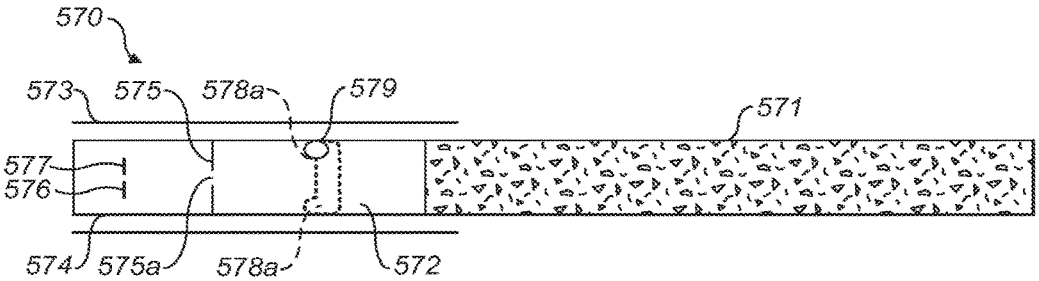
Figure 99:
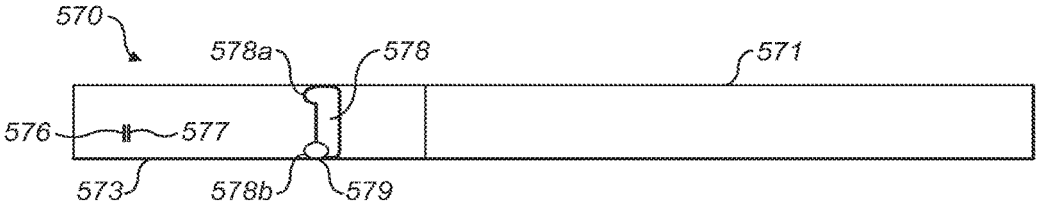
Figure 100:
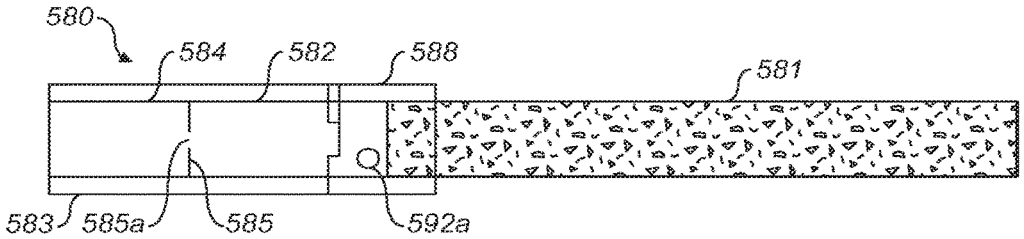
Figure 101:
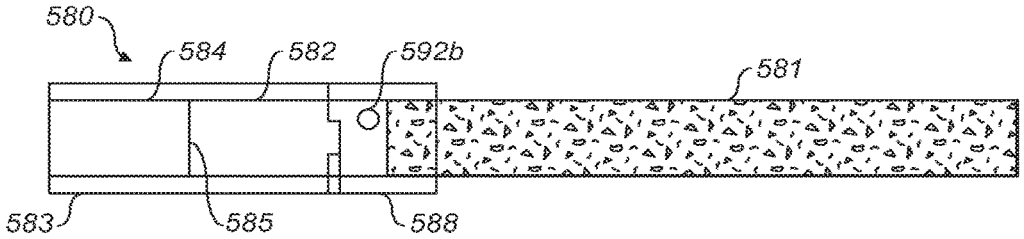
Figure 102:
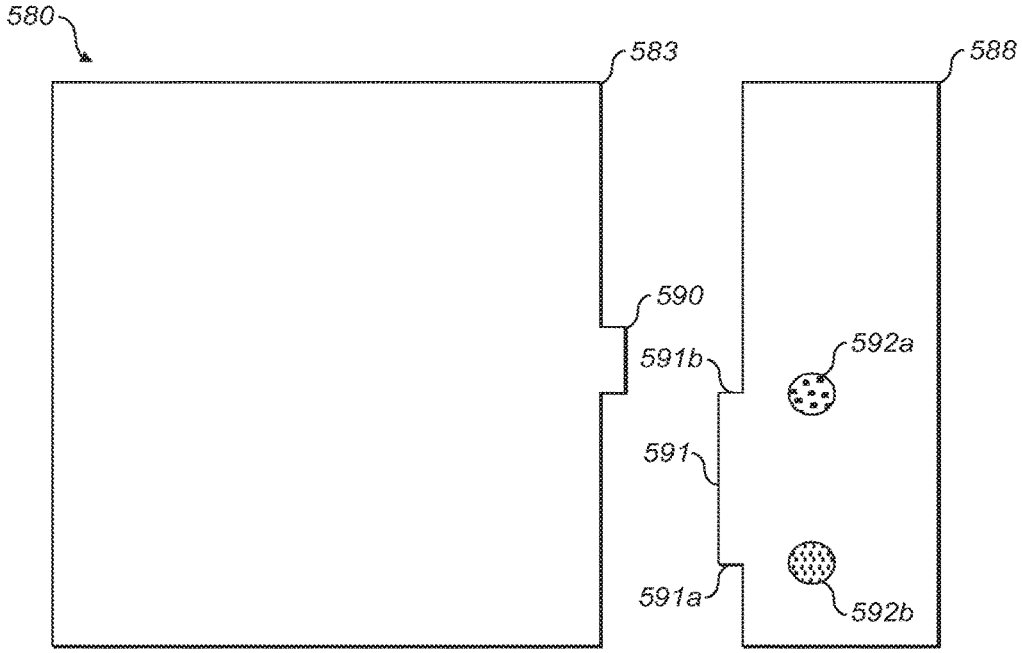
Figure 103:
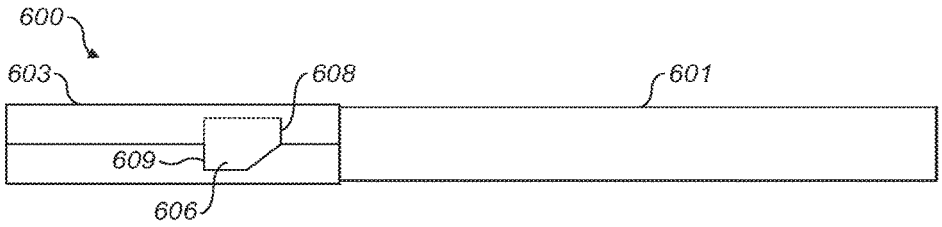
Figure 104:
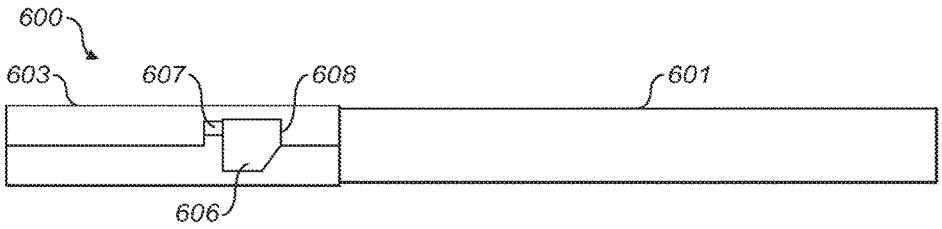

FIG. 77 is a side elevation view of a smoking article with a twenty-ninth embodiment of a variable flow system in a first state;

FIG. 78 is a cut-away side elevation view of a smoking article with the twenty-ninth embodiment of a variable flow system in a second state;

FIG. 79 is a cut-away side elevation view of a smoking article with a thirtieth embodiment of a variable flow system in a first state;

FIG. 80 is a cut-away side elevation view of a smoking article with the thirtieth embodiment of a variable flow system in a second state;

FIG. 81 is a cut-away side elevation view of a smoking article with a thirty-first embodiment of a variable flow system in a first state;

FIG. 82 is a side elevation view of a smoking article with a thirty-second embodiment of a variable flow system in a first state;

FIG. 83 is a cut-away side elevation view of a smoking article with the thirty-second embodiment of a variable flow system in a second state;

FIG. 84 is a side elevation view of a smoking article with a thirty-third embodiment of a variable flow system in a first state;

FIG. 85 is a side elevation view of a smoking article with a thirty-third embodiment of a variable flow system in a second state;

FIG. 86 is a side elevation view of a smoking article with a thirty-fourth embodiment of a variable flow system in a first state;

FIG. 87 is a side elevation view of a smoking article with a thirty-fifth embodiment of a variable flow system in a first state;

FIG. 88 is a side elevation view of a smoking article with a thirty-sixth embodiment of a variable flow system in a first state;

FIG. 89 is a cut-away side elevation view of a smoking article with a thirty-sixth embodiment of a variable flow system in a second state;

FIG. 90*a* is a cut-away side elevation view of a smoking article with a thirty-seventh embodiment of a variable flow system in a first state;

FIG. 90*b* is an end elevation view of a smoking article with the thirty-seventh embodiment of a variable flow system in the first state;

FIG. 91*a* is a cut-away side elevation view of a smoking article with a thirty-seventh embodiment of a variable flow system in a second state;

FIG. 91*b* is an end elevation view of a smoking article with the thirty-seventh embodiment of a variable flow system in the second state;

FIG. 92 is a side elevation view of a smoking article with a thirty-eighth embodiment of a variable flow system in a first state;

FIG. 93 is a cut-away side elevation view of a smoking article with a thirty-eighth embodiment of a variable flow system in a second state;

FIG. 94 is a side elevation view of a smoking article with a thirty-ninth embodiment of a variable flow system in a first state;

FIG. 95 is a cut-away side elevation view of a smoking article with a thirty-ninth embodiment of a variable flow system in a second state;

FIG. 96 is a cut-away side elevation view of a smoking article with a fortieth embodiment of a variable flow system in a first state;

FIG. 97 is a cut-away side elevation view of a smoking article with a fortieth embodiment of a variable flow system in a second state;

FIG. 98 is a cut-away side elevation view of a smoking article with a forty-first embodiment of a variable flow system in a first state;

FIG. 99 is a side elevation view of a smoking article with a forty-first embodiment of a variable flow system in a second state;

FIG. 100 is a cut-away side elevation view of a smoking article with a forty-second embodiment of a variable flow system in a first state;

FIG. 101 is a cut-away side elevation view of a smoking article with a forty-second embodiment of a variable flow system in a second state;

FIG. 102 is a plan view of blanks for forming a part of the smoking article with a forty-second embodiment of a variable flow system;

FIG. 103 is a cut-away side elevation view of a smoking article with a forty-third embodiment of a variable flow system in a first state; and FIG. 104 is a cut-away side elevation view of a smoking article with a forty-third embodiment of a variable flow system in a second state.

Figure 1:
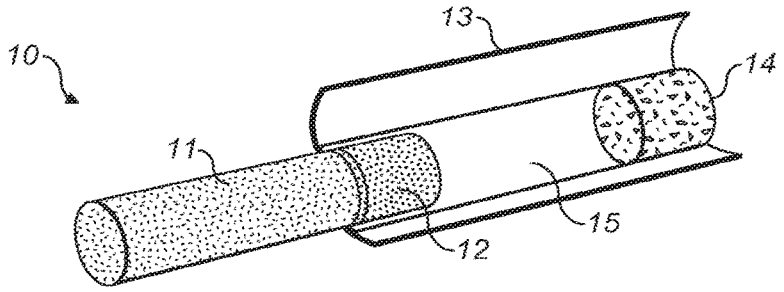
FIG. 1 is a perspective view of a first embodiment of the smoking article.
Figure 2:
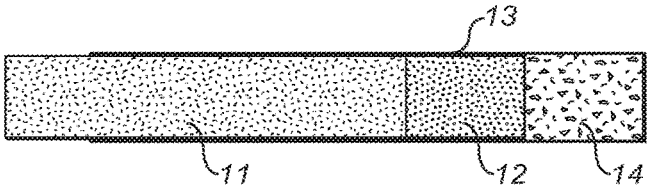
FIG. 2 is a cut-away side elevation view of the smoking article of FIG. 1 in a retracted state.
Figure 3:
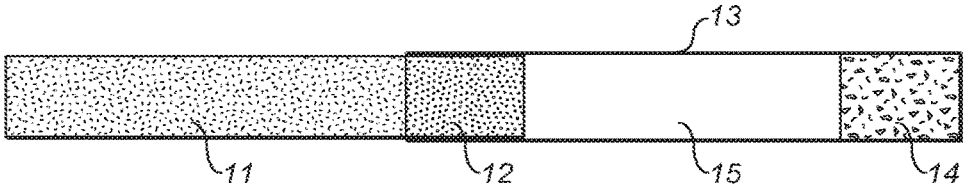
FIG. 3 is a cut-away side elevation view of the smoking article of FIG. 1 in an extended state.

FIGS. 1 to 3 show a first embodiment of a smoking article 10. The smoking article may be a tobacco industry product such as a cigarette, cigar or cigarillo. For convenience, these will be referred to as "smoking articles" in this specification. The smoking article 10 comprises a first part comprising a source of smokable material, preferably tobacco in the form of a tobacco rod 11, with an attached first filter section 12. The tobacco rod 11 and first filter section 12 are attached with a covering layer, preferably formed of tipping paper.

A second part of the smoking article comprises a sleeve 13 in the form of a cylindrical tube extending around the circumference of the tobacco rod 11 and/or first filter section 12. The tobacco rod 11 and first filter section 12 are dimensioned to slide as a unit longitudinally within the sleeve 13. The tobacco rod 11 and first filter section 12 may be referred to as a tobacco unit.

The second part may further comprises a second filter section 14 at a mouthpiece end of the sleeve 13, distal from the first filter section 12. The second filter section 14 is securely attached and fixed within the sleeve 13. The first and/or second filter sections 12, 14 are preferably made of a conventional cellulose acetate tow.

A chamber 15 is defined in the sleeve 13 between the first filter section 12 and second filter section 14. The chamber 15 has a variable length, and hence volume, as the first filter section 12 slides axially within the cylindrical sleeve 13. The chamber 15 has a length varying from zero to a predetermined maximum length. Thus, an end of the sleeve 13 distal to the source of smokable material is movable relative to the source of smokable material. The first part is slidable around the second part, i.e. the second part is slidable within the first part.

Relative movement of the first and second parts, i.e. sleeve 13 and tobacco rod 11, beyond the maximum length is prevented by a restraining means, preferably abutting surfaces on or adjacent to the tobacco rod 11 and sleeve 13. In particular, the restraining means may comprise a first engaging surface extending radially inwardly from the sleeve 13, engagable with a second engaging surface extending radially outwardly from the tobacco unit. The second engaging surface may be provided by a forward edge of a sheet material wrapped around the tobacco unit, and in particular, by material (e.g. tipping paper) connecting the tobacco rod and first filter.

FIG. 2 shows the smoking article 10 in a retracted state, with the tobacco rod 11 and first filter section 12 moved up to the second filter section 13. The length of the chamber 15 has been reduced to zero. The smoking article 10 is at its shortest overall length. The smoking article 10 may be packaged in the retracted state prior to use. The smoking article 10 may be returned to the retracted state after use, once the tobacco rod 11 has been partially or fully combusted.

FIG. 3 shows the smoking article 10 in an extended state, with the tobacco rod 11 and first filter section 12 moved as far as possible away from the second filter section 14. The length of the chamber 15 has been increased to its maximum. The smoking article 10 is at its longest length. The smoking article 10 may be in the extended state during use. The tobacco rod 11 and first filter section 12 are continuously positionable within the sleeve 13 to be in any partially extended position between the retracted and extended states.

Figure 4:
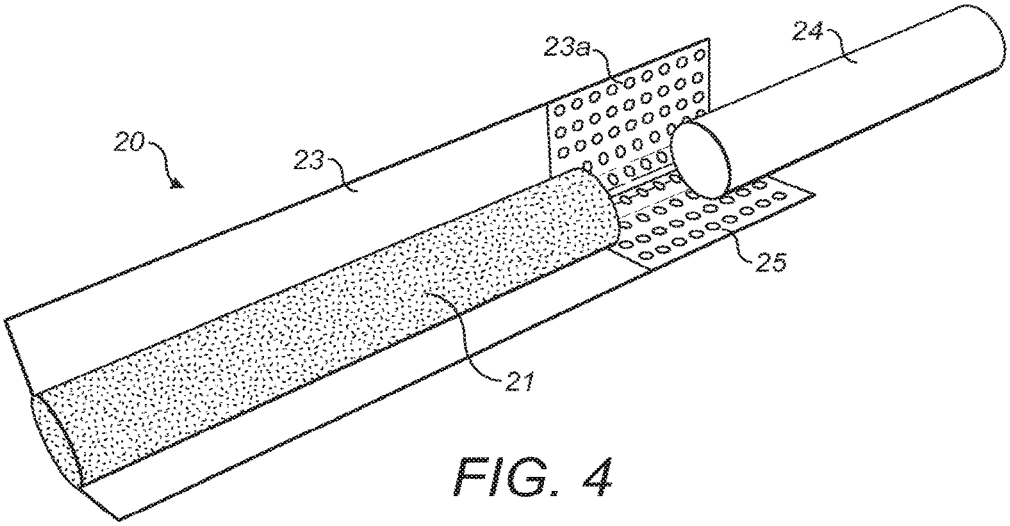
FIG. 4 is a perspective view of a second embodiment of a smoking article according to the present invention, in a partially formed state.

FIG. 4 shows a second embodiment of the smoking article 20. The smoking article 20 comprises a cylinder of tobacco 21 surrounded by, and attached to, a sleeve 23 to form a tobacco rod. The cylinder of tobacco 21 does not move relative to the sleeve 23. The sleeve 23 has a section 23*a* extending rearwardly of the tobacco 21. A filter 24 is longitudinally slidable within the sleeve section 23*a*.

A chamber 25 is formed by the tubular section 23*a*, between the tobacco 21 and the filter 24.

The smoking article 20 functions in a similar manner to smoking article 10. Smoking article 20 differs in that the sleeve forming the chamber 25 is rigidly attached to the tobacco rod, not the mouthpiece filter 24. Smoking article 20 also differs by not having a filter attached directly to the tobacco 21. A further embodiment of the present invention may have only one of these features or differences.

Relative movement of the sleeve 23 and filter 24 beyond the maximum length is prevented by a restraining means. Preferably, the restraining means comprises first and second engaging surfaces on or adjacent to the sleeve 23*a* and filter 24 respectively. A second engaging surface may be provided by one or more layers of sheet material (e.g. tipping paper) wrapped around the filter 24.

Figure 5:
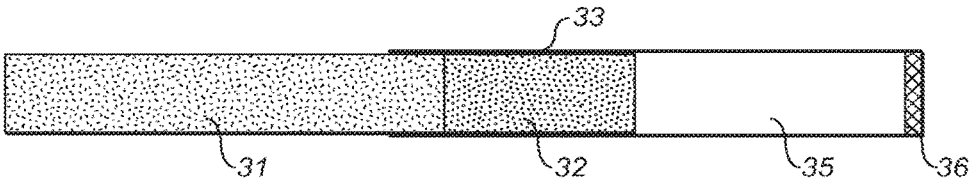
FIG. 5 is a cut-away side elevation view of a third embodiment of the smoking article.

FIG. 5 shows a third embodiment of the smoking article 30. Smoking article 30 has a similar construction to the embodiment of FIGS. 1 to 3, having a tobacco rod 31 attached to a filter 32. The tobacco rod 31 and filter 32 are slidable within a sleeve 33 formed as a cylindrical tube. At the mouthpiece end of the sleeve 33 is a stain binder 36, instead of a second filter. The stain binder 36 may remove substances which can cause staining. A variable length chamber 35 is formed between the filter 32 and stain binder 36.

The tobacco rod and attached filter are described as connected by tipping paper. The tipping paper may be standard tipping paper, or a relatively thick recessed tipping paper, or a board type tipping paper. Alternatively, a tube formed of any material may attach the filter material to the source of smokable material. In particular, such a tube may be made of a plastics material, for example, a plastic made from corn starch. Alternatively, the tube may be made from a ceramic material. Alternatively, the tube may be formed from foil, metal or metallised paper.

The embodiments above have been described as having a filter section at the mouthpiece (rearward) end of the sleeve. Alternatively, the sleeve may not contain such a filter section or stain binder. In the absence of a filter or stain binder at the mouthpiece end of the sleeve, the sleeve is only a hollow tube and the chamber is defined by the sleeve between the tobacco unit and the mouthpiece end of the sleeve. The embodiments described above may have at least one filter section, attached to one or both of the source of smokable material and the mouthpiece end of the sleeve. Alternatively, the smoking article may not include any filter section.

One or more of the filter sections may be formed of a single segment of filter material or a plurality of segments. A filter section formed of a plurality of segments may comprise segments made of different materials or having different filtration properties. In particular, a filter section may comprise a standard segment of cellulose acetate tow and a further segment of filtration material including charcoal. Alternatively, the filter section may be a single segment incorporating charcoal.

FIGS. 6 to 31*b* show seven embodiments of the smoking article variable ventilation systems, providing for selectable variations in the ventilation or air dilution of the smoking article. In particular, these embodiments of smoking article have a ventilation which is determined by the position of a first part, including a source of smokable material, relative to a second part, which is preferably formed of a sleeve. Alternatively, the variable ventilation systems may be applied to a smoking article having a first part, including a source of smokable material and a sleeve, relative to a second part, comprising a filter moveable relative to the sleeve. The ventilation provides for entry of air into one or more of a filter, a chamber or a source of smokable material. Any of the embodiments of ventilation system may be used with any of the embodiments of smoking article described in FIGS. 1 to 5.

Figure 7A:
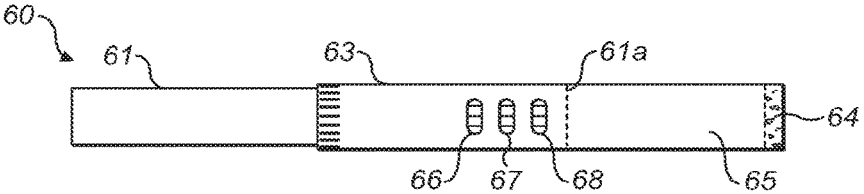
Figure 7B:
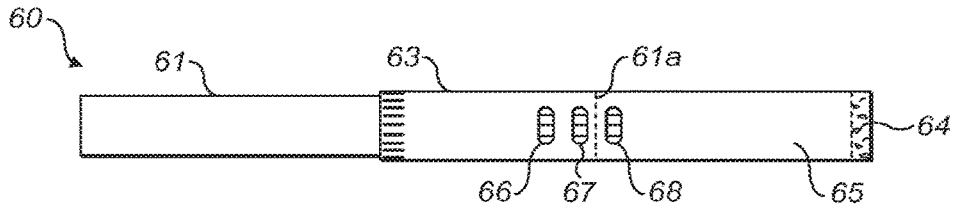
Figure 7C:
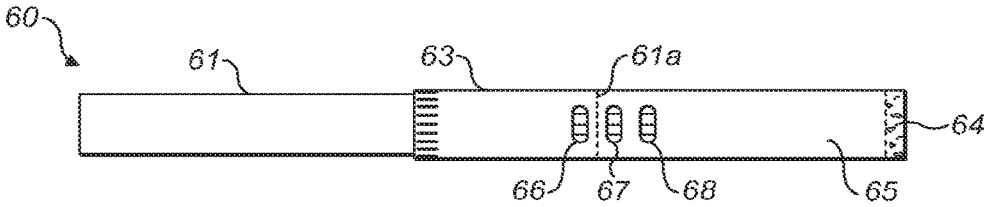
Figure 7D:
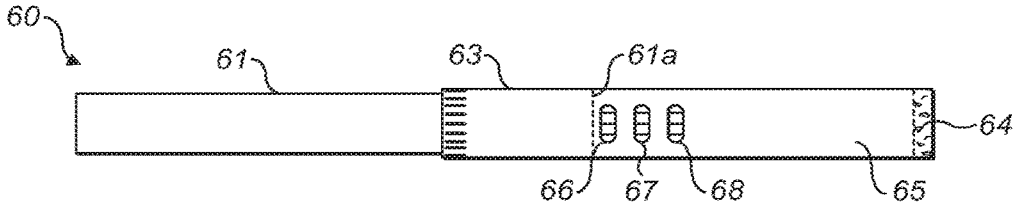

FIGS. 6 to 7*d* show a first embodiment of ventilation system in a smoking article 60. Smoking article 60 comprises a variable length chamber, substantially as described in any of the embodiments above. The smoking article 60 comprises a first part or tobacco unit 61, which may comprise a tobacco rod and first filter as described with respect to FIG. 1 to 3 or 5, or only a tobacco rod as described with respect to FIG. 4. The tobacco rod 61 is moveable relative to a second part of the smoking article comprising a sleeve 63. The variable length chamber 65 is defined between the tobacco unit 61 and a second filter or stain-binder 64. The tobacco unit 61 has a rearward end 61*a*, which is surrounded by the sleeve 63. The second filter or stain-binder 64 will be referred to as second filter 64.

The sleeve 63 comprises a plurality of ventilation apertures, preferably first, second and third ventilation apertures 66, 67, 68. The ventilation apertures 66, 67, 68 are longitudinally spaced. Each of the ventilation apertures 66, 67, 68 may be formed from one or more individual apertures. If the ventilation apertures 66, 67, 68 are formed of a plurality of individual apertures, the plurality of individual apertures are preferably laterally (i.e. circumferentially) spaced.

FIG. 7*a* shows the smoking article 60 in a retracted state. The tobacco unit 61 extends a relatively large distance into the sleeve 63, such that the chamber 65 is relatively small. The end 61*a* is located rearwardly of all of the ventilation apertures 66, 67, 68. The tobacco unit 61 comprises an outer surface which is substantially air impermeable. The ventilation apertures 66, 67, 68 are covered by the underlying tobacco unit, and so do not allow ingress of air.

FIG. 7*b* shows a first partially extended state of the smoking article. The end 61*a* of the tobacco unit 61 is located longitudinally between the second ventilation aperture 67 and third ventilation aperture 68. The first and second ventilation apertures 66, 67 are covered by the underlying tobacco unit 61, and do not contribute to ventilation. The third ventilation aperture 68 is located beyond the end 61*a*, and is not covered by the tobacco unit 61. The third ventilation aperture 68 is uncovered and allows ingress of air directly into the chamber 65.

FIG. 7*c* shows a second partially extended state of the smoking article. The end 61*a* of the tobacco unit 61 is located longitudinally between the first ventilation aperture 66 and second ventilation aperture 67. The first ventilation aperture 66 is covered by the underlying tobacco unit 61, and does not contribute to ventilation. The second and third ventilation apertures 67, 68 are located beyond the end 61*a*, and are not covered by the tobacco unit 61. The second and third ventilation apertures 67, 68 are uncovered and allow ingress of air directly into the chamber 65.

FIG. 7*d* shows the smoking article 60 in an extended state. The end 61*a* of tobacco unit 61 extends forwardly of all of the ventilation apertures 66, 67, 68. All of the ventilation apertures are uncovered and contribute to ventilation area allowing ingress of air into the chamber 65.

The first embodiment of ventilation system provides variable ventilation depending on the relative longitudinal position between the first and second parts. The required ventilation can therefore be selected by selecting the extension of the tobacco unit 61 relative to the sleeve 63. The rotational orientation of the sleeve 63 relative to the tobacco unit 61 does not affect the area of operational ventilation apertures.

FIGS. 8 to 11*b* show a second embodiment of ventilation system in a smoking article 70. Smoking article 70 comprises a variable length chamber, substantially as described in any of the embodiments above. The smoking article 70 comprises a tobacco unit 71, which may comprise a tobacco rod and first filter as described with respect to FIG. 1 to 3 or 5, or only a tobacco rod as described with respect to FIG. 4. The tobacco rod 71 is moveable relative to a second part of the smoking article comprising a sleeve 73. The variable length chamber 75 is defined between the tobacco unit 71 and a second filter or stain-binder 74. The tobacco unit 71 has a rearward end 71*a*, which is surrounded by the sleeve 73. The second filter or stain-binder 74 will be referred to as second filter 74.

The sleeve 73 is provided with one or more ventilation apertures 76 adjacent to a forward end. Preferably, the sleeve 73 comprises a single ventilation aperture 76. The tobacco unit 71 comprises one or more ventilation apertures 77 adjacent to a rearward end 71*a*. Preferably, the tobacco unit 71 comprises a single ventilation aperture 77. The ventilation aperture 77 is an aperture in the air impermeable material forming a surface of the surrounding part of the tobacco unit 71. Alternatively, the second ventilation aperture 77 may be covered by an air permeable material.

FIG. 9*a* shows the smoking article in a fully extended state, at a first rotational position of the sleeve 73 relative to the tobacco unit 71. The first and second ventilation apertures 76,77 are aligned, allowing ingress of air into the tobacco unit, and in particular, into the first filter 72.

FIG. 9*b* shows the smoking article 70 in a fully extended state, at a second rotational position of the sleeve 73 relative to the tobacco unit 71. The maximum longitudinal extension possible is dependant on the rotational orientation between the first part and the second part of the smoking article. In the second relative rotational position, the maximum longitudinal extension is greater than in the first relative rotational position such that the first and second ventilation apertures 76, 77 are not aligned. In particular the first and second ventilation apertures 76, 77 are not aligned longitudinally, and are also not aligned rotationally. Thus, ventilation of the smoking article through ventilation apertures 76, 77 is prevented.

FIG. 10 shows the coupling of the sleeve 73 and tobacco unit 71. A restraining means comprising a first and second engaging surfaces 79*a*,79*b* prevents separation of the sleeve 73 from the tobacco unit 71. In this embodiment, the restraining means provides for a different maximum extension dependant on relative rotational position.

The sleeve 73 is provided with an inwardly folded section 78*b* at its forward end. The folded over section 78*b* defines a second engaging surface 79*b*. The second engaging surface 79*b* does not extend at a uniform longitudinal position around the circumference, and is contoured with a shape complimentary to the first engaging surface.

The tobacco unit 71 has an outer surface of sheet material at its rearward end. The sheet material may be tipping paper connecting the first filter 72 to the source of smokable material, or may be an additional sheet of material wrapped around the circumference of the tobacco unit. A folded section 78*a* is folded outwardly, and defines a first engaging surface 79*a*. The restraining means does not affect rotation between the first and second parts of the smokable article at an extension less than the maximum longitudinal extension.

The first and second engaging surfaces 79*a*, 79*b* may be shaped such that relative rotation between the sleeve 73 and tobacco unit 71 actuates relative longitudinal movement. Alternatively, the first and second engaging surfaces 79*a*, 79*b* may be shaped such that rotation is prevented without prior longitudinal movement to remove the interlock.

The first and/or second engaging surfaces 79*a*, 79*b* do not extend at a uniform longitudinal position around the circumference. The first and/or second engaging surfaces 79*a*, 79*b* have a profile in the plane of the outer surface of the tobacco unit 71. The profile is a variation in the longitudinal position of the first and/or second engaging surface 79*a*,79*b* around the circumference of the tobacco unit 71 and/or sleeve 73. Preferably, the profile of the first engaging surface is the same as the second engaging surface.

The first engaging surface 79*a* is shaped to have a first portion 79*c* at a first, rearward, longitudinal position and a second portion 79*d* at a second, forward, longitudinal position. The second engaging surface 79*b* is shaped to have a first portion 79*e* at a first, forward, longitudinal position and a second portion 79*f* at a second, rearward, longitudinal position. The first and second engaging surfaces 79*a*,79*b* each preferably comprise one first portion and one second portion when assembled into an annulus. Alternatively, the first and second engaging surfaces 79*a*,79*b* each comprise a plurality of first portions and a plurality of second portions. The first portion and second portion may extend at a uniform longitudinal position for a part of the circumference.

FIG. 11*a* is a schematic view corresponding to FIG. 9*a*. The first and second ventilation apertures 76, 77 are aligned, allowing ingress of air into the filter 72. The first portion 79*d* of the first engaging surface 79*a* abuts the second portion 79*f* of the second engaging surface 79*b* in the first relative rotational position.

FIG. 11*b* is a schematic view corresponding to the smoking article of FIG. 9*b*. The first and second ventilation apertures 76, 77 are not aligned. The ventilation apertures 76, 77 are spaced longitudinally and rotationally. The second portion 79*d* of the first engaging surface 79*a* abuts the first portion 79*e* of the second engaging surface 79*b* in the second relative rotational position. Alternatively or in addition, the first portion 79*c* of the first engaging surface 79*a* abuts the second portion 79*f* of the second engaging surface 79*b* in the second relative rotational position.

FIGS. 12 to 15 show a third embodiment of ventilation system in a smoking article 80. Smoking article 80 comprises a variable length chamber, substantially as described in any of the embodiments above. The smoking article 80 comprises a tobacco unit 81, which may comprise a tobacco rod and first filter as described with respect to FIG. 1 to 3 or 5, or only a tobacco rod as described with respect to FIG. 4. The tobacco rod 81 is moveable relative to a second part of the smoking article comprising a sleeve 83. The variable length chamber 85 is defined between the tobacco unit 81 and a second filter or stain-binder 84. The tobacco unit 81 has a rearward end 81*a*, which is surrounded by the sleeve 83. The second filter or stain-binder 84 will be referred to as second filter 84.

FIG. 13*a* shows the smoking article 80 in a partially extended state. The sleeve 83 comprises a first ventilation aperture 86, adjacent a forward end. The tobacco unit 81 comprises a second ventilation aperture 87 adjacent a rearward end of the tobacco unit 81. The first ventilation aperture 86 is covered by the tobacco unit 81 having a substantially air impermeable covering. The second ventilation aperture 87 is covered by the sleeve 83, such that both the first and second ventilation apertures 86,87 do not allow ingress of air.

FIG. 13*b* shows the smoking article 80 in a fully extended state. The first ventilation aperture 86 is not covered by the tobacco unit 81, and so air can enter the chamber 85 through the first ventilation aperture 86 and beyond an end of the tobacco unit 81. The second ventilation aperture 87 is located beyond a forward edge of sleeve 83, and allows air flow into the filter 82 and hence into the chamber 85. Thus, the first and second ventilation apertures 86,87 separately provide for ventilation to the smoking article, when not aligned.

As shown in FIGS. 14*a* and 14*b*, the tobacco unit 81 is provided with a protrusion 88. The protrusion 88 is preferably formed of ink or glue, and may be considered as a dot of raised ink or glue. The protrusion 88 can be aligned with ventilation aperture 86. The protrusion 88 inhibits flow of air through ventilation aperture 86. The protrusion 88 is longitudinally spaced from the second ventilation aperture 87.

The protrusion 88 may alternatively be formed by one or more of: an embossed portion, an additional substrate attached by adhesive, or by creasing.

The protrusion 88 can releasably lock into the ventilation aperture 86, in order to locate the first and second parts in a relative position which prevents ventilation. Alternatively, the protrusion 88 may not extend a substantial radial distance, and may not engage with the ventilation aperture 86.

FIG. 14*a* shows the tobacco unit is provided with a first engaging surface 89*a*, formed on a folded over part of wrapped sheet material. The sleeve 83 is provided with a second engaging surface 89*b* in the partially extended position shown, the first and second engaging surfaces do not abut. The first ventilation aperture 86 is covered by the tobacco rod 81, and in particular, by the protrusion 88. The second ventilation aperture 87 is covered by the sleeve 83. Therefore, ventilating air does not enter the smoking 80 through the first or second ventilation apertures 86, 87. Further rotation of the first part relative to the second part may allow a small amount of ventilation through first ventilation aperture 86, when not covered by the protrusion 88.

FIG. 14*b* shows the fully extended state, in which first and second engaging surfaces 89*a*, 89*b* are abutting. Air can enter the smoking article through first ventilation aperture 86 which is aligned beyond an end 81*a* of the tobacco rod. Air can also enter through the second ventilation aperture 87, which is longitudinally spaced from the first ventilation aperture 86. Air enters beyond the forward end of the sleeve 83 through the ventilation aperture 87 into the filter 82. The ventilation in the fully extended state is independent of relative rotational position between the first and second parts, since both the first and second ventilation apertures 86,87 are uncovered beyond an end of the second and first parts respectively.

FIG. 15 shows the fully extended state of smoking article 80. The second ventilation aperture 87 preferably comprises one or more apertures extending around the substantially the whole circumference of the tobacco unit 81. Alternatively, the second ventilation aperture 87 may extend over only a part of the circumference.

FIGS. 16 to 19 show a fourth embodiment of ventilation system in a smoking article 90. Smoking article 90 comprises a variable length chamber, substantially as described in any of the embodiments above. The smoking article 90 comprises a tobacco unit 91, which may comprise a tobacco rod and first filter as described with respect to FIG. 1 to 3 or 5, or only a tobacco rod as described with respect to FIG. 4. The tobacco rod 91 is moveable relative to a second part of the smoking article comprising a sleeve 93. The variable length chamber 95 is defined between the tobacco unit 91 and a second filter or stain-binder 94. The tobacco unit 91 has a rearward end 91*a*, which is surrounded by the sleeve 93. The second filter or stain-binder 94 will be referred to as second filter 94.

The tobacco unit 91 is provided with a plurality of ventilation apertures 97. The ventilation apertures 97 are formed in a plurality of rows extending around substantially the whole circumference of the tobacco unit 91. The rows of ventilation apertures 97 are longitudinally spaced.

FIG. 17*a* shows the smoking article 90 in a fully extended state, at a first rotational position of the sleeve 93 relative to the tobacco unit 91. The ventilation apertures 97 are located beyond an end 93*a* of the sleeve 93, allowing ingress of air into the tobacco unit, and in particular into the first filter 92.

FIG. 17*b* shows the smoking article 90 in a fully extended state, at a second rotational position of the sleeve 93 relative to the tobacco unit 91. The maximum longitudinal extension possible is dependant on the rotational orientation between the first part and the second part of the smoking article. In the second relative rotational position, the maximum longitudinal extension is less than in the first relative rotational position such that the ventilation apertures 97 are covered by the overlying sleeve 93. Thus, ventilation of the smoking article through ventilation apertures 97 is prevented.

FIG. 18 shows a restraining means comprising a first and second engaging surfaces 99*a*,99*b* preventing separation of the sleeve 93 from the tobacco unit 91. In this embodiment, the restraining means provides for a different maximum extension dependent on relative rotational position.

The tobacco unit 91 has an outer surface of sheet material at its rearward end. The sheet material maybe tipping paper connecting the first filter 92 to the source of smokable material, or may be an additional sheet of material wrapped around the circumference of the tobacco unit. A portion of sheet material is folded radially outwardly and back, and defines the first engaging surface 99*a*. The sleeve 93 is provided with a section folded radially inwardly and back at its forward end, defining the second engaging surface 99*b*.

The first and/or second engaging surfaces 99*a*, 99*b* do not extend at a uniform longitudinal position around the circumference. The first and second engaging surfaces 99*a*, 99*b* are shaped to have a first portion at a first longitudinal position and a second portion at a second longitudinal position. Preferably, the first and second engaging surfaces 99*a*, 99*b* vary continuously in longitudinal position around the majority of the circumference of the tobacco unit 91. In particular, the longitudinal position varies linearly with circumferential position. The maximum extension of the smoking article 90 varies with the relative rotational positions of the sleeve 93 and tobacco unit 91, and preferably varies linearly. The restraining means does not affect rotation between the first and second parts of the smokable article at an extension less than the maximum longitudinal extension The first and second engaging surfaces 99*a*, 99*b* are shaped such that relative rotation between the sleeve 93 and tobacco unit 91 actuates relative longitudinal movement. Alternatively, the first and second engaging surfaces 99*a*, 99*b* may be shaped such that rotation is prevented, without prior longitudinal movement to remove the interlock.

FIG. 19 shows the first and second engaging surfaces 99*a*, 99*b* configured such that when the sleeve and tobacco unit are pulled apart to their maximum extent, relative rotation of the sleeve and tobacco unit actuates relative longitudinal movement therebetween. Relative rotation will only cause relative longitudinal movement when the smoking article is at its maximum extent, and the first and second surfaces are abutting. When the smoking article is only partially extended, no longitudinal movement will be actuated by rotation.

The first and second engaging surfaces wrap around the circumference of the tobacco unit and sleeve, and so opposite sides of the first and second engaging surfaces 99*a*, 99*b* meet. A first step surface 99*c* is defined in the first engaging surface 99*a* and a second step surface 99*d* is defined in the second engaging surface 99*b* where opposite sides meet. At the step surfaces 99*c*,99*d*, the profile of the first and second engaging surfaces is a step or discontinuity in a longitudinal direction. Relative rotational movement over aligned step surfaces will not result in relative longitudinal movement. When step surfaces 99*c*, 99*d* are aligned by anti-clockwise rotation of the tobacco unit 91 with the sleeve 93 stationary, the first and second engaging surfaces will move out of contact, and a longitudinal extension of the smoking article 90 is required to bring the first and second engaging surfaces into contact.

When step surfaces 99*c*, 99*d* are aligned by clockwise rotation of the tobacco unit 91 with the sleeve 93 stationary, the abutting step surfaces 99*c*,99*d* of the first and second engaging surfaces 99*a*,99*b* prevent further rotation clockwise direction.

The continuous profile of the restraining means 99*a*,99*b* over the majority of the circumference allows relative rotation of the first and second parts to actuate relative longitudinal movement, and cover or uncover the ventilation apertures 97. The discontinuities or steps 99*c*,99*d* provide a limit for the rotation.

FIGS. 20 to 23 show a fifth embodiment of ventilation system in a smoking article 100. Smoking article 100 comprises a variable length chamber 105, substantially as described in any of the embodiments above. The smoking article 100 comprises a tobacco unit 101, which may comprise a tobacco rod and first filter as described with respect to FIG. 1 to 3 or 5, or only a tobacco rod as described with respect to FIG. 4. The tobacco rod 101 is moveable relative to a second part of the smoking article comprising a sleeve 103. The variable length chamber 105 is defined between the tobacco unit 101 and a second filter or stain-binder 104. The tobacco unit 101 has a rearward end 101*a*, which is surrounded by the sleeve 103. The second filter or stain-binder 104 will be referred to as second filter 104.

FIGS. 20 and 21*a* shows the smoking article 100 in a fully extended state, at a first rotational position of the sleeve 103 relative to the tobacco unit 101. A first ventilation aperture 106 is formed adjacent a forward end of the sleeve 103. A second ventilation aperture 107 is formed adjacent a rearward end of the tobacco unit 101. The first and second ventilation apertures 106,107 are aligned, allowing ingress of air into the tobacco unit, and in particular into the first filter 102.

FIG. 21*b* shows the smoking article 100 in a fully extended state, at a second rotational position of the sleeve 103 relative to the tobacco unit 101. A protrusion 108 is aligned with the first ventilation aperture 106. The protrusion 108 is impermeable to air, and so the first ventilation aperture 106 is covered in the second rotational position of the sleeve 103 relative to the tobacco unit 101.

FIG. 22 shows the tobacco unit 101 comprises at least one protrusion 108, and preferably two spaced apart protrusions 108, located at diametrically opposite positions. The protrusions 108 are preferably formed of ink, and may be considered as a dot of raised ink. One of the protrusions 108 can be aligned with first ventilation aperture 106 to inhibit flow of air through the first ventilation aperture 106.

The protrusion 108 may alternatively be formed by one or more of: an embossed portion, an additional substrate attached by adhesive, or by creasing.

The protrusions 108 can releasably lock into the first ventilation aperture 106, in order to locate the first and second parts in a relative position which prevents ventilation. Alternatively, the protrusions 108 may not extend a substantial radial distance, and may not engage with the first ventilation aperture 106.

FIG. 23 shows the second ventilation aperture 107 extends circumferentially around substantially the whole circumference of the tobacco unit 101. The second ventilation aperture 107 does not effectively extend over at least one area, and preferably does not effectively extend over at two spaced apart areas, being covered by the protrusions 108. The protrusions 108 are longitudinally aligned with the second ventilation aperture 107. Preferably, the ventilation aperture 107 extends circumferentially up to the one or more protrusions 108. Alternatively, the protrusion 108 may be applied to a part of the ventilation aperture 107, sealing that part of the ventilation aperture 107.

The first ventilation aperture 106 is uncovered when aligned with a part of second ventilation aperture 107. Air is prevented from entering when a protrusion 108 is aligned with the first ventilation aperture 106. The covering and uncovering of the ventilation aperture 106 is achieved through rotation only, and not through longitudinal movement. Preferably, the first and second ventilation apertures 106, 107 are longitudinally aligned when the smoking article 100 is at its maximum extent, which is preferably uniform for all relative rotational positions. When the smoking article 100 is not at its maximum extension, the first and second ventilation apertures 106, 107 are longitudinally spaced, and the first ventilation aperture 106 is covered.

The smoking article 100 comprises a restraining means comprising a first and second engaging surfaces 109*a*,109*b* preventing separation of the sleeve 103 from the tobacco unit 101. The tobacco unit 101 has an outer surface of sheet material at its rearward end. The sheet material maybe tipping paper connecting the first filter 102 to the source of smokable material, or may be an additional sheet of material wrapped around the circumference of the tobacco unit. A portion of sheet material is folded radially outwardly and back, and defines the first engaging surface 109*a*. The sleeve 103 is provided with a section folded radially inwardly and back at its forward end, defining the second engaging surface 109*b*. The first and/or second engaging surfaces 109*a*, 109*b* extend at a uniform longitudinal position around the circumference. Alternatively, the first engaging surface 109*a* may be formed by sheet material connecting the first filter 102 to the source of smokable material, without being folded. A forward edge of the sheet material defines the first engaging surface.

A reinforcement sheet 103*a* may be affixed to an exterior surface of the sleeve 103. The reinforcement sheet 103*a* defines an aperture 106*a*, which is aligned with first aperture 106. The reinforcement sheet is preferably adhered to the sleeve 103. The reinforcement sheet 103*a* may have printed indicia indicating that relative rotation is possible to vary ventilation.

FIGS. 24 to 27 show a sixth embodiment of a ventilation system in a smoking article 110. Smoking article 110 comprises a variable length chamber 105, substantially as described in any of the embodiments above. The smoking article 110 comprises a tobacco unit 111, which may comprise a tobacco rod and first filter as described with respect to FIG. 1 to 3 or 5, or only a tobacco rod as described with respect to FIG. 4. The tobacco rod 111 is moveable relative to a second part of the smoking article comprising a sleeve 113. The variable length chamber 115 is defined between the tobacco unit 111 and a second filter or stain-binder 114. The tobacco unit 111 has a rearward end, which is surrounded by the sleeve 113. The second filter or stain-binder 114 will be referred to as second filter 114.

FIG. 25*a* shows the smoking article 110 in a fully extended state, at a first rotational position of the sleeve 113 relative to the tobacco unit 111. The sleeve 113 comprises a first ventilation aperture 116, adjacent a forward end.

The tobacco unit 111 comprises second ventilation apertures in the form of a plurality of sets of ventilation apertures 117 spaced circumferentially adjacent a rearward end of the tobacco unit 111. The sets of ventilation apertures 117 each have a different ventilation area, and the set of ventilation apertures 117 aligned with the first ventilation aperture 116 determines the ventilation of the smoking article. In FIG. 25*a*, a set having zero ventilation apertures is aligned with the first ventilation aperture 116, such that the first ventilation aperture 116 is completely covered.

FIG. 25*b* shows the smoking article 110 in a fully extended state, at a second rotational position of the sleeve 113 relative to the tobacco unit 111. A different set 117 is aligned with the first ventilation aperture 116, such that the first ventilation aperture 116 is partially uncovered.

FIG. 26 shows an end view of the smoking article and a plan view of part of a blank for the tobacco unit including the sets of ventilation apertures 117. The second ventilation aperture 117 is preferably formed as four sets of apertures 117*a,b,c,d* circumferentially spaced around the tobacco unit 111. Relative rotation of a tobacco unit 111 relative to the sleeve 113 selects which of the sets of apertures 117 is aligned with the first ventilation aperture 116. Each of the sets of apertures 117 has a different area of air permeable surface, allowing selection of ventilation amount.

A first set 117*a* comprises a single column of a plurality of apertures extending longitudinally. A second set 117*b* has two columns of apertures, and so provides double the ventilation area of the first set 117*a*. A third set 117*c* comprises three columns of apertures, providing three times the ventilation area of the first set 117*a*. Each of the sets 117*a*, 117*b*, 117*c* has the same longitudinal extent, which is preferably the same or less than the first ventilation aperture 116. The sets 117*a*, 117*b*, 117*c* vary by extending circumferentially by different lengths.

Alternatively, the sets 117*a*, 117*b*, 117*c* have a common circumferential extent, and different longitudinal lengths. Generally, the sets comprise one or more apertures extending over an area having a common first dimension and a different second dimension. The sets of apertures 117 are shown as comprised of a grid of apertures. Alternatively, the sets of apertures may comprise one or more apertures having differing areas.

The tobacco rod further comprises a fourth set area 117*d* which does not provide a ventilation aperture, and so prevents flow of air when rotationally aligned with the first ventilation aperture 116.

The first and second ventilation apertures 116, 117 are preferably longitudinally aligned when the smoking article 110 is at its maximum extent. The ventilation is varied by rotational movement only, without requiring longitudinal movement. Longitudinal movement away from the maximum extension will cover the first ventilation aperture 116.

The smoking article 110 comprises a restraining means comprising a first and second engaging surfaces 119*a*,119*b* preventing separation of the sleeve 113 from the tobacco unit 111. The tobacco unit 111 has an outer surface of sheet material at its rearward end. The sheet material maybe tipping paper connecting the first filter 112 to the source of smokable material, or may be an additional sheet of material wrapped around the circumference of the tobacco unit. A portion of sheet material is folded radially outwardly and back, and defines the first engaging surface 119*a*. The sleeve 113 is provided with a section folded radially inwardly and back at its forward end, defining the second engaging surface 119*b*. The first and/or second engaging surfaces 119*a*, 109*b* extend at a uniform longitudinal position around the circumference.

FIGS. 28 to 31 show a seventh embodiment of ventilation smoking system in a smoking article 120. Smoking article 120 comprises a variable length chamber, substantially as described in any of the embodiments above. The smoking article 120 comprises a tobacco unit 121, which may comprise a tobacco rod and first filter as described with respect to FIG. 1 to 3 or 5, or only a tobacco rod as described with respect to FIG. 4. The tobacco rod 121 is moveable relative to a second part of the smoking article comprising a sleeve 123. The variable length chamber 125 is defined between the tobacco unit 121 and a second filter or stain-binder 124. The tobacco unit 121 has a rearward end, which is surrounded by the sleeve 123. The second filter or stain-binder 124 will be referred to as second filter 124.

The sleeve 123 is provided with one or more first ventilation apertures 126 adjacent to a forward end. Preferably, the sleeve 123 comprises a single first ventilation aperture 126. The tobacco unit 121 comprises one or more second ventilation apertures 127 adjacent to a rearward end 121*a*. Preferably, the tobacco unit 121 comprises a single second ventilation aperture 127. The second ventilation aperture 127 is an aperture in the air impermeable material forming a surface of the surrounding part of the tobacco unit 121. Alternatively, the second ventilation aperture 127 may be covered by an air permeable material.

FIG. 29*a* shows the smoking article in a fully extended state, at a first rotational position of the sleeve 123 relative to the tobacco unit 121. The first and second ventilation apertures 126, 127 are not aligned, and in particular, are not aligned rotationally. Thus, ventilation of the smoking article through ventilation apertures 126, 127 is prevented.

FIG. 29*b* shows the smoking article 120 in a fully extended state, at a second rotational position of the sleeve 123 relative to the tobacco unit 121. The first and second ventilation apertures 126 are aligned, allowing ingress of air into the tobacco unit, and in particular into the first filter 122.

As shown in FIG. 31, the first ventilation aperture 126 extends over approximately 50%, of the circumference of the sleeve 123. The second ventilation aperture 127 extends approximately 50%, of the circumference of the tobacco unit 121.

Relative rotation of the sleeve 123 and tobacco unit 121 varies the overlap between the first and second ventilation apertures 126, 127. The amount of overlap determines the effective ventilation area which is open or uncovered, and so varies ventilation of the smoking article 120.

The first and second ventilation apertures 126, 127 can be rotationally aligned when the smoking article 120 is at a maximum longitudinal extension. In a partially extended state, the first and second ventilation apertures 126, 127 may not be aligned.

The first and second ventilation apertures 126,127 preferably extend over approximately 50% of the circumference of the first or second part respectively. Alternatively, one or both of the first and second ventilation apertures 126,127 extend over at least 25% of the respective circumference, or more preferably between 40% and 60% of the respective circumferences, or more preferably between 45% and 55% of the respective circumferences.

FIGS. 32*a* to 104 show a further thirty-six embodiments of smoking articles with variable flow systems, providing for selectable variations in the gaseous flow into the smoking article (ventilation) and/or within the smoking article. The flow system will be referred to as a ventilation system for embodiments in which the ventilation is selectable. In particular, some of these embodiments of smoking article have a ventilation which is determined by the position of a first part, including a source of smokable material, relative to a second part, which is preferably formed of a sleeve. Alternatively, the variable ventilation systems may be applied to a smoking article having a first part, including a source of smokable material and a sleeve, relative to a second part, comprising a filter moveable relative to the sleeve. Alternatively, an embodiment of variable ventilation system may include a first part moveable by rotation and/or longitudinal movement relative to a second part, in which the first part and second part do not include a source of smokable material. In further embodiments, the variable ventilation system may not require relative movement of two parts, and which is independent of the extension of the smoking article. The ventilation provides for entry of air into one or more of a filter, a chamber or a source of smokable material. Alternatively, the flow system may control gaseous flow through the smoking article, which may or may not affect ventilation of the smoking article. Any of the embodiments of ventilation system may be used with any of the embodiments of smoking article described in FIGS. 1 to 5, or with a smoking article in which a first part is rotatable relative to a second part.

FIGS. 32*a* to 33 show an eighth embodiment of ventilation system in a smoking article 130. Smoking article 130 comprises a variable length chamber 135, substantially as described in any of the embodiments above. The smoking article 130 comprises a tobacco unit 131, which may comprise a tobacco rod and first filter 132 as described with respect to FIG. 1 to 3 or 5, or only a tobacco rod, or e.g. as described with respect to FIG. 4. A first part comprising the tobacco unit 131 is moveable relative to a second part of the smoking article comprising a sleeve 133. The variable length chamber 135 is defined between the tobacco unit 131 and a second filter or stain-binder 134. The tobacco unit 131 has a rearward end, which is surrounded by the sleeve 133. The second filter or stain-binder 134 will be referred to as second filter 134.

The sleeve 133 is provided with one or more first ventilation apertures 136 adjacent to a forward end. Preferably, the sleeve 133 comprises a plurality of first ventilation apertures 136 arranged in a single circumferentially extending line. The tobacco unit 131 comprises one or more second ventilation apertures 137 adjacent to a rearward end. Preferably, the tobacco unit 131 comprises a plurality of second ventilation apertures 137 arranged in a single circumferentially extending line. In the illustrated example, the ventilation apertures are provided in the wrapper surrounding the filter 132, providing for the ingress of air into the first filter 132.

FIG. 32*a* shows the smoking article in a fully retracted state. The first and second ventilation apertures 136,137 are not aligned, inhibiting ingress of air into the smoking article.

FIG. 32*b* shows the smoking article 130 in a fully extended state. The first and second ventilation apertures 136, 137 are aligned longitudinally, allowing ventilation of the smoking article through ventilation apertures 136, 137.

FIGS. 32*a* and 32*b* show the smoking article is extended by relative longitudinal movement to provide a maximum ventilation. Alternatively, the maximum ventilation may be provided when the smoking article is retracted, and a minimum ventilation provided when the smoking article is extended. In particular, the ventilation apertures are aligned when the tobacco unit is extended or retracted from the sleeve. Alternatively, the maximum and/or minimum ventilation may be provided at a position intermediate between the maximum and minimum extensions. The positioning of the first and/or second ventilation apertures are configured at the appropriate longitudinal positions to obtain the desired function.

A restraining means comprising a first and second engaging surfaces 139*a*,139*b* prevents separation of the sleeve 133 from the tobacco unit 131. The first engaging surface 139*a* is preferably formed on a section of tobacco unit having an increased diameter, having a step change in diameter from a forward section of the tobacco unit. The forward facing first engaging surface 139*a* is preferably formed by a sheet material wrapped around the tobacco unit 131 and forming a section of increased diameter. Preferably, the first engaging surface 139*a* is formed on a radially outwardly extending edge of tipping paper, connecting a filter 132 to the tobacco rod.

FIG. 33 shows a plan view of a blank for forming the sleeve 133. The second engaging surface 139*b* is provided on an inwardly folded section of the sleeve, formed by folding the sleeve blank along line 139*c*. The tubular sleeve 133 is formed from a sheet of flexible material, and the folded section provides a rearwardly facing edge inside the tube of the sleeve 133 to define the second engaging surface 139*b*. In this embodiment, the restraining means provides for a maximum extension which is independent of relative rotational position.

The sleeve 133 is provided with symbols 138*a*, 138*b*, preferably in the form of arrows. The arrows indicate a forward and rearward longitudinal direction, showing the directions which adjust, i.e. increase or decrease, ventilation. The symbols 138*a*,138*b* may be printed on the sleeve. Alternatively, the symbols 138*a*,138*b* may be cut-outs, e.g. in the shape of arrows, and may reveal one or more printed colours on the underlying tobacco unit, for instance, when the tobacco unit is moved from a retracted to an extended state.

FIGS. 34*a* and 34*b* show a ninth embodiment of ventilation system in a smoking article 140. Smoking article 140 comprises a variable length chamber 145, substantially as described in any of the embodiments above. The smoking article 140 comprises a first part comprising a tobacco unit 141, which may comprise a tobacco rod and first filter 142 as described with respect to FIG. 1 to 3 or 5, or only a tobacco rod, or e.g. as described with respect to FIG. 4. The tobacco unit 141 is moveable relative to a second part of the smoking article comprising a sleeve 143. The variable length chamber 145 is defined between the tobacco unit 141 and a second filter or stain-binder 144. The tobacco unit 141 has a rearward end, which is surrounded by the sleeve 143. The second filter or stain-binder 144 will be referred to as second filter 144.

The tobacco unit 141 comprises one or more ventilation apertures 147 adjacent to a rearward end. Preferably, the tobacco unit 141 comprises a plurality of ventilation apertures 147 arranged in a single circumferentially extending line. The ventilation apertures 147 may overlie, and therefore provide ventilation into, a first filter 142 attached to the tobacco rod, or overlie and provide ventilation into the source of smokable material.

FIG. 34*a* shows the smoking article in a fully retracted state. The ventilation apertures 147 are covered by the surrounding impermeable sleeve 143, inhibiting ingress of air into the smoking article.

FIG. 34*b* shows the smoking article 140 in a fully extended state. The ventilation apertures 147 are located longitudinally beyond a forward end of the sleeve 143, allowing ventilation of the smoking article through ventilation apertures 147.

The smoking article 140 includes a restraining means comprising a first and second engaging surfaces 149*a*,149*b* to prevent separation of the sleeve 143 from the tobacco unit 141. The first engaging surface 149*a* is formed on a section of increased diameter, having a step change in diameter from a forward section of the tobacco unit. The forward facing first engaging surface 149*a* is preferably formed by a sheet material 146 wrapped around the tobacco unit. Preferably, the first engaging surface 149*a* is formed separately, and over, tipping paper connecting a filter to the tobacco rod, and rearwardly of a forward edge of the tipping paper. Thus, a forward edge of the sleeve may be aligned with a forward edge of the tipping paper in the non-ventilating state.

The second engaging surface 149*b* is provided on an inwardly folded section of the sleeve, formed by folding over the sleeve. The tubular sleeve 143 is formed from a sheet of flexible material, and the folded section provides a rearwardly facing edge inside the tube of the sleeve 143 to define the second engaging surface 149*b*. The restraining means provides for a maximum extension which is independent of relative rotational position.

The sleeve 143 may be provided with a symbol, preferably in the form of an arrow. The arrow may indicate a rearward longitudinal direction, showing the direction which increases ventilation. The symbol may be printed on the sleeve. Alternatively, the symbol may be a cut-out, e.g. in the shape of an arrow, and may show a printed colour on the underlying tobacco unit.

FIGS. 35 to 36*c* show a tenth embodiment of ventilation system in a smoking article 150. Smoking article 150 comprises a variable length chamber 155, substantially as described in any of the embodiments above. The smoking article 150 comprises a first part comprising a tobacco unit 151, which may comprise a tobacco rod and first filter as described with respect to FIG. 1 to 3 or 5, or only a tobacco rod, or e.g. as described with respect to FIG. 4. The tobacco unit 151 is moveable relative to a second part of the smoking article comprising a sleeve 153. The sleeve 153 is slidable longitudinally around a rearward end of the tobacco unit. The variable length chamber 155 is defined between the tobacco unit 151 and a second filter or stain-binder 154. The tobacco unit 151 has a rearward end, which is surrounded by the sleeve 153. The second filter or stain-binder 154 will be referred to as second filter 154.

The sleeve 153 is provided with a plurality of sets of first ventilation apertures 156 adjacent to a forward end. The sets of first ventilation apertures 156 are longitudinally spaced apart. Preferably, there are two sets of ventilation apertures 156. Each set of first ventilation apertures 156 comprises one or more ventilation apertures 156. Preferably, each set of first ventilation apertures 156 comprises a plurality of first ventilation apertures 156 extending circumferentially in a single line around the sleeve 153.

The tobacco unit 151 comprises a plurality of sets of second ventilation apertures 157 adjacent to a rearward end. The sets of second ventilation apertures 157 are longitudinally spaced apart, preferably, by the same longitudinal spacing as the longitudinal spacing between the sets of first ventilation apertures 156. Preferably, the smoking article comprises the same number of sets of second ventilation apertures 157 as the number of first ventilation apertures 156. In particular, there are two sets of ventilation apertures 157. Each set of second ventilation apertures 157 comprises one or more ventilation apertures 157. Preferably, each set of second ventilation apertures 157 comprises a plurality of second ventilation apertures 157 extending circumferentially in a single line around the tobacco unit 151. Preferably, each set of second ventilation apertures 157 has the same ventilation area, and the same number of ventilation apertures.

The tobacco unit 151 comprises a plurality of selectable areas 152*a*,152*b*,152*c*,152*d*. Preferably, there are four selectable areas 152*a*,152*b*,152*c*,152*d*. The sets of second ventilation apertures 157 may each be located on a selectable area. In particular, the two sets of second ventilation apertures 157 are located on selectable areas 152*a*,152*b*.

The selectable areas 152*c*,152*d* are not provided with ventilation apertures, and form a substantially air impermeable surface.

The selectable areas 152*a*,152*b*,152*c*,152*d* may be provided with a unique colour, indicating a corresponding amount of ventilation provided. Preferably, selectable area 152*a* is white, and areas 152*b*,152*c*,152*d* are a sequentially increasing darkness of the colour grey.

The smoking article 150 comprises an indexing mechanism, to select one of a plurality of pre-determined extensions. The indexing mechanism comprises a profiled or contoured slot 158 on the sleeve 153. The slot 158 extends longitudinally, and has a plurality of enlarged sections, which define indexing apertures or positions of relatively high width. The enlarged sections are longitudinally separated by sections of lower width defining constrictions. The indexing mechanism further comprises a protrusion 159 on the tobacco unit 151. The protrusion 159 extends radially outwardly and engages in the slot 158. The indexing apertures have an area larger than the protrusion, and the protrusion has a width larger than the width of the elongate slot. Preferably, the protrusion 159 is formed by ink or glue, in the form of a dot of raised ink or glue.

The protrusion 159 is movable within the slot between the three positions of increased width, which correspond to three pre-determined positions. The first part and/or the second part is configured to be resiliently deformable such that the protrusion is movable between the indexing apertures. In the pre-determined positions, zero, one or two of the sets of first ventilation apertures 156 are aligned with the sets of second ventilation apertures 157. The ventilation is determined by the number of separate sets of first ventilation apertures 156 aligned with separate sets of second ventilation apertures 157. Thus, the indexing mechanism provides a number of indexing positions having a unique ventilation which is one more than the number of sets of ventilation apertures in each part.

FIG. 36*a* shows the smoking article 150 in a fully retracted state. The sets of first ventilation apertures 156 are aligned with two of the selectable areas of the tobacco unit 151. In particular, the sets of first ventilation apertures 156 are aligned with selectable areas 152*c*,152*d* which are not provided with any ventilation apertures. Thus, ingress of air into the smoking article is inhibited. The selectable areas 152*c*,152*d* are visible through the first ventilation apertures 156, indicating a relatively low ventilation.

FIG. 36*b* shows the smoking article 150 in a partially extended state. The sets of first ventilation apertures 156 are aligned with selectable areas 152*b*,152*c*. One of the selectable areas 152*b* is provided with second ventilation apertures 157, and one of the selectable areas 152*c* is not provided with any ventilation apertures. Thus, a relatively small ingress of air into the smoking article is provided. The selectable areas 152*b*,152*c* are visible through the first ventilation apertures 156, indicating a medium ventilation.

FIG. 36*c* shows the smoking article 150 in a fully extended state. The sets of first ventilation apertures 156 are aligned with selectable areas 152*a*,152*b*. All of the selectable areas 152*a*,152*b* are provided with second ventilation apertures 157. Thus, a relatively large ingress of air into the smoking article is provided. The selectable areas 152*a*,152*b* are visible through the first ventilation apertures 156, indicating a relatively high ventilation.

Thus, the relative positions of the first and second parts controls the number of sets of first ventilation apertures 156 aligned with a set of second ventilation apertures 157, to select the ventilation of the smoking article.

The indexing apertures preferably extend through the material forming the sleeve. Alternatively, the protrusion may engage in an indexing recess, which is an area defining a larger interior space than the surrounding area. The indexing recess may be formed by deformation of the material of the sleeve. The connecting slot may be an elongate recess, which does not extend through the material of the sleeve. The protrusion extends into the connecting slot to guide the protrusion. Alternatively, the sleeve may be provided with the protrusion and the tobacco unit provided with one or more indexing recesses and connecting slots in the form of recesses.

FIGS. 37 to 39 show an eleventh embodiment of ventilation system in a smoking article 160, having similarities to any of the embodiments above. The smoking article 160 comprises a tobacco unit 161, which may comprise a tobacco rod and first filter as described with respect to FIG. 1 to 3 or 5, or only a tobacco rod, or e.g. as described with respect to FIG. 4. A first part comprising the tobacco unit 161 is moveable relative to a second part of the smoking article comprising a sleeve 163. The tobacco unit 161 has a rearward end, which is surrounded by the sleeve 163. The second filter or stain-binder 164 will be referred to as second filter 164.

The sleeve 163 is provided with a plurality of first ventilation apertures 166 adjacent to a forward end. Preferably, the first ventilation apertures 166 are arranged in an array extending longitudinally and circumferentially over an area of the sleeve 163. Preferably, the array extends circumferentially over a radial angle of approximately 60 degrees.

The tobacco unit 161 comprises one or more second ventilation apertures 167 adjacent to a rearward end. Preferably, the tobacco unit 161 comprises a single second ventilation aperture 167. The second ventilation aperture 167 is an aperture in the air impermeable material forming a surface of the surrounding part of the tobacco unit 161. Alternatively, the second ventilation aperture 167 may be covered by an air permeable material or a material comprising a plurality of ventilation holes. Preferably, the second ventilation aperture 167 extends circumferentially over the same radial angle as the first ventilation aperture, preferably approximately 60 degrees.

Relative rotation of the sleeve 163 and tobacco unit 161 varies the overlap between the first and second ventilation apertures 166, 167. The amount of overlap determines the effective ventilation area which is open or uncovered, and so varies ventilation of the smoking article 160.

The smoking article 160 is provided with a ventilation indicator means, for indicating the ventilation state of the smoking article. The indicator means also functions as a limiting means, configured to limit relative rotational movement to a predetermined range. The ventilation indicator means comprises a circumferentially extending slot 168 in the sleeve, and a marker 169 on the tobacco unit 161. Relative rotation between the tobacco unit 161 and sleeve 163 produces free movement of the marker 169 within the slot 168, indicating a corresponding ventilation. The marker, defining a first engaging surface, is engagable with a second engaging surface formed by each end of the slot to limit rotation. In addition, the tobacco unit 161 may be coloured differently on each side of the marker 168. The colour visible through the slot 168 also, or alternatively, indicates the ventilation state.

The marker 169 may be formed of ink or glue. In particular, the marker 169 may be a protrusion, preferably formed of raised ink or glue. The marker 169 may be configured to engage with the ends of the slot 169, preventing further relative rotational movement.

The smoking article 160 is preferably not an extendable smoking article. The ventilation is variable by relative rotation, without extending of the smoking article. The smoking article 160 may alternatively be extendable. Ventilation is not provided when apertures 166,167 are longitudinally spaced.

FIGS. 37 and 38*a* show the smoking article 160 in a minimum ventilation state. The first and second ventilation apertures 166,167 are not aligned. The marker 169 is at an end of the slot 168.

FIGS. 38*b* and 39 show the smoking article 160 in a maximum ventilation state. The first and second ventilation apertures 166,167 are fully aligned. The marker 169 is at an opposite end of the slot 168. The ventilation can be varied between the minimum and maximum by controlling the overlap between the first and second ventilation apertures 166,167, as indicated by the marker 169.

The first and second ventilation apertures 166,167 preferably each extend over approximately 60 degrees, or 16.7%, of the circumference of the first or second part respectively. Alternatively, one or both of the first and second ventilation apertures 166,167 extend over at least 10% of the respective circumference, or more preferably between 10% and 40% of the respective circumferences, or more preferably between 15% and 20% of the respective circumferences.

The first ventilation aperture has been described as an array of a plurality of apertures extending longitudinally and circumferentially over an area of the sleeve. The second ventilation aperture has been described as a single aperture in the tobacco unit. Alternatively, the first ventilation aperture in the sleeve may comprise a single ventilation aperture. The first ventilation aperture may have a triangular or rectangular outline. Alternatively, the first ventilation aperture may comprise a small number of discrete apertures, for example two to five apertures, and preferably three apertures. The apertures may be rectangular in outline, and extend longitudinally. The visibility of a coloured area on the tobacco unit under the first ventilation apertures may indicate the selected ventilation. The second ventilation aperture in the tobacco unit may comprise a plurality of apertures in an array extending longitudinally and circumferentially over an area of the tobacco unit, or a single aperture. The ventilation is controlled by overlap of the first and second ventilation apertures. The function of the smoking article and indicator means may be as described above.

FIGS. 40 to 42 show a twelfth embodiment of ventilation system in a smoking article 170, similar to any of the embodiments above. The smoking article 170 comprises a tobacco unit 171, which may comprise a tobacco rod and first filter as described with respect to FIG. 1 to 3 or 5, or only a tobacco rod, or e.g. as described with respect to FIG. 4. A first part comprising the tobacco unit 171 is moveable relative to a second part of the smoking article comprising a sleeve 173, wherein the first part is rotatable and not slidable longitudinally relative to the second part. The tobacco unit 171 has a rearward end, which is surrounded by the sleeve 173. The second filter or stain-binder 174 will be referred to as second filter 174.

The sleeve 173 is provided with a plurality of first ventilation apertures 176 adjacent to a forward end. Preferably, the first ventilation apertures 176 are arranged in a plurality of arrays extending longitudinally and circumferentially over an area of the sleeve 173. Preferably, there are two spaced apart arrays, each array extending over a radial angle of approximately 90 degrees, and are spaced apart by approximately 90 degrees.

The tobacco unit 171 comprises one or more second ventilation apertures 177 adjacent to a rearward end. Preferably, the tobacco unit 171 comprises a plurality of second ventilation apertures 177. Preferably, there are two spaced apart second ventilation apertures 177, each defining a set comprising a single aperture extending longitudinally and circumferentially over an area of the tobacco unit. The second ventilation apertures 177 are apertures in the air impermeable material forming a surface of the surrounding part of the tobacco unit 171. Alternatively, the second ventilation aperture 177 may be covered by an air permeable material. Preferably, the second ventilation apertures 177 each extend over a radial angle of approximately 60 degrees, and are spaced apart by approximately 90 degrees. Preferably, the dimensions of the arrays of first ventilation apertures 176 and second ventilation apertures 177 are approximately equal.

Relative rotation of the sleeve 173 and tobacco unit 171 varies the overlap between the first and second ventilation apertures 176, 177. The amount of overlap determines the effective ventilation area which is open or uncovered, and so varies ventilation of the smoking article 170.

The smoking article 170 is provided with a ventilation indicator means, for indicating the ventilation state of the smoking article. The ventilation indicator means comprises a circumferentially extending marker strip 178 on the tobacco unit 171. Preferably, the marker strip 178 indicates the circumferential position of the second ventilation apertures 177. Relative rotation between the tobacco unit 171 and sleeve 173 produces relative movement of the marker strip 178 and the arrays of first ventilation apertures 176 on the sleeve 173, indicating a corresponding ventilation.

The marker strip 178 may comprise four areas, having two different colours. A first colour 178*a* is aligned between the second ventilation apertures 177, and a second colour 178*b* is aligned with the second ventilation apertures 177, and extends over the same circumferential range as the second ventilation apertures 177. The overlap of the first colour 178*a* with an array of first ventilation apertures 176 indicates there is no overlap of the first and second ventilation apertures 176, 177, and a low ventilation. The overlap of the second colour 178*b* with an array of first ventilation apertures 176 indicates there is an overlap of the first and second ventilation apertures 176, 177, and a high ventilation.

The smoking article 170 is preferably not an extendable smoking article. The ventilation is variable by relative rotation, without extending of the smoking article. A restraining means comprising first and second engaging surface 179*a*,179*b* prevents extension, whilst allowing free rotation. The first engaging surface 179*a* is preferably formed on a section of increased diameter, having a step change in diameter from a forward section of the tobacco unit. The forward facing first engaging surface 179*a* is preferably formed by a sheet material (e.g. paper) wrapped around the tobacco unit and forming a section of increased diameter. Preferably, the first engaging surface 179*a* is formed on a radially outwardly extending edge of tipping paper, connecting a filter to the tobacco rod.

The second engaging surface 179*b* is provided within an interior surface of the cylindrical tube forming the sleeve. The second engaging surface 179*b* is on an inwardly folded section of the sleeve, formed by folding the sleeve blank. The tubular sleeve 173 is formed from a sheet of flexible material, and the folded section provides an end defining a rearwardly facing edge inside the tube of the sleeve 173, to define the second engaging surface 179*b*. Forward movement of the sleeve over the tobacco unit is prevented by the second filter 174 abutting against the tobacco unit, preferably against the first filter. In this embodiment, the restraining means provides for a maximum extension which is independent of relative rotational position. The smoking article 170 may alternatively be extendable. Ventilation is not provided when apertures 176,177 are longitudinally spaced.

FIGS. 40 and 41*a* show the smoking article 170 in a minimum ventilation state. The first and second ventilation apertures 176,177 are not aligned. The marker strip 178 has a first colour 178*a* aligned with an array of first ventilation apertures 176.

FIGS. 41*b* and 42 show the smoking article 170 in a maximum ventilation state. The first and second ventilation apertures 176,177 are fully aligned. The ventilation can be varied between the minimum and maximum by controlling the overlap between the first and second ventilation apertures 176,177, as indicated by the marker strip 178.

The first and second ventilation apertures 176,177 preferably each extend over approximately 90 degrees, or 25%, of the circumference of the first or second part respectively. Alternatively, one of the first and second ventilation apertures 176,177 extend between 15% and 40% of the respective circumferences, or more preferably between 20% and 30% of the respective circumferences. The other of the first and second ventilation apertures 176,177 may extend over the remaining part of the circumference, such that the whole circumference has one of a first and second ventilation apertures 176,177. Preferably, the first and second ventilation apertures 176,177 do not overlap at one or more relative rotational positions.

FIGS. 43*a* to 46 show a thirteenth embodiment of ventilation system in a smoking article 210, substantially as described in any of the embodiments above. The smoking article 210 comprises a tobacco unit 211, which may comprise a tobacco rod and first filter 212 as described with respect to FIG. 1 to 3 or 5, or only a tobacco rod, or e.g. as described with respect to FIG. 4. A first part comprising the tobacco unit 211 is moveable relative to a second part of the smoking article comprising a sleeve 213. The tobacco unit 211 has a rearward end, which is surrounded by the sleeve 213. The second filter or stain-binder 214 will be referred to as second filter 214.

The sleeve 213 is provided with one or more first ventilation apertures 216 adjacent to a forward end. Preferably, the sleeve comprises a single ventilation aperture 216 extending longitudinally and circumferentially over an area of the sleeve 213. The ventilation aperture 216 may be a circular aperture.

The tobacco unit 211 comprises one or more second ventilation apertures 217 adjacent to a rearward end. Preferably, the tobacco unit 211 comprises a plurality of second ventilation apertures 217 arranged in an array extending longitudinally and circumferentially. The second ventilation apertures 217 are apertures in the air impermeable material forming a surface of the surrounding part of the tobacco unit 211. Alternatively, the second ventilation apertures 217 may be covered by an air permeable material.

Relative rotation of the sleeve 213 and tobacco unit 211 varies the overlap between the first and second ventilation apertures 216, 217. The amount of overlap determines the effective ventilation area which is open or uncovered, and so varies ventilation of the smoking article 210.

The smoking article 210 is provided with a state indicator, for indicating the ventilation state of the smoking article. The state indicator comprises a coloured area on the tobacco unit 211 adjacent the second ventilation apertures 217. The coloured area is visible through the first ventilation aperture 216 to indicate a high ventilation, or partially or not visible to indicate partial or minimum ventilation respectively.

The smoking article 210 is preferably not an extendable smoking article. The ventilation is variable by relative rotation, without extending the smoking article.

FIG. 43*a* shows the smoking article 210 in a minimum ventilation state. The first and second ventilation apertures 216,217 are not aligned.

FIG. 43*b* shows the smoking article 210 in a maximum ventilation state. The first and second ventilation apertures 216,217 are fully aligned. The coloured area on the tobacco unit 211 is visible though the first ventilation aperture 216.

FIG. 44 shows an exploded view of the smoking article 210. The smoking article 210 comprises a tobacco unit 211 having a first filter attached to the tobacco rod. The tobacco unit 211 comprises a first stopper 219. The first stopper 219 is an elongate strip in the form of a tongue overlying an outer surface of the tobacco unit, at a rearward end of the tobacco unit. The first stopper 219 protrudes in a radially outward direction. The first stopper 219 may be formed from a folded over section of flexible material, in particular paper, attached to a section wrapped around the circumference of the tobacco unit.

The sleeve 213 comprises a second filter 214 attached at a rearward end. The sleeve comprises a second stopper 218. The second stopper 218 is an elongate strip in the form of a tongue extending along an inner surface at a forward end of the sleeve 213. The stopper 218 is within the cylindrical tube of the sleeve. The second stopper 218 protrudes in a radially inward direction. The second stopper 218 may be formed from a folded over section of flexible material, in particular paper, forming the sleeve 213. The first ventilation aperture 216 extends through the sleeve 213 and second stopper 219.

FIG. 45 shows a cross-section through the smoking article 210. The first and second stoppers 218,219 form a limiting mechanism for limiting relative rotation between the sleeve 213 and tobacco unit 211. The first and second stoppers 218,219 can abut to prevent further rotation between the sleeve 213 and tobacco unit 211. The first and second ventilation apertures 216,217 are aligned when the first and second stoppers 218,219 are abutting. The stoppers 218,219 provide an index position for a high ventilation. A user may rotate the sleeve 213 relative to the tobacco unit 211 until the stoppers 218,219 abut at the index position, in order to obtain a high ventilation. The user may rotate the sleeve 213 relative to the tobacco unit 211 in a single direction away from the index position to reduce ventilation.

FIG. 46 shows a blank for the sleeve 213 and stopper 218. The blank is configured to form a cylindrical tube. The blank has an aperture 216*a* for forming the first ventilation aperture 216. Prior to forming the cylindrical tube, the blank is folded along fold-line 220. The stopper 218 is folded over by 180°, onto a part of the blank forming an interior surface of the sleeve 213. The stopper 218 comprises an aperture 216*b* which is aligned with the aperture 216*a* for forming the first ventilation aperture 216. Alternatively, the first ventilation aperture 216 may be formed on the sleeve 213 and spaced from the tongue.

The smoking article 210 is preferably not an extendable smoking article. The ventilation is variable by relative rotation, without extending of the smoking article. A restraining means comprising first and second engaging surface prevents extension, whilst allowing free rotation, substantially as described with respect to FIGS. 14 to 16 with modified dimensions such that the first and second filter sections are abutting when the first and second engaging surfaces are abutting. The first engaging surface is preferably formed on a section of increased diameter, having a step change in diameter from a forward section of the tobacco unit. The forward facing first engaging surface is preferably formed by a sheet material wrapped around the tobacco unit and forming a section of increased diameter. Preferably, the first engaging surface is formed on a radially outwardly extending edge of tipping paper, connecting a filter to the tobacco rod. Alternatively, a forward edge of the tongue 219 may provide the first engaging surface.

The second engaging surface is provided on an inwardly folded section of the sleeve, formed by folding the sleeve blank along fold line 220. The tubular sleeve 213 is formed from a sheet of flexible material, and the folded section provides a rearwardly facing edge inside the tube of the sleeve 213 to define the second engaging surface. In this embodiment, the restraining means provides for a maximum extension which is constant and independent of relative rotational position.

FIGS. 47 to 49 show a fourteenth embodiment of ventilation system in a smoking article 250. Smoking article 250 comprises a variable length chamber, substantially as described in any of the embodiments above. The smoking article 250 comprises a tobacco unit 251, which may comprise a tobacco rod and first filter as described with respect to FIG. 1 to 3 or 5, or only a tobacco rod, or e.g. as described with respect to FIG. 4. A first part comprising the tobacco unit 251 is moveable relative to a second part of the smoking article comprising a sleeve 253. The variable length chamber is defined between the tobacco unit 251 and a second filter or stain-binder. The tobacco unit 251 has a rearward end, which is surrounded by the sleeve 253. The second filter or stain-binder will be referred to as second filter.

The tobacco unit 251 comprises one or more ventilation grooves 256 adjacent to a rearward end. Preferably, the tobacco unit 256 comprises a plurality of ventilation grooves 256 extending substantially longitudinally. The ventilation grooves 256 may be selectively covered by the sleeve 253 to control the ventilation. The sleeve 253 is formed of a substantially air impermeable material, preferably paper. Air can flow into an exposed part of a ventilation groove 256 which is not covered by the sleeve. The air can flow rearwardly along the groove 256, and into the tobacco unit or chamber of the smoking article. The air can flow from the grooves 256 through an open rear end of the grooves, or through ventilation apertures formed in a rearward part of the grooves.

FIG. 47 shows the smoking article 250 in an extended state, with the tobacco unit 251 at a maximum longitudinal extension relative to the sleeve 253. The smoking article is shown having four grooves, or may comprise one, two, three, five or more grooves. The ventilation grooves 256 of uniform cross-section formed in the tobacco unit 251 extend beyond the sleeve 253. The smoking article 256 has a maximum ventilation when all the ventilation grooves 256 are open to receive air flow. The ventilation grooves 256 extend over a range of distances from a rearward end of the tobacco unit 251. At least one groove has a forward end which is at a different longitudinal position to at least one other groove. Preferably, each ventilation groove 256 extends a unique distance longitudinally. Alternatively, a plurality of grooves may extend to a first longitudinal position, and one or more further grooves may extend to a second longitudinal position, different to the first longitudinal position. The grooves 256 preferably all extend to the same rearward position, which may be the rearward end of the tobacco unit. Alternatively, the grooves 256 may extend to different rearward positions. The grooves may each have substantially the same length, and be positioned at different longitudinal locations.

FIG. 48 shows an enlarged view of the ventilation grooves 256. Two grooves 256*a*,256*b* extend at least partially beyond the sleeve 253, allowing air flow into those grooves 256*a*,256*b* and through the grooves 256*a*,256*b* and into or rearwardly of the tobacco unit 251. Any part or length of the groove which is not covered by the sleeve 253 allows air flow into the groove, and hence into the smoking article. The two grooves 256*c*,256*d* which are fully covered by the sleeve 253 do not allow air flow into the smoking article 250, and do not contribute to ventilation. The number of ventilation grooves 256 extending beyond the sleeve 253 determines the ventilation. Thus, the relative longitudinal position of the sleeve 253 relative to the tobacco unit 251 determines the ventilation of the smoking article 250.

FIG. 49 shows a cross-section through the smoking article 250. The grooves 256 are preferably formed in an exterior surface of the first filter of the tobacco unit 251. The grooves 256 are pressed into the first filter during production. The first filter preferably comprises a filter material, for example, cellulose acetate, circumscribed by a filter wrap. The filter wrap forms a continuous outer surface around the circumference of the first filter, including through the ventilation grooves 256. The filter wrap is substantially air impermeable, and forms a channel with the sleeve to carry air flow along the ventilation grooves 256.

Alternatively, the sleeve 253 may be provided with ventilation apertures at a pre-determined longitudinal position or range. Alignment of the ventilation grooves 256 with the ventilation apertures allows flow of air into the grooves 256, and hence into the smoking article. The amount of ventilation is controlled by extension of the smoking article, by alignment of the grooves 256 with the apertures in the sleeve, in addition or instead of alignment of the grooves 256 beyond a forward end of the sleeve 253.

The ventilation apertures have been described as extending to different lengths to provide a plurality of levels of ventilation. Alternatively, different ventilation levels can be provided with a single groove having a non-uniform cross-section or extent in a circumferential direction. The groove may have a cross-section which reduces in circumferential extent towards a forward end of the smoking article. In particular, the groove may taper to an apex in a forward direction. The ventilation of the smoking article may be determined by the area of groove which extends beyond a forward end of the sleeve. The extension of the smoking article controls the longitudinal extent of the exposed groove, which determines the circumferential cross-section of groove which is uncovered.

FIG. 50 shows a fifteenth embodiment of ventilation system in a smoking article 260. Smoking article 260 comprises a variable length chamber 265, substantially as described in any of the embodiments above. The smoking article 260 comprises a tobacco unit 261, which may comprise a tobacco rod and first filter as described with respect to FIG. 1 to 3 or 5, or only a tobacco rod, or e.g. as described with respect to FIG. 4. A first part comprising the tobacco unit 261 is moveable relative to a second part of the smoking article comprising a sleeve 263. The variable length chamber is defined between the tobacco unit 261 and a second filter or stain-binder. The tobacco unit 261 has a rearward end, which is surrounded by the sleeve 263. The second filter or stain-binder will be referred to as second filter.

The tobacco unit 261 comprises one or more ventilation apertures 266 adjacent to a rearward end. Preferably, the tobacco unit 266 comprises a plurality of ventilation apertures 266 spaced at longitudinally at intervals. A plurality of ventilation apertures 266 may also be spaced circumferentially at each longitudinal interval. FIG. 50 shows three sets of ventilation apertures 266 spaced at longitudinally at intervals along the tobacco rod section and/or filter, allowing ingress of air into the tobacco rod and/or filter respectively. The ventilation apertures 266 may be covered by the sleeve 263, formed of air impermeable material, to prevent ingress of air and control the ventilation.

FIG. 50 shows the smoking article 260 in a partially extended state, with the tobacco unit 261 near a maximum longitudinal extension relative to the sleeve 263. The sleeve 264 is provided with one or more helical grooves 269 adjacent a forward end. The tobacco unit 261 is provided with one or more helical ribs 268 adjacent a rearward end. The helical grooves 269 and ribs 268 mate to form engaging threaded surfaces. When the helical grooves 269 and ribs 268 are engaged, a relative rotation between the sleeve 263 and tobacco unit 261 actuates a relative longitudinal movement. The ribs 268 may be formed by printing, i.e. formed of raised ink or glue. The grooves 269 may be formed by any suitable process. The relative longitudinal movement may selectively cover or uncover the ventilation apertures 266 and alter the ventilation of the smoking article. The threaded surfaces 268,269 provide for precise variation in ventilation. In addition, the threaded surfaces 268,269 provide and/or enhance the seal between the sleeve 263 and tobacco unit 261.

The smoking article 260 is extendable between a retracted state and an extended state. In the retracted state and a partially extended state, the threaded surfaces 268,269 are not engaged and the sleeve 263 can slide freely around the tobacco unit 261. The threaded surfaces 268,269 only engage approaching the fully extended state, when the ventilation apertures 266 are adjacent a forward end of the sleeve 263.

The tobacco unit 261 comprises a visual indicator for indicating the positions of the ventilation apertures 266. Preferably, the visual indicator is a series of spaced apart circumferentially extending printed lines, aligned with the ventilation apertures 266. The number of printed lines visible indicates the ventilation.

FIGS. 51*a* to 52 show a sixteenth embodiment of ventilation system in a smoking article 270. Smoking article 270 comprises a variable length chamber, substantially as described in any of the embodiments above. The smoking article 270 comprises a tobacco unit 271, which may comprise a tobacco rod and first filter as described with respect to FIG. 1 to 3 or 5, or only a tobacco rod, or e.g. as described with respect to FIG. 4. A first part comprising the tobacco unit 271 is moveable relative to a second part of the smoking article comprising a sleeve 273. The variable length chamber is defined between the tobacco unit 271 and a second filter or stain-binder. The tobacco unit 271 has a rearward end, which is surrounded by the sleeve 273. The second filter or stain-binder will be referred to as second filter.

FIGS. 51*a* and 51*b* show the smoking article 270 in a retracted and extended state respectively. The sleeve 273 may slide around the tobacco unit substantially as described with respect to FIGS. 6*a* to 7. The smoking article may comprise a restraining means having engaging surfaces to limit longitudinal sliding of the sleeve 273 with respect to the tobacco unit. The restraining means may be as described in any embodiment, for example, the embodiment described with respect to FIGS. 12 to 15.

The sleeve 273 is partially surrounded by an outer sleeve 274. The outer sleeve 274 is a cylindrical tube located around the sleeve 273. The outer sleeve 274 comprises a circumferential frangible connection 278, providing for separation of the outer sleeve 274 into two parts. The frangible connection 278 may be formed by perforations in the outer sleeve 274, and broken by twisting one part relative to the other part. The outer sleeve 274 is a cylindrical tube preferably formed of a flexible material, e.g. paper. The tube is preferably formed from a rectangular blank by adhering opposite sides together. The outer sleeve 274 may be formed from a blank around the sleeve 273, or formed into a tube and then inserted around the sleeve 273.

FIG. 52 shows the outer sleeve 274 divided into two parts, a rearward section 274*a* and a forward section 274*b*. One or both of the rearward section 274*a* and the forward section 274*b* are slidable longitudinally around the sleeve 273. The rearward section 274*a* and a forward section 274*b* are separable to uncover one or more ventilation apertures 276 in the underlying sleeve 273. Preferably, a plurality of ventilation apertures 276 are arranged in an array on the sleeve 273. The ventilation apertures 276 allow ingress of air into the smoking article 270 when uncovered. The amount of separation of the section 274*a*,27*b* determines the number or surface area of the ventilation apertures 276 uncovered, controlling ventilation. The ventilation apertures 276 may allow air into the second filter, into the chamber when the smoking article is fully or partially extended, or into the tobacco unit if the ventilation apertures 276 are aligned with ventilation apertures (not shown) in the tobacco unit. Alternatively, the tobacco unit may have an air impermeable exterior surface (without ventilation apertures) which prevents flow of air into the smoking article when the tobacco unit underlies the ventilation apertures 276.

Preferably, the rearward section 274*a* of the outer sleeve is permanently fixed to the sleeve 273. The forward section 274*b* is slidable forwardly to uncover the ventilation apertures 276. Alternatively, the forward section 274*b* of the outer sleeve is permanently fixed to the sleeve 273. The rearward section 274*a* is slidable rearwardly to uncover the ventilation apertures 276. Alternatively, both the forward section 273*b* and rearward section 274*a* are slidable around the sleeve 273. The smoking article may comprise a restraining means to limit longitudinal movement of the rearward section 274*a* and/or forward section 274*b*. The restraining means may be formed by engaging surfaces on a raised section formed by embossing, a folded over section of material, or an additional section of material, analogous to any embodiment of restraining means described.

The sleeve 273 has been described as slidable relative to the tobacco unit. Alternatively, the sleeve may be fixedly attached to the tobacco unit, or integrated with the tobacco unit such that the outer sleeve 274 is on the tobacco unit.

FIGS. 53 and 54 show a seventeenth embodiment of ventilation system in a smoking article 280. The smoking article 280 has substantially the same structure as the smoking article 270 shown in FIGS. 51*a* to 52, with the following differences.

The smoking article 280 has an outer sleeve 284 surrounding a sleeve as previously described. The outer sleeve 284 comprises two circumferential frangible connections 288,289 providing for separation of a strip 287 from the outer sleeve 274. The strip 287 has an end 287*a* which is initially separate or frangible from the opposite end of the strip 287. The end 287*a* is liftable or graspable by a user in order to initiate lifting of the strip 287.

FIG. 54 shows the strip 287 partially separated from the outer sleeve 284. The strip 287 is moveable to uncover one or more ventilation apertures 286. Preferably, a plurality of ventilation apertures 286 are arranged in an array on the sleeve 283. The ventilation apertures 286 allow ingress of air into the smoking article 270 when uncovered.

Preferably, the parts of the outer sleeve 284 adjacent to the strip 287 are permanently fixed to the sleeve 283. Alternatively, a part of the outer sleeve 284 forward of the strip and/or a part of the outer sleeve 284 rearward of the strip are slidable around the sleeve 283 when the strip has been removed.

The sleeve 283 has been described as slidable relative to the tobacco unit. Alternatively, the sleeve may be fixedly attached to the tobacco unit, or integrated with the tobacco unit such that the removable strip is on the tobacco unit.

FIGS. 55 and 56 show an eighteenth embodiment of ventilation system in a smoking article 290. Smoking article 290 comprises a variable length chamber 295, substantially as described in any of the embodiments above. The smoking article 290 comprises a tobacco unit 291, which may comprise a tobacco rod and first filter as described with respect to FIG. 1 to 3 or 5, or only a tobacco rod, or e.g. as described with respect to FIG. 4. A first part comprising the tobacco unit 291 is moveable relative to a second part of the smoking article comprising a sleeve 293. The variable length chamber is defined between the tobacco unit 291 and a second filter 294 or stain-binder. The tobacco unit 291 has a rearward end, which is surrounded by the sleeve 293. The second filter or stain-binder will be referred to as second filter 294.

The sleeve 293 comprises one or more ventilation apertures 296 adjacent to a rearward end. The ventilation apertures 296 provide for ingress of air into the chamber 295, forwardly of the second filter 294. Preferably, the sleeve 293 comprises a plurality of ventilation apertures 296 spaced in an array over a longitudinally circumferentially extending area.

A plug 298 is located within the sleeve 293, between the tobacco unit 291 and the second filter 294. The plug 298 is moveable longitudinally within the chamber 295, when the smoking article 290 is extended such that the chamber is longer than the plug 298. The plug 298 is preferably a cylinder having a curved exterior surface substantially matching the diameter of an interior surface of the sleeve 293. The exterior surface of the plug 298 is substantially impermeable to air.

The plug 298 is configured to allow air to flow longitudinally through the plug. Preferably, the plug 298 comprises a bore 299 extending axially through the plug. The bore is preferably cylindrical and centrally located. The bore 299 allows air to flow with minimal resistance through the plug 299. The plug 299 is not moved by air flow through the smoking article 290.

FIG. 55 shows the smoking article 290 in an extended state, in a first ventilation state. The plug 298 is located adjacent a forward end of the chamber 295, adjacent the tobacco unit. Air can enter through the ventilation apertures 296 into the chamber, providing ventilation to the smoking article 290. The plug 298 does not inhibit flow of air through the ventilation apertures 296.

FIG. 56 shows the smoking article 290 in an extended state, in a second ventilation state. The plug 298 is located adjacent a rearward end of the chamber 295, adjacent the second filter 294. The plug 298 covers the ventilation apertures 296, preventing air from entering through the ventilation apertures 296.

The plug 298 and/or interior surface of the chamber 295 are coated in a low friction material. The low friction material allows the plug 298 to move freely inside the sleeve 293. The plug 298 is moved forwardly or rearwardly to select the level of ventilation. The plug 298 is preferably moved by angling the smoking article 290, and allowing the plug 298 to slide under gravity. The plug 298 is therefore controlled without external contact.

The plug 298 has an outer surface which is coloured. The coloured outer surface is visible through the ventilation apertures 296, providing an indication of the position of the plug 298 and the ventilation of the smoking article 290.

The ventilation apertures 296 have been shown and described as located at a rearward section of the sleeve 293. Alternatively, the ventilation apertures 296 may be located at a forward section of the sleeve 293. Alternatively, the ventilation apertures 296 may be located at a forward and rearward section of the sleeve 293, the ventilation apertures 296 having a different area at a forward section from a rearward section.

The plug 298 may have any shape or configuration having an exterior surface to cover the ventilation apertures, whilst allowing axial air flow past or through the plug. For example, the plug may be solid and air permeable in an axial direction. The plug 298 has been described as slidable longitudinally within a variable length chamber. Alternatively, the smoking article 290 may not be extendable, and the plug 298 may be slidable longitudinally within a fixed length chamber to vary ventilation.

FIGS. 57 to 59 show a nineteenth embodiment of ventilation system in a smoking article 300. Smoking article 300 comprises a variable length chamber 305, substantially as described in any of the embodiments above. The smoking article 300 comprises a tobacco unit 301, which may comprise a tobacco rod and first filter as described with respect to FIG. 1 to 3 or 5, or only a tobacco rod, or e.g. as described with respect to FIG. 4. A first part comprising the tobacco unit 301 is moveable relative to a second part of the smoking article comprising a sleeve 303. The variable length chamber is defined between the tobacco unit 301 and a second filter 304 or stain-binder. The tobacco unit 301 has a rearward end, which is surrounded by the sleeve 303. The second filter or stain-binder will be referred to as second filter.

FIG. 57 shows the smoking article 300 in a retracted state. The sleeve 303 comprises one or more ventilation flaps 306. Preferably, the sleeve 303 comprises a plurality of ventilation flaps 306 spaced circumferentially around a circumference of the sleeve 303.

FIG. 58 shows the smoking article 300 in a partially or fully extended state. The tobacco unit 301 is at least partially moved out of the sleeve 303 to define a chamber 305. The ventilation flaps 306 are configured to open inwardly into the chamber 305. The ventilation flaps 306 are configured to be hinged open by rearward air flow through the chamber 305 alone. The opened ventilation flaps 306 uncover ventilation apertures 307 through which air can ingress into the chamber 305.

FIG. 58 shows an enlarged view of the ventilation flaps 306. The ventilation flaps 306 are attached to the sleeve along a hinge line 308. The ventilation flaps 306 are pivotable about the hinge line 308. The hinge line 308 extends circumferentially at a rearward end of the ventilation flaps 306. The ventilation flaps 306 are formed by a cut in the sleeve 303, which defines the sides of the ventilation flaps 306 apart from the hinge line 308. The cut defines a distal edge 309 extending opposite to the hinge line 308. The ventilation flaps 306 are substantially shaped as a trapezium in outline, and preferably an isosceles trapezium. The distal edge 309 is longer than the hinge line 308. The trapezium shape and relatively short hinge line 308 provides a relatively large surface area for the ventilation flaps 306 whilst allowing the ventilation flaps 306 to easily open.

The ventilation flaps 306 open inwardly into the chamber 305. When the smoking article is in a retracted state, the tobacco unit 301 is adjacent the second filter 304 and extends under the ventilation flaps 306. The ventilation flaps 306 cannot open inwardly when the smoking article is in the retracted state.

The ventilation flaps 306 allow ventilation into the smoking article 300. The level of ventilation depends on the angle at which the ventilation flaps 306 are opened, which determines the area of the ventilation apertures 307. The angle at which the ventilation flaps 306 are opened is solely by flow of air through the chamber 305. Thus, the level of ventilation depends on the flow of air, which is determined by the air flow generated by a user. The user therefore controls the level of ventilation.

The ventilation flaps have been described as trapezoid. Alternatively, the ventilation flaps may have another shape, for example, any polygonal shape such as square, pentagonal, or substantially circular or substantially oval. In particular, the ventilation flaps may have any shape having a distal edge or maximum extent in a direction parallel to the hinge line which is longer than the hinge line for ease of opening. For example, for a ventilation flap in the form of a regular pentagon, one of the five sides may be the hinge line. The ventilation flap has a circumferential extent which is a maximum at a longitudinal position spaced from the distal edge of the ventilation flap, and said maximum circumferential extent is longer than the hinge line. Alternatively, the hinge line may be same length as a distal edge or maximum circumferential extent, for example, if the ventilation flap is a square. Alternatively, the hinge line may be longer in length than a distal edge or maximum circumferential extent.

The ventilation flaps have been described as opening onto a variable length chamber. Alternatively, the smoking article 300 may not be extendable, and the flaps may open onto a fixed length chamber to vary ventilation. The hinge line for each ventilation aperture may extend at any angle to a circumferential direction.

FIGS. 60*a* to 61*d* show a twentieth embodiment of ventilation system in a smoking article 310. Smoking article 310 comprises a variable length chamber, substantially as described in any of the embodiments above. The smoking article 310 comprises a tobacco unit 311, which may comprise a tobacco rod and first filter as described with respect to FIG. 1 to 3 or 5, or only a tobacco rod, or e.g. as described with respect to FIG. 4. A first part comprising the tobacco unit 311 is moveable relative to a second part of the smoking article comprising a sleeve 313. The variable length chamber is defined between the tobacco unit 311 and a second filter or stain-binder. The tobacco unit 311 has a rearward end, which is surrounded by the sleeve 313. The second filter or stain-binder will be referred to as the second filter.

FIG. 60*a* shows the smoking article 310 in a retracted state. The sleeve 313 is partially surrounded by an outer sleeve 314. The outer sleeve 314 is a cylindrical tube located around the sleeve 313. The outer sleeve 314 comprises a frangible, or breakable, connection 318, providing for separation of the outer sleeve 314 into two sections. The frangible connection 318 extends at an angle to a circumference of the outer sleeve 314.

FIG. 60*b* shows the smoking article 310 in an extended state. The outer sleeve 314 is formed of two sections, a first or forward section 314*b*, and a second or rearward section 314*a*. The rearward section 314*a* and forward section 314*b* are divided by the frangible connection 318. The forward section 314*b* is rotatable relative to the rearward section 314*a*. Preferably, the forward section 314*b* is freely rotatable and freely slidable longitudinally around the sleeve 313. The relative rotation of the two sections 314*a*,314*b* and oblique angle of the connecting line 318 actuates forward longitudinal movement of the forward section 314*b* by a cam action. The abutting ends of the two sections 314*a*,314*b* are configured to actuate longitudinal movement of the first or second section when rotated, wherein the longitudinal movement of the first or second section selectively covers or uncovers one or more ventilation apertures 316 in the sleeve 313. The abutting ends are preferably in a plane angled to a circumferential line, or alternatively, may have any shape to provide for longitudinal movement when abutting and rotated.

The movement of the forward section 314*b* and complementary shaped ends of the two parts 314*a*,314*b* uncovers a portion of the sleeve 313 between the two parts 314*a*,314*b* of the outer sleeve 314. The uncovered portion of the sleeve 313 comprises one or more ventilation apertures 316. Preferably, a plurality of ventilation apertures 316 are arranged in an array on the sleeve 313. The ventilation apertures 316 allow ingress of air into the smoking article 310 when uncovered. Preferably, the sleeve 313 with the ventilation apertures 316 is formed of a micro-vented membrane. The rotatable section 314*b* is also configured to uncover ventilation apertures dependent on its relative rotational position. The angled rearward edge has a position which varies with rotation, independent of the actuated longitudinal movement. The combination of rotation and the longitudinal movement due to the same rotation, of the rotatable section 341*b* selects the ventilation. The operation of the outer sleeve 314 to select ventilation is independent of the extension of the tobacco unit within the sleeve 313.

Preferably, the rearward section 314*a* of the outer sleeve is permanently fixed to the sleeve 313. The forward section 314*b* is slidable forwardly to uncover the ventilation apertures 316. Alternatively, the forward section 314*b* of the outer sleeve is permanently fixed to the sleeve 313. The rearward section 314*a* is rotatable and slidable rearwardly to uncover the ventilation apertures 316. Alternatively, both the forward section 314*b* and rearward section 314*a* are slidable around the sleeve 313.

FIGS. 61*a* to 61*d* show the smoking article 310 in four states in the transition from a minimum ventilation state to a maximum ventilation state. FIG. 61*a* shows the smoking article 310 in a minimum ventilation state. The two parts 314*a*,314*b* of the outer sleeve 314 are abutting around the whole circumference. The ventilation apertures 316 are completely covered.

FIG. 61*b* shows a small rotation of the forward section 314*a* relative to the stationary rearward section 314*b*. The forward section 314*a* and rearward section 314*b* still abut, and uncover a portion of the sleeve 313.

FIG. 61*c* shows a further rotation of the forward section 314*a*, which by a cam action is driven forwardly. The ventilation apertures 316 are partially uncovered.

FIG. 61*d* shows the maximum ventilation state of the smoking article 310. The forward section 314*b* has been moved forwardly to its maximum extent, uncovering all of the ventilation apertures 316. The forward section 314*b* is in contact with the rearward section 314*a* at a single point opposite to the ventilation apertures 316. Further relative rotation will not actuate further movement of the forward section 314*b*.

The line 318 has been described as frangible. Alternatively, the outer sleeve 314 may be initially formed as two separate parts 314*a*,314*b*.

The smoking article has been described as extendable and having a variable length chamber. The sleeve may slide around the tobacco unit substantially as described with respect to FIGS. 6 to 7*d* or FIGS. 32*a* to 33. The smoking article may comprise a restraining means having engaging surfaces to limit longitudinal sliding of the sleeve 313 with respect to the tobacco unit. The restraining means may be as described in any embodiment, for example, the embodiment described with respect to FIGS. 6 to 7*d*. Alternatively, the smoking article 310 may not be extendable, and the ventilation apertures may open onto a fixed length chamber or into the tobacco unit or filter to vary ventilation.

The ventilation apertures 316 may allow air into the second filter, into the chamber when the smoking article is fully or partially extended, or into the tobacco unit if the ventilation apertures 316 are aligned with ventilation apertures (not shown) in the tobacco rod and/or filter of the tobacco unit. Alternatively, the tobacco unit may have an air impermeable exterior surface (without ventilation apertures) which prevents flow of air into the smoking article when the tobacco unit underlies the ventilation apertures 316.

The forward section 314*b* has been described as determining ventilation by longitudinal position and/or rotation. The forward section 314*b* may determine the ventilation by rotation only. In particular, an edge of the forward section 314*b* may extend at an angle to a circumferential line. The smoking article may or may not comprise a rearward section, which if present, may have an abutting edge which extends circumferentially. Rotation only of the forward section 314*b* is configured to selectively cover or uncover underlying ventilation apertures.

Preferably, the forward section 314*b* is freely rotatable slidable longitudinally around the sleeve 313. Alternatively, the forward section 314*b* may be engaged with the sleeve 313 by a thread, providing for relative longitudinal movement of the forward section 314*b* when rotated. The sleeve 313 or forward section 314*b* may be provided with a helical guiding means, in the form of helical ribs or grooves, configured to engage with a helical guiding means, in the form of helical ribs or grooves, or other protrusion or recess on the other of the sleeve 313 and forward section 314*b*. The threaded surfaces may be formed as described with respect to FIG. 50. Rotation of the forward section 314*b* in a first direction drives the section 314*b* forwardly, and rotation in an opposite, second direction, drives the section 314*b* rearwardly. The movable section 314*b* selectively covers the ventilation apertures depending on its rotational position and longitudinal position when the relevant edge (connecting line 318) is oblique, i.e. angled to a circumferential direction. Alternatively, the edge may extend substantially circumferentially, and covering of the ventilation apertures achieved by longitudinal movement only. In this case, rotation of the forward section 314*b* is independent of the rearward section 314*a*.

FIG. 62 shows a twenty-first embodiment of ventilation system in a smoking article 320. Smoking article 320 comprises a variable length chamber, substantially as described in any of the embodiments above. The smoking article 320 comprises a tobacco unit 321, which may comprise a tobacco rod and first filter as described with respect to FIG. 1 to 3 or 5, or only a tobacco rod, or e.g. as described with respect to FIG. 4. A first part comprising the tobacco unit 321 is moveable relative to a second part of the smoking article comprising a sleeve 323. The variable length chamber is defined between the tobacco unit 321 and a second filter or stain-binder. The tobacco unit 321 has a rearward end, which is surrounded by the sleeve 323. The second filter or stain-binder will be referred to as the second filter.

The sleeve 323 is provided with one or more ventilation apertures 326 adjacent to a forward end. Preferably, the sleeve 323 comprises a plurality of ventilation apertures 326. The ventilation apertures 326 are dispersed over an area of the sleeve 323 extending longitudinally and circumferentially. The ventilation apertures 326 are dispersed in an irregular pattern over the sleeve 323, and are not arranged in a line or grid.

The ventilation apertures 326 are individually marked, preferably by a printed colour on the sleeve 323. The ventilation apertures 326 are relatively small in diameter, and so may be difficult for a user to see without the printed colours. The printed colours may be in the form of a solid square of colour containing one ventilation aperture 326.

The tobacco rod and/or the filter of the tobacco unit 321 covers the ventilation apertures 326 when the smoking article is retracted and lies underneath the ventilation apertures 326. The ventilation apertures 326 are uncovered when a rearward end of the tobacco unit 321 extends beyond the ventilation apertures 326, enabling ventilation into the chamber within the sleeve 323. The ventilation apertures 326 are spread over a longitudinally extending area, and so increasing the extension of the smoking article 320 increases the number of uncovered ventilation apertures 326, and increases ventilation.

FIGS. 63*a* and 63*b* show a twenty-second embodiment of ventilation system in a smoking article 330. Smoking article 330 comprises a variable length chamber, substantially as described in any of the embodiments above. The smoking article 330 comprises a tobacco unit 331, which may comprise a tobacco rod and first filter as described with respect to FIG. 1 to 3 or 5, or only a tobacco rod, or e.g. as described with respect to FIG. 4. A first part comprising the tobacco unit 331 is moveable relative to a second part of the smoking article comprising a sleeve 333. The variable length chamber is defined between the tobacco unit 331 and a second filter or stain-binder. The tobacco unit 331 has a rearward end, which is surrounded by the sleeve 333. The second filter or stain-binder will be referred to as second filter.

FIG. 63*a* shows the sleeve 333 is provided with one or more flavourant pods 338 containing a source of flavouring. The source of flavouring may be mint flavouring, or any other type of flavouring. Preferably, the sleeve 333 comprises a plurality of flavourant pods 338 on an exterior surface. The flavourant pods 338 are dispersed over an area of the sleeve 333 extending longitudinally and circumferentially. The flavourant pods 338 are dispersed in an irregular pattern over the sleeve 333, and are not arranged in a line or grid. The flavourant pods 338 are frangible and are configured to break open and/or break apart and release the source of flavouring when rubbed by a user. The flavourant pods 338 may alternatively release the source of flavouring when an external part of the pod is removed. The flavourant is provided at the ventilation apertures.

Referring to FIG. 63*b*, at least some of the flavourant pods 338 cover one or more ventilation apertures 336. Preferably, each flavourant pod 338 covers a single ventilation aperture 336. Thus, the ventilation apertures 336 are arranged in the same pattern as the flavourant pods 338, i.e. dispersed over an area of the sleeve 333 extending longitudinally and circumferentially. The ventilation apertures 336 are dispersed in an irregular pattern over the sleeve 333, and are not arranged in a line or grid.

The flavourant pods 338 prevent ingress of air through the ventilation apertures 336 when the flavourant pods 338 are intact. The flavourant pods 338 allow ingress of air through the ventilation apertures 336 when the flavourant pods 338 are broken open and the source of flavouring released.

The tobacco unit 331 covers the ventilation apertures 336 when the smoking article is retracted and lies underneath the ventilation apertures 336. The ventilation apertures 336 are uncovered when a rearward end of the tobacco unit 331 extends beyond the ventilation apertures 336. The ventilation apertures 336 are spread over a longitudinally extending area, and so increasing the extension of the smoking article 330 increases the number of uncovered ventilation apertures 336, and increases ventilation.

The ventilation and flavouring of the smoking article 330 are selected together, by selecting the number of flavourant pods 338 which are opened. The extension of the smoking article 330 also determines ventilation when at least some of the flavourant pods 338 are broken and the ventilation apertures 336 are uncovered.

The smoking article has been described as extendable and having a variable length chamber. Alternatively, the smoking article 330 may not be extendable, and the ventilation apertures may open onto a fixed length chamber or into the tobacco unit or filter to vary ventilation.

The flavourant pods 338 are preferably broken by a user. Alternatively, the flavourant pods may be broken open by movement of the tobacco unit within the sleeve 333. The flavourant pods 338 may extend beyond an internal surface of the sleeve 333, and are configured to be broken by engagement with the tobacco unit. In particular, sliding of the tobacco unit within the sleeve may catch or rub against an internally extending part of the flavourant pods to break open or remove an exterior part of the flavourant pod.

FIGS. 64 and 65 show a twenty-third embodiment of ventilation system in a smoking article 340. Smoking article 340 comprises a variable length chamber, substantially as described in any of the embodiments above. The smoking article 340 comprises a tobacco unit 341, which may comprise a tobacco rod and first filter as described with respect to FIG. 1 to 3 or 5, or only a tobacco rod, or e.g. as described with respect to FIG. 4. A first part comprising the tobacco unit 341 is moveable relative to a second part of the smoking article comprising a sleeve 343. The variable length chamber is defined between the tobacco unit 341 and a second filter or stain-binder. The tobacco unit 341 has a rearward end, which is surrounded by the sleeve 343. The second filter or stain-binder will be referred to as the second filter.

FIG. 64 shows the smoking article 340 in a retracted state. The sleeve 343 comprises one or more ventilation flaps 346. Preferably, the sleeve 343 comprises a plurality of ventilation flaps 346 spaced circumferentially and longitudinally over an area on an exterior surface of the sleeve 343. The ventilation flaps 346 are closed, inhibiting ingress of air.

FIG. 65 shows the sleeve 343 with opened ventilation flaps 346. The ventilation flaps 346 are configured to open outwardly. The ventilation flaps 346 may be opened independently of whether the smoking article 340 is retracted or extended.

The ventilation flaps 346 are configured to be hinged open by a user. The user may manually open the ventilation flaps 346 by moving a finger across the ventilation flaps 346. The opened ventilation flaps 346 uncover ventilation apertures 347 through which air can ingress into the chamber or onto the tobacco unit. The ventilation apertures 347 are preferably defined by a porous membrane extending under the ventilation flaps 346. The porous membrane allows air flow into the smoking article when the ventilation flaps 346 are raised and the ventilation apertures 347 uncovered.

The ventilation flaps 346 are attached to the sleeve along a hinge line 348. The ventilation flaps 346 are pivotable about the hinge line 348. The hinge line 348 extends circumferentially at a rearward end of the ventilation flaps 346. The ventilation flaps 346 are formed by a cut 349 in the sleeve 343, which defines the sides of the ventilation flaps 346 apart from the hinge line 348. The ventilation flaps 346 are substantially triangular in outline, and preferably an isosceles triangle having the hinge line 348 as a base.

The ventilation flaps 346 are preferably coated in a low-tack adhesive. The adhesive is coated on an exterior surface of the ventilation flaps 346 to assist in lifting of the ventilation flaps 346. The flaps 346 are preferably lifted by moving a finger across the surface of the sleeve in a rearward direction.

The ventilation flaps 346 allow ventilation into the smoking article 340. The level of ventilation depends on the angle at which the ventilation flaps 346 are opened, which determines the area of the ventilation apertures 347. The angle at which the ventilation flaps 306 are opened is determined by the user.

The ventilation flaps have been described as triangular. Alternatively, the ventilation flaps may have another shape, for example, any polygonal shape such as square, pentagonal, or substantially circular or substantially oval.

The smoking article has been described as extendable and having a variable length chamber. Alternatively, the smoking article 340 may not be extendable, and the ventilation apertures may open onto a fixed length chamber or into the tobacco unit or filter to vary ventilation.

FIGS. 66 and 67 show a twenty-fourth embodiment of ventilation system in a smoking article 350. Smoking article 350 comprises a variable length chamber, substantially as described in any of the embodiments above. The smoking article 350 comprises a tobacco unit 351, which may comprise a tobacco rod and first filter as described with respect to FIG. 1 to 3 or 5, or only a tobacco rod, or e.g. as described with respect to FIG. 4. A first part comprising the tobacco unit 351 is moveable relative to a second part of the smoking article comprising a sleeve 353. The variable length chamber is defined between the tobacco unit 351 and a second filter or stain-binder. The tobacco unit 351 has a rearward end, which is surrounded by the sleeve 353. The second filter or stain-binder will be referred to as second filter.

FIG. 66 shows the smoking article 350 in an extended state. The sleeve 353 may slide around the tobacco unit substantially as described with respect to FIGS. 6*a* to 7*d*. The smoking article may comprise a restraining means having engaging surfaces to limit longitudinal sliding of the sleeve 353 with respect to the tobacco unit. The restraining means may be as described in any embodiment, for example, the embodiment described with respect to FIGS. 12 and 15.

The sleeve 353 comprises one or more strips of material separated from adjacent material by a ventilation slit 356. Preferably, the one or more ventilation slits 356 extend substantially longitudinally. Preferably, the sleeve 353 comprises a plurality of ventilation slits 356 spaced circumferentially on an exterior surface of the sleeve 353. The sleeve 353 defines a rearward grip area 358 which is longitudinally rearward of the ventilation slits 356, and does not comprise any ventilation slits. The sleeve 353 defines a forward grip area 359 which is longitudinally forward of the ventilation slits 356, and does not comprise any ventilation slits. The ventilation slits 356 extend only over a central portion of the sleeve, and do not extend to the areas 358,359 at either end of the sleeve. The rearward and forward grip areas 358, 359 may be marked by symbols, for example, arrows pointing in opposite rotational directions. The ventilation slits 356 extend longitudinally, and strips of sleeve 353 defined by the ventilation slits 356 extend in close proximity to each other. The slits 356 may be straight cuts through the material of the sleeve of negligible width, or may have a pre-determined width when formed. The sleeve 353 allows a minimum ventilation into the smoking article when the slits 356 extend without being twisted.

FIG. 67 shows the sleeve 353 with opened ventilation slits 356. The ventilation slits 356 are opened by a relative rotational movement between a forward end and a rearward end. The twisting of the sleeve 353 increases the separation of the strips of material forming the sleeve. In particular, the width of the ventilation slits 356 is increased by a relative rotational movement between the rearward and forward grip areas 358, 359. One of the rearward and forward grip areas 358, 359 may be rotated whilst the other of the rearward and forward grip areas 358, 359 is held stationary. Alternatively, the rearward and forward grip areas 358, 359 may be twisted in opposite directions. The twisting of the sleeve 353 causes the sleeve to curve radially outwardly around a longitudinal centre of the ventilation slits 356. The enlarged diameter increases a width of the ventilation slits 356, allowing air to flow through the ventilation slits 356. The ventilation slits 356 may be opened independently of whether the smoking article 340 is retracted or extended. The smoking article is configured to vary ventilation according to the relative rotation between a forward part and a rearward part of the sleeve. Preferably, longitudinally extending slits extend between the forward part and a rearward part, whose width is controlled by the relative rotation.

A porous membrane 357 extends underneath the ventilation slits 356. The porous membrane allows air flow into the smoking article 350. The porous membrane may be attached to an interior of the sleeve 353, and may twist with the sleeve 353. The porous membrane may extend over the whole circumference of the sleeve 353. Alternatively, the smoking article may not comprise a porous membrane, and the ventilation slits may provide apertures in an external surface.

The ventilation slits 356 may allow air into the second filter, into the chamber when the smoking article is fully or partially extended, or into the tobacco unit if the ventilation apertures 356 are aligned with ventilation apertures (not shown) in the tobacco unit.

Alternatively, the tobacco unit may have an air impermeable exterior surface (without ventilation apertures) which prevents flow of air into the smoking article when the tobacco unit underlies the ventilation apertures 356.

The smoking article 350 comprises a means configured to retain the sleeve in the twisted configuration allowing increased ventilation. The means may comprise a gripping means arranged between an end of the sleeve and an underlying substrate which is not twisted. In particular, the sleeve 353 having ventilation slits may surround an inner cylindrical tube which is substantially air permeable, and which is rigid to resist twisting when the sleeve 353 is twisted. The gripping means may utilise engaging protrusions and recesses, or may utilise friction between adjacent surfaces e.g. provided by rubber rings. Alternatively, the sleeve 353 may not have a gripping means, and may be formed of a material (e.g. paper) configured to plastically deform and remain in the twisted configuration without external support.

The ventilation slits 356 allow ventilation into the smoking article 350. The level of ventilation depends on the amount by which the ventilation slits 356 are opened, which determines the area of the ventilation slits 356. The amount of relative twisting between a forward and rearward end of the ventilation slits 356 determines the area of the ventilation slits 356.

The smoking article has been described as extendable and having a variable length chamber. Alternatively, the smoking article 350 may not be extendable, and the ventilation apertures may open onto a fixed length chamber or into the tobacco unit or filter to vary ventilation.

FIGS. 68 and 69 show a twenty-fifth embodiment of ventilation system in a smoking article 360. Smoking article 360 comprises a variable length chamber, substantially as described in any of the embodiments above. The smoking article 360 comprises a tobacco unit 361, which may comprise a tobacco rod and first filter as described with respect to FIG. 1 to 3 or 5, or only a tobacco rod, or e.g. as described with respect to FIG. 4. A first part comprising the tobacco unit 361 is moveable relative to a second part of the smoking article comprising a sleeve 363. The variable length chamber is defined between the tobacco unit 361 and a second filter or stain-binder. The tobacco unit 361 has a rearward end, which is surrounded by the sleeve 363. The second filter or stain-binder will be referred to as second filter.

FIG. 68 shows the smoking article 360 in an extended state. The sleeve 363 is slidable longitudinally around a rearward end of the tobacco unit to control the length of the chamber. The sleeve 363 may slide around the tobacco unit substantially as described with respect to FIGS. 32*a* to 33. The smoking article may comprise a restraining means having engaging surfaces to limit longitudinal sliding of the sleeve 363 with respect to the tobacco unit. The restraining means may be as described in any embodiment, for example, the embodiment described with respect to FIGS. 32*a* to 33.

The sleeve 363 is partially surrounded by an outer sleeve 364. The outer sleeve 364 is a cylindrical tube located around the sleeve 363. The outer sleeve 364 is freely rotatable around the sleeve 363. The outer sleeve 364 does not slide longitudinally over the sleeve 363, and may be restrained from sliding longitudinally by a restraining means as described in any other embodiment. The sleeve 363 extends forwardly and rearwardly of the outer sleeve 364. In particular, a rear section 363*a* of the sleeve extends rearwardly of the outer sleeve 364. The rear section 363*a* of the sleeve may be described as a hand dial which can be gripped by a user when turning the outer sleeve. Alternatively, a user may grip a section of the sleeve 363 forwardly of the outer sleeve 364 when turning the outer sleeve.

The outer sleeve 364 is provided with one or more first ventilation apertures 366. Preferably, the outer sleeve 364 comprises a single first ventilation aperture 366 extending longitudinally and circumferentially. Preferably, the first ventilation aperture 366 has a substantially quadrangular, or rectangular, outline. The first ventilation aperture 366 may be styled as a parallelogram as shown.

The sleeve 363 comprises one or more sets of second ventilation apertures 367 alignable with the first ventilation aperture 366. Preferably, the sleeve 363 comprises a plurality of sets of second ventilation apertures 367 spaced circumferentially around the sleeve 363.

The set of second ventilation apertures 367 aligned with the first ventilation aperture 366 is selectable to control the ventilation. Each set of second ventilation apertures 367 comprises a plurality of apertures, preferably in a longitudinally extending line. Each set of second ventilation apertures 367 may define a different ventilation area, preferably by comprising a different number of apertures to another set. Alternatively, the apertures extend longitudinally and circumferentially. Alternatively, one or more sets of second ventilation apertures 367 comprise a single aperture, which may define a different ventilation area to other sets of second ventilation apertures 367.

FIG. 68 shows the smoking article 360 in a high ventilation state. The first ventilation aperture 366 is aligned with a set of second ventilation apertures 367 comprising seven apertures. The first ventilation aperture 366 functions as a viewing window through which the selected set of second ventilation apertures 367 can be seen and identified.

FIG. 69 shows the smoking article in a low ventilation state. The first ventilation aperture 366 is aligned with a set of second ventilation apertures 367 comprising two apertures. The set containing two apertures has a smaller ventilation area than the set containing seven apertures. The high or low ventilation state is selected by relative rotation between the outer sleeve 364 and sleeve 363. In particular, a user may grip and twist the rearward section 363*a* of the sleeve whilst holding the outer sleeve 364 stationary.

The ventilation apertures 366,367 may allow air into the second filter, into the chamber when the smoking article is fully or partially extended, or into the tobacco unit if the ventilation apertures 366,367 are aligned with ventilation apertures (not shown) in the tobacco unit. Alternatively, the tobacco unit may have an air impermeable exterior surface (without ventilation apertures) which prevents flow of air into the smoking article when the tobacco unit underlies the ventilation apertures 366,367.

The smoking article 360 has been described having two sets of second ventilation apertures 367. Alternatively, the smoking article may comprise one or more sets of second ventilation apertures 367 having different ventilation areas. The sleeve 363 may comprise an area without second ventilation apertures which can be selected by the first ventilation aperture 366.

The smoking article has been described as extendable and having a variable length chamber. Alternatively, the smoking article 360 may not be extendable, and the ventilation apertures may open onto a fixed length chamber or into the tobacco unit or filter to vary ventilation.

FIGS. 70 to 71*b* show a twenty-sixth embodiment of ventilation system in a smoking article 370. Smoking article 370 comprises a variable length chamber, substantially as described in any of the embodiments above. The smoking article 370 comprises a tobacco unit 371, which may comprise a tobacco rod and first filter 372 as described with respect to FIG. 1 to 3 or 5, or only a tobacco rod, or e.g. as described with respect to FIG. 4. A first part comprising the tobacco unit 371 is moveable relative to a second part of the smoking article comprising a sleeve 373. The variable length chamber is defined between the tobacco unit 371 and a second filter 374. The tobacco unit 371 has a rearward end, which is surrounded by the sleeve 373. The second filter or stain-binder will be referred to as second filter 374.

FIG. 70 shows the smoking article 370 in a retracted state. The sleeve 373 is provided with one or more ventilation apertures 376. Preferably, the sleeve 373 comprises a plurality of ventilation apertures 376 spaced longitudinally. The smoking article 370 further comprises a button 378 which can be depressed to select a different ventilation state of the smoking article.

FIG. 71 a shows a rearward end of the sleeve 373. The sleeve 373 comprises a chamber 375 between the first filter 372 and the second filter 374. The second filter 374 forms a rear end of the sleeve 373. The ventilation apertures 376 extend over a part only of the length of the chamber 375.

A plug 377 is movable longitudinally within the chamber 375. The plug 377 has a cylindrical outer surface fitting tightly against an interior surface of the sleeve 373. The plug 377 is moveable between a first position covering the ventilation apertures 376 and a second position spaced from the ventilation apertures 376 and allowing ingress of air into the ventilation chamber 375.

A connecting element extends outside of the chamber for controlling the position of the plug 377. The connecting element is preferably a rigid rod 378. The plug 377 is integrally formed with the rod 378. The rod 378 extends longitudinally through a bore 379 in a rearward stop formed by the filter 374 or other substrate, and rearwardly of the sleeve 373. The rearward end of the rod 378 functions as a button to control movement of the plug 377. The rod 378 does not inhibit air from entering the ventilation apertures 376, preferably, since the rod has a smaller diameter than the plug 377.

FIG. 71*a* shows the plug 377 in the first position covering the ventilation apertures 376. The rod 378 extends rearwardly of the sleeve 373. The plug 377 inhibits air flow through the ventilation apertures 376, and the smoking article 370 is in a low ventilation state.

FIG. 71*b* shows the smoking article 370 in a high ventilation state. The rod 378 has been pushed forwardly until a rear end of the rod 378 is flush with the rear end of the sleeve 373. The plug 377 has been driven forwardly by the rod 378 until the rear end of the rod 378 is flush with the sleeve 373, or when the smoking article is only extended by a small amount, the plug 377 will be in contact with, or adjacent to, the first filter 372. The plug 377 is longitudinally spaced from the ventilation apertures 376, and so air can flow through the ventilation apertures 376. The rod 378 may be pushed partially forward, providing a partial uncovering of the ventilation apertures 376 and an intermediate ventilation state.

The filter 372 has been described as attached to the tobacco rod. Alternatively, the filter 372 may instead be attached to the sleeve.

The ventilation apertures 376 have been described as located to be covered by the plug when the rod extends rearwardly, and not covered when the rod is pushed forwardly. Alternatively, the ventilation apertures 376 may be located over a forward section of the ventilation chamber 375. The plug 377 will not cover the ventilation apertures 376 when in a rearward position, and will cover the ventilation apertures 376 when moved forwardly. Alternatively, the ventilation apertures 376 may extend over only a longitudinally central area of the ventilation chamber 375, and/or may vary in area in a longitudinal direction.

The connecting element has been described as a rigid rod. Alternatively, the connecting element may be a flexible element, for example, a length of string providing for movement in one direction. The plug may slide freely under gravity in the opposite direction.

The smoking article has been described as extendable and having a variable length chamber. Alternatively, the smoking article 370 may not be extendable, and the ventilation apertures may open onto a fixed length chamber to vary ventilation.

FIGS. 72 to 74 show a twenty-seventh embodiment of ventilation system in a smoking article 380. Smoking article 380 comprises a variable length chamber, substantially as described in any of the embodiments above. The smoking article 380 comprises a tobacco unit 381, which may comprise a tobacco rod and first filter as described with respect to FIG. 1 to 3 or 5, or only a tobacco rod, or e.g. as described with respect to FIG. 4. A first part comprising the tobacco unit 381 is moveable relative to a second part of the smoking article comprising a sleeve 383. The variable length chamber is defined between the tobacco unit 381 and a second filter or stain-binder. The tobacco unit 381 has a rearward end, which is surrounded by the sleeve 143. The second filter or stain-binder will be referred to as second filter.

The tobacco unit 381 comprises one or more ventilation apertures 386 adjacent to a rearward end. Preferably, the tobacco unit 381 comprises a plurality of ventilation apertures 386 arranged in an array extending circumferentially and longitudinally. The ventilation apertures 386 preferably overlie the source of smokable material.

FIG. 72 shows the smoking article in an extended state. The ventilation apertures 386 are located longitudinally beyond a forward end of the sleeve 383, allowing ventilation of the smoking article through ventilation apertures 386.

The sleeve 383 comprises an indicator for indicating the ventilation of the smoking article 383. The indicator shows the extension of the tobacco unit 381 within the sleeve 383, which determines the number of ventilation apertures 386 beyond the sleeve 383 and uncovered to allow ingress of air.

The indicator comprises a window 387 in the sleeve 383. The window 387 is preferably a transparent material, which preferably has a series of marks 389 at longitudinal intervals. The window adds structural rigidity to the sleeve 383. The window 387 allows viewing of an indicator line on the tobacco unit 381. Preferably, the indicator line is formed by a rear end 382*a* of a filter 382. The filter 382 is a first colour, for example black, which is visible through the window 387. An interior surface of the sleeve 383 is a second colour, different to the first colour. The window 387 allows viewing of two areas separated by the indicator line 382*a*, the relative sizes of the areas and/or position of the indicator line 382*a* relative to the marks 389 indicates the ventilation.

FIG. 73 shows the smoking article 380 in a partially extended state. Approximately half of the ventilation apertures 386 are covered by the surrounding impermeable sleeve 383, allowing a selected amount of air into the smoking article.

FIG. 74 shows an enlarged view of the tobacco unit 381 with ventilation apertures 386. The ventilation apertures 386 may be formed as short circumferentially extending slits. The ventilation apertures 386 are spaced apart from each other over an area which extends circumferentially and longitudinally. The ventilation apertures 386 may be arranged in concentric rows, with ventilation apertures 386 of alternating rows aligned circumferentially.

FIGS. 75 to 76*c* show a twenty-eighth embodiment of flow system in a smoking article 390. The smoking article 390 comprises a gaseous flow system configured to control gaseous flow through the smoking article. Smoking article 390 comprises a variable length chamber, substantially as described in any of the embodiments above. The smoking article 390 comprises a tobacco unit 391, which may comprise a tobacco rod and first filter as described with respect to FIG. 1 to 3 or 5, or only a tobacco rod, or e.g. as described with respect to FIG. 4. A first part comprising the tobacco unit 391 is moveable relative to a second part of the smoking article comprising a sleeve 393, and preferably slidable longitudinally relative to the second part. The variable length chamber is defined between the tobacco unit 391 and a second filter. The tobacco unit 391 has a rearward end, which is surrounded by the sleeve 393. The second filter or stain-binder will be referred to as the second filter.

FIG. 75 shows a cut-away view through the sleeve 393 of the smoking article 390. The sleeve 393 may slide around the tobacco unit substantially as described with respect to FIGS. 32*a* to 33. The smoking article may comprise a restraining means having engaging surfaces to limit longitudinal sliding of the sleeve 393 with respect to the tobacco unit. The restraining means may be as described in any embodiment, for example, the embodiment described with respect to FIGS. 32*a* to 33.

The sleeve 393 comprises a chamber 395 between the tobacco unit 391 and the second filter 394. A valve 397 is located in the chamber 395, and configured to control gaseous flow through the smoking article 390. The valve 397 is in the form of a plug having a cylindrical outer surface fitting tightly against an interior surface of the sleeve 393. The valve 397 is fixed in position within the sleeve 393. The valve 397 may be connected to the sleeve 393 to fix the valve in position e.g. by an adhesive on the cylindrical outer surface of the valve 397. The valve 397 is preferably formed from a filtration material, e.g. cellulose acetate.

The valve 397 has a deformable bore for controlling gaseous flow. The bore allows gaseous flow though the valve, and deformation of the bore controls the effective area of the bore and hence controls the gaseous flow. In particular, the valve 397 comprises a deformable cylindrical tube having a central bore 399. The valve 397 is plastically deformable, such that an exterior surface and surface of the bore 399 remain in a deformed state when pressure is applied. The amount of gaseous flow through the bore 399 is controlled by the valve 397. The material of the valve 397 preferably acts a filtration material. The area of the bore 399 in a plane perpendicular to the longitudinal axis of the smoking article determines the amount of gaseous flow which can bypass the filtration material of the valve 397.

The smoking article is preferably ventilated to allow air to ingress into the smoking article 390. The ventilation may be provided by ventilation apertures (not shown) in a part of the sleeve aligned with the chamber 395, i.e. upstream of the valve 397. Alternatively or in addition, ventilation apertures are provided at other locations upstream, i.e. forwardly, of the valve 397, e.g. overlying the tobacco rod and/or filter of the tobacco unit. Alternatively or in addition, ventilation apertures are located rearwardly of the valve and configured to allow ingress of air downstream of the valve. Alternatively or in addition, ventilation apertures may overlie the valve 397.

The ventilation apertures in the sleeve may allow air into the chamber when the smoking article is fully or partially extended, or into the tobacco unit if the ventilation apertures are aligned with ventilation apertures (not shown) in the tobacco unit. Alternatively, the tobacco unit may have an air impermeable exterior surface (without ventilation apertures) which prevents flow of air into the smoking article when the tobacco unit underlies the ventilation apertures. The ventilation apertures in the first or second parts may be permanently uncovered and open, or may be selectively covered by an air impermeable area of the other of the first or second parts. The description below refers to the ventilation apertures when uncovered.

The ventilation provided by the ventilation apertures may be dependent or independent on the gaseous flow allowed by the valve 397, according to the longitudinal position of the ventilation apertures. For ventilation apertures which have a longitudinal position upstream (forwardly) of the valve 397, the amount of ventilation is independent of the gaseous flow allowed by the valve 397, and hence independent of the area of the bore 399. Thus, the ventilation of the smoking article due to such ventilation apertures is not changed when the area of the bore 399 is varied.

For ventilation apertures which have a longitudinal position downstream of the valve 397, the amount of ventilation is dependent, in an inverse proportional relationship, on the gaseous flow allowed through the valve 397. The ventilation of the smoking article due to such ventilation apertures is inversely proportional to the area of the bore 399. Thus, when the bore 399 has a relatively small area, the ventilation due to such ventilation apertures is relatively high. When the bore 399 has a relatively large area, the ventilation due to such ventilation apertures is relatively low. Thus, the smoking article 390 can be configured to vary the gaseous flow within the smoking article and vary the ventilation with the valve 397, or vary the gaseous flow within the smoking article without varying the ventilation.

FIG. 76*a* shows the valve 397 in a first state. The exterior surface of the valve 397 is circular in outline. The bore 399 is substantially elliptical in cross-section and allows an intermediate level of flow therethrough. This first state is the initial state of the valve 397.

FIG. 76*b* shows the valve 397 in a second state. The valve 397 has been compressed by inward lateral forces, such that the exterior surface of the valve 397 forms an elliptical shape around a vertical axis as shown. The bore 399 is a different elliptical shape, being more rounded, and allows a higher level of flow therethrough than the intermediate level.

FIG. 76*c* shows the valve 397 in a third state. The valve 397 has been compressed by inward vertical forces, such that the exterior surface of the valve 397 forms an elliptical shape around a horizontal axis as shown. The bore 399 is a different elliptical shape, being more flattened, and allows a lower level of flow therethrough than the intermediate level.

The sleeve 393 has an exterior surface comprising marks indicating the position of the valve 397, and the directions to compress in order to increase or decrease flow through the valve 397. The marked directions to increase flow through the valve 397 are a pair of diametrically opposite marks corresponding to laterally inward compression as shown in FIG. 76*b*. The marked directions to decrease flow through the valve 397 are a pair of diametrically opposite marks corresponding to vertically inward compression as shown in FIG. 76*c*. The pairs of marks indicate perpendicular radial directions.

The initial shape of the bore 399 as an ellipse in cross-section has the advantage that a higher flow through the valve 397 is provided with deformation in the defined direction, and a lower flow through the valve 397 is provided with deformation in a different defined direction. Alternatively, the bore 399 may be circular in cross-section when an exterior surface of the valve is circular in cross-section. A high flow through the valve 397 is initially provided. A lower flow through the valve 397 may be provided by deformation in any radial direction. A high flow through the valve 397 may be restored by deforming the valve in a direction perpendicular to previously applied, until the exterior surface of the valve 397 is restored to the initial circular cross-section.

The smoking article 390 has been described as extendable, having a variable length chamber. Alternatively, the first part and second part may be rigidly connected such that the smoking article is not extendable. The valve 397 may be located forwardly and/or rearwardly of a fixed length chamber, or may abut against the first filter or tobacco rod, and/or against the second filter.

The smoking article 390 has been described as ventilated to allow ingress of air. Alternatively, the smoking article 390 may not comprise any ventilation apertures to allow ingress of air. The valve 397 controls only gaseous flow through the smoking article. Alternatively, the smoking article may comprise ventilation apertures which are configured to provide a level of ventilation which is independent of the configuration of the valve 397.

The valve 397 has been described as formed of a filtration material. Alternatively, the valve 397 may be formed of any suitable material which is impermeable to gaseous flow, or provides some resistance to gaseous flow. The bore may be an aperture as described, or may be filled with a material providing less resistance to gaseous flow than the surrounding annular valve member.

FIGS. 77 and 78 show a twenty-ninth embodiment of ventilation system in a smoking article 400. Smoking article 400 comprises a variable length chamber 405, substantially as described in any of the embodiments above. The smoking article 400 comprises a tobacco unit 401, which may comprise a tobacco rod and first filter as described with respect to FIG. 1 to 3 or 5, or only a tobacco rod, or e.g. as described with respect to FIG. 4. A first part comprising a tobacco unit 401 is moveable relative to a second part of the smoking article comprising a sleeve 403. The variable length chamber 405 is defined between the tobacco unit 401 and a second filter 404 or stain-binder connected to the sleeve. The tobacco unit 401 has a rearward end, which is surrounded by the sleeve 403. The second filter or stain-binder 404 will be referred to as second filter 404.

The sleeve 403 is slidable longitudinally around the rearward end of the tobacco unit. The sleeve 403 is provided with one or more first ventilation apertures 406 adjacent to a forward end. Preferably, the sleeve 403 comprises a single first ventilation aperture 406 extending longitudinally and circumferentially. The first ventilation aperture extends over only a part of the circumference of the sleeve. Preferably, the first ventilation aperture 406 has a substantially rectangular outline. The tobacco unit 401 comprises one or more second ventilation apertures 407 adjacent to a rearward end. Preferably, the tobacco unit 401 comprises a plurality of second ventilation apertures 407 arranged in a plurality of longitudinally spaced circumferentially extending lines. The second ventilation apertures preferably extend over the whole of the circumference of the tobacco unit. Preferably, the tobacco unit 401 comprises a plurality of second ventilation apertures 407 in an array extending longitudinally and circumferentially. Alternatively, the second ventilation apertures 407 are arranged in a single circumferentially extending line.

FIG. 77 shows the smoking article 400 in a fully extended state. The first and second ventilation apertures 406, 407 are aligned longitudinally, allowing ventilation of the smoking article through ventilation apertures 406, 407.

FIG. 78 shows the smoking article in a partially retracted state. The first and second ventilation apertures 406,407 are not aligned, inhibiting ingress of air into the smoking article.

A restraining means comprising a first and second engaging surfaces 409*a*,409*b* prevents separation of the sleeve 403 from the tobacco unit 401. The first engaging surface extends radially outwardly from the exterior of the tobacco unit, facing forwardly. The first engaging surface has an increased diameter relative to the adjacent tobacco unit, and may formed by one or more sheets of flexible material extending around the first part. A portion of sheet material is folded radially outwardly and back, and defines the first engaging surface 409*a*. The first engaging surface 409*a* is preferably formed on a radially outwardly extending edge of tipping paper, connecting a filter to the tobacco rod, or may be formed by another sheet material wrapped around the tobacco unit, with or without a fold.

The second engaging surface is formed between the forward and rearward ends of the sleeve, and extends inside of the cylindrical sleeve forming an exterior surface of the sleeve. The second engaging surface 409*b* is therefore formed within an exterior surface of the second part. The second engaging surface 409*b* is provided on an inwardly folded section of the sleeve, preferably a forward end folded inwardly and rearwardly. In this embodiment, the restraining means provides for a maximum extension which is independent of relative rotational position.

FIGS. 79 and 80 show a thirtieth embodiment of ventilation system in a smoking article 410. Smoking article 410 comprises a variable length chamber 415, substantially as described in any of the embodiments above. The smoking article 410 comprises a tobacco unit 411, which preferably comprises a tobacco rod and first filter 412 as described with respect to FIG. 1 to 3 or 5, or only a tobacco rod, or e.g. as described with respect to FIG. 4. A first part comprising a tobacco unit 411 is moveable relative to a second part of the smoking article comprising a sleeve 413. The variable length chamber 415 is defined between the tobacco unit 411 and a second filter 414 or stain-binder connected to the sleeve. The tobacco unit 411 has a rearward end, which is surrounded by the sleeve 413. The second filter or stain-binder 414 will be referred to as second filter 414.

The sleeve 413 is slidable longitudinally around the rearward end of the tobacco unit. The sleeve 413 is provided with one or more first ventilation apertures 416 adjacent to a forward end. Preferably, the sleeve 413 comprises a single first ventilation aperture 416 extending longitudinally and circumferentially. Preferably, the first ventilation aperture 416 has a substantially circular outline. The tobacco unit 411 does not comprise any ventilation apertures adjacent to a rearward end which are alignable with first ventilation aperture 416.

FIG. 79 shows the smoking article 410 in a fully extended state. The sleeve 413 is slidable longitudinally around the tobacco unit 411. The first ventilation aperture 416 is aligned longitudinally with the chamber 415, allowing ventilation of the smoking article through first ventilation aperture 416 and into the chamber 415.

FIG. 80 shows the smoking article 410 in a fully retracted state. The first ventilation aperture 416 is not aligned with the chamber, inhibiting ingress of air into the smoking article. The first ventilation aperture 416 is covered by the tobacco unit, and preferably by the first filter 412, to prevent ventilation.

A restraining means comprising a first and second engaging surfaces prevents separation of the sleeve 413 from the tobacco unit 411. The first engaging surface extends radially outwardly from the exterior of the tobacco unit, facing forwardly. The first engaging surface has an increased diameter relative to the adjacent tobacco unit, and may formed by one or more sheets of flexible material extending around the first part. A portion of sheet material is folded radially outwardly and back, and defines the first engaging surface. The first engaging surface is preferably formed on a radially outwardly extending edge of tipping paper, or may be formed by another sheet material wrapped around the tobacco unit, with or without a fold.

The second engaging surface is formed between the forward and rearward ends of the sleeve, and extends inside of the cylindrical sleeve forming an exterior surface of the sleeve. The second engaging surface is therefore formed within an exterior surface of the second part. The second engaging surface is provided on an inwardly folded section of the sleeve, preferably a forward end folded inwardly and rearwardly. In this embodiment, the restraining means provides for a maximum extension which is independent of relative rotational position.

The smoking article 410 further comprises an outer raised section 418. The outer raised section 418 preferably comprises a sheet of flexible material, preferably paper, wrapped one or more times around a forward portion of the tobacco unit. The raised section 418 has an outer surface which has substantially the same diameter as an outer surface of the sleeve 413. The raised section 418 and sleeve 413 are flush when the smoking article 410 is in a retracted position. The exterior surface of the smoking article 418 is therefore continuous, or smooth, in the retracted state. In the extended state, the raised section 418 and sleeve 413 are separated by a region of smaller diameter, corresponding to an external surface of the tobacco unit within the raised section 418, and preferably the first filter 412.

The smoking article 410 has been described as having one or more ventilation apertures 416 allowing ingress of air into the chamber 415 only. Alternatively, the smoking article 410 may have one or more additional ventilation apertures (not shown) in an exterior surface of the tobacco unit, allowing ingress of air into the tobacco unit rearwardly of the raised section 418. The additional ventilation apertures may allow ingress of air into the first filter 412 and/or tobacco rod when the smoking article is at least partially extended, and the additional ventilation apertures are located forwardly beyond the sleeve.

FIG. 81 shows a thirty-first embodiment of ventilation system in a smoking article 430. Smoking article 430 comprises a first part moveable longitudinally relative to a second part to control the ventilation. The smoking article 430 comprises a first part comprising a tobacco unit 431, which may comprise a tobacco rod and first filter 432 as described with respect to FIG. 1 to 3 or 5, or only a tobacco rod, or e.g. as described with respect to FIG. 4. The tobacco unit 431 is moveable relative to a second part of the smoking article comprising a sleeve 433. The sleeve 433 is a hollow cylindrical tube, and smoking article 430 does not have a separate second filter or stain-binder attached to the sleeve 433. The first filter 432 attached to the tobacco rod may have a length substantially equal to the combined length of the first and second filters described in other embodiments. The tobacco unit 431 has a rearward end, which is surrounded by the sleeve 433.

The sleeve 433 is slidable longitudinally around the rearward end of the tobacco unit. The tobacco unit 431 comprises one or more ventilation apertures 437 adjacent to a rearward end. Preferably, the tobacco unit 431 comprises a plurality of ventilation apertures 437 arranged in a single circumferentially extending line. The ventilation apertures 437 may overlie a first filter attached to the tobacco rod, or overlie the source of smokable material.

FIG. 81 shows the smoking article 430 in a fully extended state. The ventilation apertures 437 are located longitudinally beyond a forward end of the sleeve 433, allowing ventilation of the smoking article through ventilation apertures 437. The sleeve 433 is moveable forwardly into a retracted state, in which the sleeve 433 covers the ventilation apertures 437 and inhibits ventilation through the ventilation apertures 437.

The smoking article 430 includes a restraining means comprising a first and second engaging surfaces 439*a*,439*b* to prevent separation of the sleeve 433 from the tobacco unit 431. The restraining means is substantially as described with respect to FIGS. 12 to 15 or 32*a* to 33. The first engaging surface 439*a* is preferably formed on a sheet material wrapped around the tobacco unit. The first engaging surface extends radially outwardly from the exterior of the tobacco unit, facing forwardly. The first engaging surface 439*a* has an increased diameter relative to the adjacent tobacco unit, and may formed by one or more sheets of flexible material extending around the first part. Alternatively, a portion of sheet material is folded radially outwardly and back, and defines the first engaging surface.

The second engaging surface 439*b* is formed between the forward and rearward ends of the sleeve, and extends inside of the cylindrical sleeve forming an exterior surface of the sleeve. The second engaging surface is therefore formed within an exterior surface of the second part. The second engaging surface is provided on an inwardly folded section of the sleeve, preferably a forward end folded inwardly and rearwardly. In this embodiment, the restraining means provides for a maximum extension which is independent of relative rotational position.

The smoking article 430 further comprises an outer raised section 438. The outer raised section 438 preferably comprises a sheet of flexible material, preferably paper, wrapped one or more times around a forward portion of the tobacco unit. The raised section 438 has an outer surface which has substantially the same diameter as an outer surface of the sleeve 433. The raised section 438 and sleeve 433 are flush and abutting when the smoking article 430 is in a retracted position. A forward movement of the sleeve 433 is limited by abutting against the raised section 438. The exterior surface of the smoking article 438 is therefore continuous, or smooth, in the retracted state. In the extended state, the raised section 438 and sleeve 433 are separated by a region of smaller diameter, corresponding to an external surface of the tobacco unit within the raised section 438, and preferably the first filter 432.

FIGS. 82 and 83 show a thirty-second embodiment of ventilation system in a smoking article 440. Smoking article 440 comprises a first part moveable longitudinally relative to a second part to control the ventilation. The smoking article 440 comprises a first part comprising a tobacco unit 441, which may comprise a tobacco rod and first filter 442 as described with respect to FIG. 1 to 3 or 5, or only a tobacco rod, or e.g. as described with respect to FIG. 4. The tobacco unit 441 is moveable relative to a second part of the smoking article comprising a sleeve 443. The smoking article 440 does not have a separate second filter or stain-binder attached to the sleeve 443. Instead the first filter 442 attached to the tobacco rod may have a length substantially equal to the combined length of the first and second filters described in other embodiments. The tobacco unit 441 has a rearward end, which is surrounded by the sleeve 443.

The sleeve 443 is slidable longitudinally around the rearward end of the tobacco unit. The sleeve 443 is provided with one or more first ventilation apertures 446 adjacent to a forward end. Preferably, the sleeve 443 comprises a plurality of first ventilation apertures 446 arranged in an array having a plurality of longitudinally spaced circumferentially extending lines. Each first ventilation aperture 446 preferably has a substantially circular shape. The tobacco unit 441 comprises one or more second ventilation apertures 447 adjacent to a rearward end. Preferably, the tobacco unit 441 comprises a plurality of second ventilation apertures 447 arranged in an array having a plurality of longitudinally spaced circumferentially extending lines. Each second ventilation aperture 447 preferably has a substantially circular shape, or may have any shape. The second ventilation apertures 447 are preferably smaller than the first ventilation apertures 446, and are preferably all substantially identically sized. The first and second ventilation apertures 446, 447 have the same longitudinal spacing. Preferably, the second ventilation apertures 447, and/or optionally the first ventilation apertures 446, extend around the whole circumference of the first or second parts. Preferably, the ventilation is independent of rotation of the sleeve relative to the tobacco unit.

The first ventilation apertures 446 are preferably formed in two or more different sizes. The size of the first ventilation apertures 446 determines the area of second ventilation aperture 447, preferably determined by the number of second ventilation apertures 447, with which the first ventilation apertures 446 can be aligned. At least some of the first ventilation apertures 446 have a size which is preferably larger than a size of the second ventilation apertures 447, such that a plurality of second ventilation apertures 447 can be aligned with a single first ventilation aperture 446. In particular, two second ventilation apertures 447 may be aligned within the perimeter of a single first ventilation aperture 446. At least some of the first ventilation apertures 446 have a size which is the same or slightly larger than a size of the second ventilation apertures 447, such that a single second ventilation aperture 447 may be aligned within the perimeter of a single first ventilation aperture 446. Such smaller first ventilation apertures 446 may be half the diameter of the larger first ventilation apertures 446. Preferably, the second ventilation apertures 447 may be distributed, preferably distributed closely together, such that each of the first ventilation apertures 446 is alignable with the maximum number of second ventilation aperture 447 for its size, i.e. each of the larger first ventilation apertures 446 is aligned with two second ventilation aperture 447, and each of the smaller first ventilation apertures 446 is aligned with one second ventilation aperture 447. Alternatively, all of the first ventilation apertures 446 may be the same size.

FIGS. 82 and 83 show the smoking article 440 in a fully extended state. The first and second ventilation apertures 446, 447 are aligned longitudinally, allowing ventilation of the smoking article through ventilation apertures 446, 447. In particular, each of the circumferentially extending lines of first ventilation apertures 446 is aligned with one of the circumferentially extending lines of second ventilation apertures 447. A rearward end of the sleeve 443 is aligned with a rearward end of the tobacco unit.

In a retracted state, the first and second ventilation apertures 446, 447 are not aligned longitudinally, inhibiting ventilation of the smoking article through ventilation apertures 446, 447. In particular, circumferentially extending lines of first ventilation apertures 446 are located longitudinally between adjacent lines of second ventilation apertures 447. The longitudinal positions of the first ventilation apertures 446 alternate with the longitudinal positions of the second ventilation apertures 447 along the axis of the sleeve. Alternatively, the ventilation apertures may be aligned in the retracted state, and not in the extended state.

Longitudinal movement of the sleeve 443 from the retracted position to the extended position results in each of the lines of first ventilation apertures 446 simultaneously aligning with one of the lines of second ventilation apertures 447. The smoking article 440 provides either a high ventilation state or a low ventilation state. The ventilation is varied with all the first and second apertures at the same time.

A restraining means comprising a first and second engaging surfaces 449*a*,449*b* prevents separation of the sleeve 443 from the tobacco unit 441, substantially as described in respect of FIGS. 40 to 42. The first engaging surface 449*a* is preferably formed on a radially outwardly extending edge of tipping paper, connecting a filter to the tobacco rod, or may be formed by another sheet material wrapped around the tobacco unit. The first engaging surface extends radially outwardly from the exterior of the tobacco unit, facing forwardly. The first engaging surface has an increased diameter relative to the adjacent tobacco unit, and may formed by one or more sheets of flexible material extending around the first part. Alternatively, a portion of sheet material is folded radially outwardly and back, and defines the first engaging surface.

The second engaging surface is formed between the forward and rearward ends of the sleeve, and extends inside of the cylindrical sleeve forming an exterior surface of the sleeve. The second engaging surface is therefore formed within an exterior surface of the second part. The second engaging surface is provided on an inwardly folded section of the sleeve, preferably a forward end folded inwardly and rearwardly. In this embodiment, the restraining means provides for a maximum extension which is independent of relative rotational position.

Alternatively, the sleeve and tobacco unit comprise a plurality of circumferentially spaced first and second ventilation apertures with the same spacing. Relative rotational movement between the sleeve and tobacco unit simultaneously aligns or separates the circumferentially spaced first and second ventilation apertures, in order to vary the ventilation with all the first and second ventilation apertures at the same time.

Alternatively, the smoking article 440 may be configured such that the ventilation is dependent on the rotational position of the sleeve relative to the tobacco unit. The first and second ventilation apertures may extend over only a part of the circumference of the sleeve and tobacco unit respectively. The area of overlap of the first and second ventilation apertures in a circumferential direction, when aligned longitudinally, determines the ventilation. The first and second ventilation apertures may have the dimensions as described above. Alternatively, the areas of the first and/or second ventilation apertures may vary circumferentially. In particular, the first and/or second ventilation apertures may progressively increase in size in a particular longitudinal direction. At least one of the first and second ventilation apertures may extend over only a part of the circumference of the sleeve and tobacco unit respectively. The area of overlap of the first and second ventilation apertures in a circumferential direction depends on the size of the ventilation apertures which are selected to be aligned, which determines the ventilation.

FIGS. 84 and 85 show a thirty-third embodiment of ventilation system in a smoking article 460, substantially as described in any of the embodiments above. The smoking article 460 comprises a tobacco unit 461, which may comprise a tobacco rod and first filter as described with respect to FIG. 1 to 3 or 5, or only a tobacco rod, or e.g. as described with respect to FIG. 4. A first part comprising the tobacco unit 461 is moveable relative to a second part of the smoking article comprising a sleeve 463. The tobacco unit 461 has a rearward end, which is surrounded by the sleeve 463. A second filter is preferably rigidly and co-axially attached to the rear of the first filter, or alternatively the smoking article 460 may comprise only the first filter.

FIG. 84 shows the smoking article 460 in a low ventilation state. The sleeve 463 is a cylindrical tube located around the tobacco unit. The sleeve 463 is formed of two parts, a rearward part 463*a* and a forward part 463*b*. The two parts 463*a*,463*b* are initially connected by a circumferentially extending frangible, or breakable, connection 468. Alternatively, the two parts 463*a*,463*b* of the sleeve may abut, and not be connected.

FIG. 85 shows the smoking article 460 in a high ventilation state. The two parts of the sleeve 463 are separated longitudinally to define a first ventilation aperture 466 therebetween. One or both of the rearward section 463*a* and the forward section 463*b* are slidable longitudinally around the tobacco unit. Preferably, the rearward part 463*a* is fixed in position and the forward part 463*b* is slidable forwardly around the first and/or second filter. The rearward part 463*a* functions as a rearward stop section, limiting rearward movement of the slidable part 463*b*.

The rearward section 463*a* and a forward section 463*b* are separable to uncover one or more second ventilation apertures 467. Preferably, the plurality of second ventilation apertures 467 are arranged in a circumferentially extending line on the tobacco unit, and preferably on a paper wrap around the first filter. The ventilation apertures 467 allow ingress of air into the smoking article 460 when uncovered.

Preferably, the rearward section 463*a* of the outer sleeve is permanently fixed to the first and/or second filter. The forward section 463*b* is slidable forwardly to uncover the ventilation apertures 467. The forward movement of the forward section 463*b* is limited by a forward stop section 469. The stop section 469 is preferably one or more layers of flexible material, preferably paper, surrounding the first filter and/or tobacco rod. The stop section 469 has an exterior surface which is preferably flush with an exterior surface of the forward section 463*b* of the sleeve and the rearward section 463*a* of the sleeve. The stop section 469 is fixed in position relative to the tobacco unit. Alternatively, the forward section 463*b* of the outer sleeve is permanently fixed in position, and the rearward section 463*a* is slidable rearwardly to uncover the ventilation apertures 467. The stop section 469 may be located to limit movement of the rearward section 463*a*. Alternatively, both the forward section 463*b* and rearward section 463*a* are slidable longitudinally.

The forward section 463*b* and rearward section 463*a* of the sleeve have edges facing each other with a profile comprising circumferentially extending lands separated by recesses. The lands of forward section 463*b* and rearward section 463*a* may abut, and may initially be frangibly connected. The forward section 463*b* and rearward section 463*a* may be formed as a single piece, and the frangible connection formed by perforations.

A further embodiment of a smoking article may be configured and function substantially as described with respect to FIGS. 84 and 85. The further embodiment may have a forward section and rearward section of the sleeve having edges facing each other with a continuously undulating, or sinuous, profile. The profiled edges are preferably initially complementary and interlocking. The forward section and rearward section of the sleeve are preferably initially connected by a plurality of discrete frangible connections. The forward section and rearward section may be formed as a single piece, and the frangible connection formed by perforations. The forward section is moveable forwardly to uncover ventilation apertures in the tobacco unit. Movement of the forward section is limited by abutting a forward stop section, and a rearward stop section formed by the rearward section of the sleeve.

FIG. 86 shows a thirty-fourth embodiment of ventilation system in a smoking article 470. Smoking article 470 comprises a variable length chamber 475, substantially as described in any of the embodiments above. The smoking article 470 comprises a tobacco unit 471, which may comprise a tobacco rod and first filter 472 as described with respect to FIG. 1 to 3 or 5, or only a tobacco rod, or e.g. as described with respect to FIG. 4. The tobacco rod 471 is moveable relative to a second part of the smoking article comprising a sleeve 473. The variable length chamber 475 is defined between the tobacco unit 471 and a second filter 474 or stain-binder connected to the sleeve. The tobacco unit 471 has a rearward end surrounded by the sleeve 473. The second filter or stain-binder 474 will be referred to as second filter 474.

The tobacco unit 471 is provided with a plurality of ventilation apertures 477. The ventilation apertures 477 are formed in one or more rows or sets extending around substantially the whole circumference of the tobacco unit 471. Preferably, the tobacco unit 471 comprises a plurality of sets of ventilation apertures, and in particular two sets, namely a forward set 477*a* and a rearward set 477*b*. The sets of ventilation apertures 477*a*,477*b* are longitudinally spaced. Each set 477*a*,477*b* comprises a plurality of discrete apertures extending in a circumferentially extending line.

The forward set 477*a* and rearward set 477*b* of ventilation apertures preferably have different ventilation characteristics, and in particular, different areas. In particular, the apertures of the forward set 477*a* of ventilation apertures are smaller than the apertures of the rearward set 477*b*. In addition, the smoking article 470 may comprise more apertures in the forward set 477*a* than in the rearward set 477*b*. Alternatively, forward set 477*a* and rearward set 477*b* of ventilation apertures may be substantially identical. Alternatively, the forward set 477*a* may comprise apertures which are larger and/or less numerous than the rearward set 477*b*.

FIG. 86 shows the smoking article 470 in a fully extended state. The ventilation apertures 477 are located beyond an end 473*a* of the sleeve 473, allowing ingress of air into the tobacco unit, and in particular into the first filter 472.

The sleeve 473 is movable into a partially extended state, in which the longitudinal extension is less than in the fully extended state, such that the rearward ventilation apertures 477*b* are covered by the overlying sleeve 473. Thus, ventilation of the smoking article is provided through forward ventilation apertures 477*a*, and prevented through rearward ventilation apertures 477*b*.

The sleeve 473 is also slidable into a fully retracted state, in which the forward and rearward ventilation apertures 477*a*,477*b* are covered by the overlying sleeve 473. Thus, ventilation of the smoking article is prevented through the ventilation apertures 477.

The smoking article comprises a restraining means comprising a first and second engaging surfaces 479*a*,479*b* preventing separation of the sleeve 473 from the tobacco unit 471. In this embodiment, the restraining means provides for a maximum extension which is independent of relative rotational position.

The restraining means is substantially as described with respect to FIGS. 77 and 78, and any features described are applicable to this embodiment. The tobacco unit 471 has an outer surface of sheet material at its rearward end. The sheet material maybe tipping paper connecting the first filter 472 to the source of smokable material, or may be an additional sheet of material wrapped around the circumference of the tobacco unit. A portion of sheet material is folded radially outwardly and back, and defines the first engaging surface 479*a*. The sleeve 473 is provided with a section folded radially inwardly and back at its forward end, defining the second engaging surface 479*b*.

FIG. 87 shows a thirty-fifth embodiment of a smoking article 480, which is a variation of the smoking article 470 shown in FIG. 86. The control of ventilation, restraining means and general function is the same as described in FIG. 86, and identical references are used to indicate the corresponding parts.

FIG. 87 shows the smoking article 480 in an extended state. The ventilation apertures 477 are located longitudinally beyond a forward end of the sleeve 473, allowing ventilation of the smoking article through ventilation apertures 477. The smoking article 480 additionally has an indicator for indicating the ventilation of the smoking article 473. The indicator shows the extension of the tobacco unit 471 within the sleeve 473, which determines the number of sets of ventilation apertures 477 beyond the sleeve 473 and uncovered to allow ingress of air.

The indicator comprises one or more windows 486 in the sleeve 473. The windows 486 are preferably apertures in the sleeve or alternatively comprise a transparent material.

Preferably, the windows 486 are three circumferentially spaced apertures. The windows 486 allow viewing of markings on the tobacco unit 471. The tobacco unit 471 comprises a series of coloured areas at different longitudinal positions. The tobacco unit 471 comprises a coloured area for each different ventilation state available, i.e. three states in this example. Alternatively, the tobacco unit may comprise more or fewer longitudinally spaced sets of ventilation apertures providing more or fewer states. The windows 486 allow viewing of one of the coloured areas when the smoking article 480 is in a ventilation state, i.e. none, one or more of the ventilation apertures are not covered by the sleeve 473. The colour of the coloured area visible through windows 486 corresponds to the ventilation state. Alternatively, the tobacco unit 471 may be provided with patterns, symbols, or indicia visible through one or more windows to indicate the ventilation state.

FIGS. 88 and 89 show a thirty-sixth embodiment of ventilation system in a smoking article 500, substantially as described in any of the embodiments above. The smoking article 500 comprises a tobacco unit 501, which may comprise a tobacco rod and first filter 502 as described with respect to FIG. 1 to 3 or 5, or only a tobacco rod, or e.g. as described with respect to FIG. 4. A first part comprising the tobacco unit 501 is moveable relative to a second part of the smoking article comprising a sleeve 503. The tobacco unit 501 has a rearward end, which is surrounded by the sleeve 503. The second filter 504 or stain-binder is connected to the sleeve 503, and will be referred to as second filter 504.

The sleeve 503 is freely rotatable around the tobacco unit. The sleeve 503 is provided with a plurality of first ventilation apertures 506 adjacent to a forward end. Preferably, the first ventilation apertures 506 are arranged in an array extending longitudinally and circumferentially over an area of the sleeve 503. The sleeve 503 preferably comprises one array of first ventilation apertures 506, or may alternatively comprise two arrays on opposite sides of the sleeve 503. The array or arrays extend over only a part of the circumference of the sleeve.

The tobacco unit 501 comprises one or more second ventilation apertures 507 adjacent to a rearward end. Preferably, the tobacco unit 501 comprises a single second ventilation aperture 507. The second ventilation aperture 507 is an aperture in the air impermeable material forming a surface of the surrounding part of the tobacco unit 501. Alternatively, the second ventilation aperture 507 may be covered by an air permeable material. Preferably, the second ventilation aperture 507 extends over the same radial angle as the array of first ventilation apertures.

Relative rotation of the sleeve 503 and tobacco unit 501 varies the overlap between the first and second ventilation apertures 506, 507. The amount of overlap determines the effective ventilation area which is open or uncovered, and so varies ventilation of the smoking article 500.

The smoking article 500 is provided with a ventilation indicator means, for indicating the ventilation state of the smoking article. The ventilation indicator means comprises one or more windows or apertures 511 in the sleeve, and a marked area 512 on the tobacco unit 501. The one or more apertures 511 may comprise a plurality of apertures, preferably three, extending circumferentially in a line around only a part of the circumference. Relative rotation between the tobacco unit 501 and sleeve 503 produces movement of the marked area 512 under the apertures 511, indicating a corresponding ventilation. In particular, the marked area 512 is a different colour to a surrounding area which may be visible through the apertures 511. The visibility of the marked area 512 through none, one, two or all three of the ventilation apertures 511 indicates the ventilation.

FIGS. 88 and 89 show the smoking article 500 in a maximum ventilation state. The first and second ventilation apertures 506,507 are fully aligned. The marked area 512 is aligned with all three of the indicator apertures 511. The ventilation can be varied between the minimum and maximum by controlling the overlap between the first and second ventilation apertures 506,507.

The ventilation of the smoking article 500 is variable by relative rotation, without extending the smoking article. The sleeve 503 is freely rotatable relative to tobacco unit 503, and is prevented from longitudinal movement by a restraining means.

The smoking article 500 comprises a limiting mechanism for limiting relative rotation between the sleeve 503 and tobacco unit 501. The limiting mechanism is preferably substantially as described with respect to FIGS. 43*a* to 46. The limiting mechanism comprises a first stopper (not shown) comprising a raised surface extending from the tobacco unit at a first circumferential position. The limiting mechanism further comprises a second stopper (not shown) comprising a raised surface extending from the tobacco unit at a second circumferential position. The first and second stoppers may each comprise an elongate strip or tongue overlying an outer surface of the tobacco unit, at a rearward end of the tobacco unit. The first and second stoppers protrude in a radially outward direction. The first and second stoppers may each be formed from a section of flexible material, in particular paper, attached to a section wrapped around the circumference of the tobacco unit. The first and second stoppers may be separately formed, or integrally formed, and separated by a cut-out in the flexible material. Alternatively, the first and second stoppers may be formed by folding over a section of flexible material.

The sleeve 503 comprises a protrusion (not shown) configured to engage with the first or second stopper to limit relative rotational movement. The protrusion extends inwardly from the cylindrical tube of the sleeve. The protrusion may be an elongate strip in the form of a tongue extending along an inner surface at a forward end of the sleeve, and protruding in a radially inward direction. The protrusion may be formed from a folded over section of flexible material, in particular paper, forming the sleeve or from a separate layer of material. The fold may be at a forward end of the sleeve. Alternatively, the protrusion may be raised dot, for example, formed by ink or glue. The limiting mechanism may provide index positions for a maximum and minimum ventilation.

The restraining means comprises a first and second engaging surfaces 509*a*,509*b* preventing rearward movement of the sleeve 503 relative to the tobacco unit 501. In this embodiment, the restraining means provides for a maximum extension which is independent of relative rotational position. The restraining means may comprise the folded section of material forming part of the limiting mechanism described with respect to FIGS. 43*a* to 46.

The first engaging surface extends radially outwardly from the exterior of the tobacco unit, facing forwardly. The first engaging surface has an increased diameter relative to the adjacent tobacco unit, and may formed by one or more sheets of flexible material extending around the first part. The tobacco unit 501 has an outer surface of sheet material at its rearward end. The sheet material may be tipping paper connecting the first filter 502 to the source of smokable material, or may be an additional sheet of material wrapped around the circumference of the tobacco unit. A portion of sheet material is folded radially outwardly and back, and defines the first engaging surface 509*a*.

The sleeve 503 is provided with a section folded radially inwardly and back at its forward end, defining the second engaging surface 509*b*. The second engaging surface is formed between the forward and rearward ends of the sleeve, and inside of the cylindrical sleeve forming an exterior surface of the sleeve. The second engaging surface 509*b* is therefore formed within an exterior surface of the second part.

A forward end 510*a* of the sleeve 503 abuts a rearward facing third engaging surface 510*b* formed on a raised section 508. The raised section 508 is preferably one or more layers of flexible material, preferably paper, surrounding the first filter and/or tobacco rod. The raised section 508 has an exterior surface which is preferably flush with an exterior surface of the sleeve 503. The raised section 508 may be formed by folding outwardly and rearwardly a forward end of a sheet of flexible material, preferably paper, surrounding the tobacco unit. The flexible material may be the same piece of material forming the second engaging surface 509*b*, or alternatively, may be a separate piece. The first, second and third engaging surfaces have been described as formed on a folded sheet of flexible material, preferably paper. Alternatively, one or more of the first, second and third engaging surfaces may be formed by a band of material affixed to the first or second part, by embossing, or by any other means to create a raised edge.

The ventilation indicator means has been described as having a plurality of apertures. Alternatively, the ventilation indicator means may comprise a single aperture or slot extending circumferentially on the sleeve. A marked area on the tobacco unit is visible through the aperture to indicate relative rotational position, and so indicate ventilation. The tobacco unit may be provided with a limiting means, comprising a protrusion configured to engage with ends of the slot to limit rotation. Alternatively, the tobacco unit may not comprise such a limiting means. Alternatively, the smoking article may comprise an indexing means, comprising a protrusion on the tobacco unit, e.g. formed by raised ink or glue, engagable with the plurality of apertures 511 to define indexing positions.

FIGS. 90*a* to 91*b* show a thirty-seventh embodiment of flow system in a smoking article 520, substantially as described in any of the embodiments above. The smoking article 520 comprises a gaseous flow system configured to control gaseous flow through the smoking article. The smoking article 520 comprises a tobacco unit 521, which may comprise a tobacco rod and first filter 522 as described with respect to FIG. 1 to 3 or 5, or only a tobacco rod, or e.g. as described with respect to FIG. 4. A first part comprising the tobacco unit 521 is moveable relative to a second part of the smoking article comprising a sleeve 523 and a second filter 524. The tobacco unit 521 has a rearward end, which is surrounded by the sleeve 523. The sleeve 523 and second filter 524 are rotatable as a unit relative to the tobacco unit 521. The first and second parts of the smoking article 520 may comprise one or more longitudinally extending channels, the channels connecting a forward and rearward end of the filters or substrates.

FIGS. 90*a* and 90*b* show the first filter 522 comprising a longitudinally extending channel 526. The channel 526 extends the whole length of the first filter. The channel 526 is a uniform recess in the circumference of the first filter, and the channel is open to a radial exterior surface of the first filter 522. The channel 526 preferably has a planar base surface and straight sides tapering outwardly from the base surface. The filter 522 and channel 526 are preferably covered by a wrap of flexible material. The first filter 522 preferably comprises filtration material, for example cellulose acetate tow, surrounding by a layer of paper plugwrap. The plugwrap forms an exterior surface of the long sides of the substantially cylindrical first filter, including the surfaces of the channel 526.

FIGS. 91*a* and 91*b* show the second filter 524 comprising a longitudinally extending channel 527. The channel 527 extends substantially the whole length of the second filter. The channel 527 is a substantially uniform recess in the circumference of the second filter, and the channel is open to a radial exterior surface of the second filter. The channel 527 preferably has a planar base surface and straight sides tapering outwardly from the base surface. The filter 524 and channel 527 are covered by the tubular sleeve 523. The first and second filters 526,527 are co-axial and adjacent.

The profile of the second filter 524 is seen in FIG. 90*b*, in which the channel 527 is open to the left. The first channel 526 has the same profile as the second channel 527. The second filter 524 preferably comprises filtration material, for example cellulose acetate tow, surrounding by a layer of paper plugwrap. The plugwrap forms an exterior surface of the long sides of the substantially cylindrical second filter, including the surfaces of the channel 526.

Relative rotation of the sleeve 523 and tobacco unit 521 varies the alignment or axial overlap between the first and second channels 526, 527. The gaseous flow within the smoking article is determined by the amount of axial overlap.

The tobacco unit 521 may comprise one or more ventilation apertures. The ventilation apertures (not shown) may be aligned with the first channel 526, and configured to allow air into the first ventilation channel 526. Alternatively or in addition, the ventilation apertures are aligned with the body of the first filter and configured to allow ventilating air into the material of the first filter. Ventilation apertures may alternatively or in addition be provided in the sleeve to allow ventilating air into the first filter and/or first channel, and/or into the second filter and/or second filter. Alternatively or in addition, ventilation apertures may be provided upstream of the first filter, in particular, in the tobacco rod to allow ventilating air into the tobacco rod. Alternatively or in addition, ventilating apertures may be provided downstream of the second filter 524. The ventilation apertures in the first or second parts may be permanently uncovered and open, or may be selectively covered by air impermeable area of the other of the first or second parts or aligned with a ventilation aperture in the other of the first or second parts. The description below refers to the ventilation apertures when uncovered.

The ventilation provided by the ventilation apertures may be dependent or independent on the alignment of the channels 526,527, according to the longitudinal position of the ventilation apertures. For ventilation apertures which have a longitudinal position overlying the first filter 522 (channel or body), or upstream of the first filter e.g. overlying the tobacco rod, the amount of ventilation is independent of the alignment of the channels 526,527. Thus, the ventilation of the smoking article due to such ventilation apertures is not changed when the first part is rotated relative to the second part.

For ventilation apertures which have a longitudinal position overlying the second filter 524 (channel or body), or downstream of the second filter e.g. towards the mouthpiece end of the smoking article, the amount of ventilation is dependent on the alignment of the channels 526,527. The ventilation of the smoking article due to such ventilation apertures is inversely proportional to the overlap of the first and second channels 526,527. Thus, when the first and second channels 526,527 are not aligned, the ventilation due to such ventilation apertures is relatively high. When the first and second channels 526,527 are at least partially aligned, the ventilation due to such ventilation apertures is relatively low. When the first and second channels 526,527 are fully aligned and coincident, the ventilation due to such ventilation apertures is at a minimum. Thus, the smoking article 520 can be configured to vary the gaseous flow within the smoking article and vary the ventilation with the alignment of the channels, or vary the gaseous flow within the smoking article without varying the ventilation.

The smoking article preferably provides for at least some filtration when the first and second channels 526,527 are aligned. Preferably, the second channel 527 does not extend to a rearward end of the second filter. Preferably, the depth of the second channel 527 tapers to zero, adjacent to the rearward end. The second filter 524 provides filtration, independent of the rotational alignment of the channels 526,527. Alternatively, the smoking article 520 may comprise a third filter (not shown), co-axial and rearwardly of the second filter. The third filter does not have a channel, and so provides filtration over the whole cross-section of the smoking article. The second channel may extend to the rearward end of the second filter when the third filter is attached.

The channels 526,527 are described as formed in filters. Alternatively, the channels may be formed in any substrate, for example the tobacco rod and/or a non-filtering material such as an impermeable plug. The first and second parts of the smoking article 520 may comprise one or more longitudinally extending channels, connecting a forward and rearward end of the filters or substrates.

The smoking article 520 comprises a restraining means for preventing longitudinal movement of the sleeve 523 relative to the tobacco unit, whilst allowing free rotational movement. The restraining means is preferably as described with respect to FIGS. 40 to 42. In particular, a first engaging surface formed on a raised section of the tobacco unit is engagable with a second engaging surface within the cylindrical tube of the sleeve, preferably formed by folding the material of the sleeve.

Alternatively, the smoking article 520 is not provided with ventilation apertures. The relative rotational position of the channels 526,527 determines gaseous flow through the smoking article, but does not vary ventilation of air entering the smoking article.

FIGS. 92 and 93 show a thirty-eighth embodiment of ventilation system in a smoking article 530, substantially as described in any of the embodiments above. The smoking article 530 comprises a tobacco unit 531, which may comprise a tobacco rod and first filter 534 as described with respect to FIG. 1 to 3 or 5, or only a tobacco rod, or e.g. as described with respect to FIG. 4. A first part comprising the tobacco unit 531 is moveable relative to a second part of the smoking article comprising a sleeve 533. A second filter 534 is attached to the sleeve 533. The tobacco unit 531 has a rearward end, which is surrounded by the sleeve 533. The second filter 534 or stain-binder will be referred to as second filter 534.

The sleeve 533 is provided with a plurality of first ventilation apertures 536 adjacent to a forward end. Preferably, the first ventilation apertures 536 are arranged in an array extending longitudinally and circumferentially over an area of the sleeve 533. Preferably, the array is arranged as a diagonal grid. The first ventilation apertures 536 are distinct and well-formed apertures, preferably circular, and preferably separated by a diagonal distance approximately equal to their diameter. Alternatively, the array may be a square array, in which the apertures are separated by one to three times their diameter.

The tobacco unit 531 comprises a plurality of second ventilation apertures 537 adjacent to a rearward end. Preferably, the second ventilation apertures 537 are arranged in an array extending longitudinally and circumferentially over an area of the tobacco unit 531. Preferably, the array is arranged as a square array. The second ventilation apertures 537 are apertures in the air impermeable material forming a surface of the surrounding part of the tobacco unit 531. Alternatively, the second ventilation apertures 537 may be covered by an air permeable material. Preferably, the exterior dimensions of the arrays of first ventilation apertures 536 and second ventilation apertures 537 are approximately equal.

Relative rotation of the sleeve 533 and tobacco unit 531 varies the number of the first and second ventilation apertures 536, 537 aligned, i.e. overlapping. The amount of overlap determines the effective ventilation area which is open or uncovered, and so varies ventilation of the smoking article 530. Each of the first and second ventilation apertures 536, 537 are relatively small in size, such that each first ventilation aperture is substantially either aligned or not aligned with a second ventilation aperture.

FIG. 92 shows the smoking article 530 in a partially ventilating state. Two rows of first ventilation apertures 536 are aligned with second ventilation apertures 537, and one row of first ventilation apertures 536 is not aligned with any second ventilation apertures 537.

FIG. 93 shows the smoking article 530 in a maximum ventilation state. All of the first ventilation apertures 536 are aligned with second ventilation apertures 537.

The smoking article 530 may be provided with a ventilation indicator means, for indicating the ventilation state of the smoking article. The tobacco unit 531 may be coloured or marked in an area around the second ventilation apertures 537, to indicate that ventilation is provided by the first ventilation aperture 536 through which that colour or marking is visible.

The second ventilation apertures 537 are arranged to align with a first ventilation aperture 536, when a first ventilation aperture 536 is within the area of the array of the second ventilation apertures 537. The second ventilation apertures 537 comprises more apertures than the first ventilation apertures 536 in the relevant area. The second ventilation apertures 537 have half the longitudinal spacing between a row in a longitudinal direction than the first ventilation apertures 536, and the second ventilation apertures 537 have half the circumferential spacing between a column at a longitudinal point than the first ventilation apertures 536. The number of second ventilation apertures 537 ensures alignment with the diagonal grid of first ventilation apertures 536 at each relative rotational position. Preferably, the second ventilation apertures are arranged to align with all the first ventilation apertures in a selectable circumferential area, i.e. all the first ventilation apertures in a row are aligned with a second ventilation aperture, and the number of aligned rows is selectable to control ventilation. At least one of the second ventilation apertures 537 are not aligned with first ventilation apertures 536 at any orientation of the first and second parts. Therefore, in a maximum ventilation state when all of the first ventilation apertures 536 are aligned with a second ventilation apertures 537, further second ventilation apertures 537 are covered by the sleeve 533.

The smoking article 530 comprises an indexing mechanism, to select one of a plurality of pre-determined rotational positions. The indexing mechanism comprises a plurality of discrete and circumferentially spaced indexing apertures 538 on the sleeve 533. Preferably, the sleeve comprises three indexing apertures 538 to provide three indexed positions. The indexing apertures 538 extend in a circumferential line. The indexing mechanism further comprises a protrusion 539 on the tobacco unit 531. The protrusion 539 extends radially outwardly and engages in one of the indexing apertures 538. The first part and/or the second part is configured to be resiliently deformable such that the protrusion is movable between the indexing apertures. Preferably, the protrusion 539 is formed by ink or glue, in the form of a dot of raised ink or glue.

The protrusion 539 is movable between the three indexing apertures 538, which correspond to three pre-determined positions. In the pre-determined positions, one, two or three rows of first ventilation apertures 536 are aligned with the second ventilation apertures 537. The sleeve 533 may also be rotated such that the protrusion is disengaged with any of the indexing apertures 538, such that none of the first ventilation apertures 536 are aligned with the second ventilation apertures 537. The indexing mechanism also functions as an indicator to indicate the ventilation selected. Alternatively, the indexing mechanism may function only as an indicator, with the protrusion replaced by a marking which does not engage in the apertures 538.

FIGS. 94 and 95 show a thirty-ninth embodiment of ventilation system in a smoking article 540, substantially as described in any of the embodiments above. The smoking article 540 comprises a tobacco unit 541, which may comprise a tobacco rod and first filter 542 as described with respect to FIG. 1 to 3 or 5, or only a tobacco rod, or e.g. as described with respect to FIG. 4. A first part comprising the tobacco unit 541 is moveable relative to a second part of the smoking article comprising a sleeve 543. A second filter may be attached to the sleeve 543, or alternatively, the smoking article 540 may not have a second filter and the sleeve 543 rotates around the first filter 542. The tobacco unit 541 has a rearward end, which is surrounded by the sleeve 543.

The sleeve 543 is provided with a plurality of first ventilation apertures 546 adjacent to a forward end. Preferably, the first ventilation apertures 546 are arranged in an array extending longitudinally and circumferentially over an area of the sleeve 543. Preferably, the array is arranged as a diagonal grid. Alternatively, the array may be a square array.

The tobacco unit 541 comprises a plurality of second ventilation apertures 547 adjacent to a rearward end. Preferably, the second ventilation apertures 547 are arranged in an array extending longitudinally and circumferentially over an area of the tobacco unit 541. Preferably, the array is arranged as a diagonal array. Alternatively, the array may be a square array. The second ventilation apertures 547 are apertures in the air impermeable material forming a surface of the surrounding part of the tobacco unit 541. Alternatively, the second ventilation apertures 547 may be covered by an air permeable material. Preferably, the dimensions and spacings of the arrays of first ventilation apertures 546 and second ventilation apertures 547 are approximately equal.

Relative rotation of the sleeve 543 and tobacco unit 541 varies the overlap of the first and second ventilation apertures 546, 547. The amount of overlap determines the effective ventilation area which is open or uncovered, and so varies ventilation of the smoking article 540. The overlap of the first and second ventilation apertures 546, 547 changes simultaneously for each of the apertures 546,547. Each first ventilation aperture 546 is paired with one second ventilation aperture 547. Rotation of the sleeve 543 controls the alignment of each pair of apertures 546,547 at the same time.

FIG. 94 shows the smoking article 540 in a partially ventilating state. All of the first ventilation apertures 546 are partially aligned with a second ventilation aperture 547.

FIG. 95 shows the smoking article 540 in a minimum ventilating state. None of the first ventilation apertures 546 are aligned with a second ventilation aperture 547.

The smoking article 540 may be provided with a ventilation indicator means, for indicating the ventilation state of the smoking article. The tobacco unit 541 may be coloured or marked in an area around the second ventilation apertures 547, to indicate the amount of ventilation provided through the first ventilation aperture 546 which shows that colour or marking.

The smoking article 540 comprises a further ventilation indicator means, which also limits relative rotation between the sleeve 543 and tobacco unit 541. The ventilation indicator means comprises a circumferentially extending slot 548 in the sleeve, and a marker 549 on the tobacco unit 541. Relative rotation between the tobacco unit 541 and sleeve 543 produces movement of the marker 549 within the slot 548, indicating a corresponding ventilation. The marker 549 may be formed of ink. In particular, the marker 549 may be a protrusion, preferably formed of raised ink or glue The marker 549 may be configured to engage with the ends of the slot 549, preventing further relative rotational movement.

FIGS. 96 and 97 show a fortieth embodiment of ventilation system in a smoking article 560. Smoking article 560 is formed substantially as described in any of the embodiments above. The smoking article 560 comprises a tobacco unit 561, which may comprise a tobacco rod and a first filter 562 as described with respect to FIG. 1 to 3 or 5, or only a tobacco rod, or e.g. as described with respect to FIG. 4. A first part comprising the tobacco unit 561 is moveable relative to a second part of the smoking article comprising a sleeve 563 and a second filter 564. The first part is rotatable relative to the second part. The tobacco unit 561 has a rearward end, which is surrounded by the sleeve 563.

FIG. 96 shows the smoking article 560 in a minimum ventilation state. The first and second filters 562,564 are separate filters attached to and surrounded by a wrap 568 of a sheet of flexible material. Preferably, the wrap 568 is formed of paper, and is preferably formed into a cylinder. The filters 562,564 are attached to the wrap 568 with a longitudinal space between them. The sleeve 563 surrounds the wrap, and is attached to the part of the wrap attached to the second filter 564. The wrap 568 extends around both filters 562, 564 and is twisted in a space between the two co-axial filters 562, 564. The twisting of the wrap 568 controls the longitudinal spacing between the filters 562, 564. In the non-ventilating state, the longitudinal spacing is reduced to a minimum by increasing twisting. Thus, the sleeve 563 is in a forward position, surrounding a maximum area of the first filter 562.

The first filter 562 and surrounding part of the wrap 568 is provided with one or more ventilation apertures 567 adjacent to a rearward end. The ventilation apertures preferably overlie the first filter attached to the tobacco rod, or alternatively overlie the source of smokable material. The ventilation apertures 567 are preferably apertures in the air impermeable wrap 568, and in any air impermeable layer surrounding the filtration material, for example, plugwrap forming the wrap. Alternatively, the wrap 568 and any plugwrap surrounding the filtration material of the first filter 568 is formed of air permeable material, or a material made air permeable with perforations. The ventilation apertures 567 may comprises a plurality of sets of apertures spaced longitudinally, or one or more apertures having a longitudinal extent. Alternatively, the ventilation apertures 567 may extend circumferentially at a single longitudinal position.

FIG. 96 shows the sleeve 563 covering the ventilation apertures when the longitudinal spacing of the filters 562, 564 is a minimum. The sleeve is formed of an air impermeable material and prevents ingress of air into the ventilation apertures. The smoking article 560 has a minimum ventilation in this state.

A forward end of the sleeve 563 abuts a rearward facing surface formed on a raised section 569. The raised section 569 is preferably one or more layers of flexible material, preferably paper, surrounding the first filter and/or tobacco rod. The raised section 569 has an exterior surface which is preferably flush with an exterior surface of the sleeve 563.

FIG. 97 shows the smoking article 560 in a relatively high ventilation state. The sleeve is rotated relative to the non-ventilation state, such that the twisting of the wrap 568 between the filters 562,564 is reduced. The longitudinal spacing is increased to a maximum. Thus, the sleeve 563 is in a rearward position, surrounding a minimum area of the first filter 562. A ventilation aperture 566 is defined between the forward end of the sleeve 563 and a rearward end of the raised section 569. The sleeve 563 does not cover at least some of the ventilation apertures 567 in the first part when the longitudinal spacing of the filters 562,564 is a maximum. The ventilation apertures in the first part are located longitudinally beyond a forward end of the sleeve 563, allowing ventilation of the smoking article through the ventilation apertures 566,567.

The relative rotational position of the sleeve and tobacco unit controls the relative longitudinal position of the sleeve, by controlling the amount of twisting of the wrap 568 between the filters 562,564. The ventilation is continuously variable between a minimum and maximum level by selecting the relative rotational position of the sleeve and tobacco unit.

The wrap 568 has been described as connecting first and second filters 562,564. Alternatively, the wrap 568 may connect a first and second substrate of any material attached to the first and second parts respectively. In particular, smoking article 560 may not include a first filter, and the wrap 568 connects the second filter directly to the source of smokable material. Alternatively, the first and/or second filter may be replaced by an air permeable plug or hollow cylinder, which supports the ends of the wrap during twisting.

The wrap 568 has been described as a paper cylinder. Alternatively, the wrap may be considered a web formed of any shape and material connecting the first and second substrates. In particular, the web may be one or more spaced apart strips or strings of flexible material connecting the substrates. The web may be formed of a plastics material, paper or any other material. The web may be rigid and pivotally attached to the first and second substrates.

FIGS. 98 and 99 show a forty-first embodiment of ventilation system in a smoking article 570. Smoking article 570 is formed substantially as described in any of the embodiments above. The smoking article 570 comprises a tobacco unit 571, which may comprise a tobacco rod and a first filter 572 as described with respect to FIG. 1 to 3 or 5, or only a tobacco rod, or e.g. as described with respect to FIG. 4. A first part comprising the tobacco unit 571 is moveable relative to a second part of the smoking article comprising a sleeve 573 attached to a second filter 574. The smoking article 570 does not comprise a chamber between the tobacco unit 571 and the second filter 574. The sleeve 573 is rotatable relative to the tobacco unit 571, and the sleeve 573 is substantially not movable longitudinally relative to the tobacco unit 571. The tobacco unit 571 has a rearward end, which is surrounded by the sleeve 573.

FIG. 98 shows the smoking article 570 in a non-ventilating state. The first and second filters 572,574 are sections of an integral single filter. The first filter 572 is partially separated from the second filter 574 by a lateral cut 575. The cut 575 extends over a radially outer part of the first and second filters 572,574. A radially inner core 575*a*, which is not cut, connects the first and second filters 572,574. The first filter 572 can twist relative to the second filter 574 around the central core 575*a*, without the core breaking. The central core maintains a connection between the sleeve and tobacco unit, retaining the first and second parts of the smoking article together. The filter may comprise conventional filtration material, e.g. cellulose acetate tow.

The sleeve is provided with one or more first ventilation apertures 576 at one or more circumferential positions. The first ventilation aperture extends circumferentially over only a part of the circumference, and preferably, is formed by a slit having a small longitudinal extent. The tobacco unit is provided with one or more second ventilation apertures 577 at one or more circumferential positions. The second ventilation aperture may extend circumferentially over only a part of the circumference, and preferably, is formed by a slit having a small longitudinal extent. The first and second ventilation apertures are at the same longitudinal position. The circumferential lengths of the ventilation apertures may be equal to the range of rotational movement, such that the ventilation apertures are movable between a fully aligned position, and a non-aligned position in which the ventilation apertures are circumferentially adjacent but not aligned.

In the non-ventilating state, the first and second ventilation apertures 576,577 are not aligned, and are separated circumferentially. In a ventilating state shown in FIG. 99, the first and second ventilation apertures 576,577 are aligned (although shown slightly separated for clarity). The state of ventilation is selected by relative rotation of the sleeve and tobacco unit. The first and second filters 572,574 twist relative to each other as required to select an overlap or alignment of the first and second ventilation apertures. Alternatively, the first and second ventilation apertures may extend longitudinally at a single circumferential position, or extend both longitudinally and circumferentially.

FIGS. 98 and 99 show the smoking article 570 comprises an indexing mechanism, to select one of a plurality of pre-determined rotations. The indexing mechanism also functions as a limiting mechanism to limit relative rotational movement to a pre-determined range. The indexing mechanism comprises a profiled slot 578 on the sleeve 573. The slot 578 extends circumferentially and has a plurality of enlarged sections, which define indexing apertures or positions of relatively high width. The enlarged sections are separated by one or more sections of lower width defining constrictions. The indexing apertures are connected by the slot 578. Alternatively The slot 578 has two positions 578*a*,578*b* of increased width separated by a central narrowed section. The indexing mechanism further comprises a protrusion 579 on the tobacco unit 571. The protrusion 579 extends radially outwardly and engages in the slot 578. Preferably, the protrusion 579 is formed by ink or glue, in the form of raised ink or glue.

The increased width of the slot at the indexing apertures 578*a*,578*b* are rearwardly of the intermediate connecting slot. The position 578*a* may be located to receive the protrusion 579 when the filters 572,574 are not twisted, i.e. the protrusion is in the indexed position rearwardly of the narrowed section of the slot in the non-ventilating state. When the filters are twisted, the resilient filters 572,574 urge the sleeve forwardly over the tobacco unit in a longitudinal direction. Therefore, the filters 572,574 urge the protrusion rearwardly, and after relative rotation, into the index position 578*b*. The rearward location or bias of the protrusion inhibits accidental relative rotation from the selected indexing position. The sleeve and tobacco unit may need to be pulled longitudinally apart in order to move the protrusion out of the positions 578*a*,578*b* and rotate the sleeve.

The filters 572,574 resiliently urge the sleeve and tobacco unit to rotate relative to each other towards a position in which the filters 572,574 are not twisted. The smoking article 570 is biased towards a particular ventilation state, preferably a non-ventilating state. The engagement of the protrusion 579 in the indexing position 578*b* prevents the bias from causing relative rotation. Alternatively, the filters 572,574 may not be twisted in a state of high ventilation, and the filters may bias the smoking article into this state.

The protrusion 579 is movable within the slot 578 between the two positions of increased width 578*a*,578*b*, which correspond to a minimum and maximum ventilation. In the pre-determined positions, the ventilation apertures in the sleeve and tobacco unit are either aligned or not aligned. The slot 578 may not constrict the engaging protrusion.

The indexing mechanism described may be used on any other embodiment of smoking article. The indexing mechanism also functions as an indicator to indicate the ventilation state selected.

The filters have been described as formed into sections, joined by a core integrally formed with the two sections. Alternatively, a substrate of any material may be formed in two sections, joined by a core which allows twisting. Alternatively, the substrate may be formed of two separate sections, and coupled together to allow relative rotation. Alternatively, the filter may be initially formed having two filter sections connected by a core of reduced diameter.

FIGS. 100 to 102 show a forty-second embodiment of ventilation system in a smoking article 580. Smoking article 580 has the same basic configuration as the embodiment of FIGS. 98 and 99. The smoking article 580 comprises a tobacco unit 581, which may comprise a tobacco rod and a first filter 582 as described with respect to FIG. 1 to 3 or 5, or only a tobacco rod, or e.g. as described with respect to FIG. 4. A first part comprising the tobacco unit 581 is moveable relative to a second part of the smoking article comprising a sleeve 583 and a second filter 584. The smoking article 580 does not comprise a chamber between the tobacco unit 581 and the second filter 584. The sleeve 583 is rotatable relative to the tobacco unit 581, and the sleeve 583 is not movable longitudinally relative to the tobacco unit 581. The tobacco unit 581 has a rearward end, which is surrounded by the sleeve 583.

FIG. 100 shows the smoking article 580 in a non-ventilating state. The first and second filters 582,584 are formed as a single filter. The first filter 582 is partially separated from the second filter 584 by a lateral cut 585. The cut 585 extends over a radially outer part of the first and second filters 582,584. A radially inner core 585*a*, which is not cut, connects the first and second filters 582,584. The first and second filters 582,584 and core 585*a* are integrally formed. The first filter 582 can twist relative to the second filter 584 around the core 585*a*.

The sleeve is provided with one or more first ventilation apertures (not shown) at one or more circumferential positions. The ventilation apertures may extend longitudinally. The tobacco unit is provided with one or more second ventilation apertures (not shown) at one or more circumferential positions. The ventilation apertures may extend longitudinally. In the non-ventilating state, the first and second ventilation apertures are not aligned.

FIG. 101 shows the smoking article 580 in a ventilating state. The first and second ventilation apertures are aligned. The state of ventilation is selected by relative rotation of the sleeve and tobacco unit. The first and second filters 582,584 are twisted relative to each other as required to select an overlap or alignment of the first and second ventilation apertures.

The smoking article 580 comprises limiting means to limit rotation of the sleeve 583 relative to the tobacco unit 581 to a pre-determined range. The limiting means comprises a stop section 588 which is engagable with the sleeve 583. The stop section 588 is a raised section surrounding and attached to the tobacco unit 581, and is preferably formed of one or more layers of a flexible material, e.g. paper. The stop section 588 is a substantially cylindrical tube having an exterior surface having substantially the same diameter as the cylindrical sleeve 583, such that the exterior of the stop section and sleeve are substantially flush.

The stop section 588 comprises a first tongue 591 extending longitudinally rearwardly. The first tongue 591 extends in the same plane as the material forming the stop section 588, and the first tongue is not formed on a folded section. The sleeve 583 comprises a second tongue 590 extending longitudinally forwardly. The second tongue 590 extends in the same plane as the material forming the sleeve 583, and the second tongue is not formed on a folded section. The tongues 590, 591 are engagable to limit rotational movement between the first and second parts.

FIG. 102 shows a blank for the sleeve 583 and stop section 588. The blanks are rolled into cylindrical tubes to form the sleeve 583 and stop section 588. The integral tongue 591 of the stop section 588 determines the circumferential range into which the tongue 590 of the sleeve 583 cannot travel. In particular, first and second surfaces 591*a*, 591*b* of the tongue 591 of the stop section 588 act as stops to define the limit of rotation of the sleeve 583 by engaging with the integral tongue 590. The surfaces 591*a*,591*b* are in a radially extending plane on the smoking article, and limit rotational movement in a tangential direction. The tongue 591 extends over between a quarter and a half of the circumference of the smoking article 580, and preferably extends over approximately a third of the circumference. The stop section 588 may be provided with markings 592*a*,592*b* which, when aligned with the tongue 590 of the sleeve, indicate a minimum ventilation position and a maximum ventilation position respectively. The tongues 590,591 are formed as an extension of a layer of flexible material which at least partially surrounds the tobacco unit.

FIGS. 103 and 104 show a forty-third embodiment of ventilation system in a smoking article 600. The smoking article 600 comprises a tobacco unit 601, which may comprise a tobacco rod and first filter as described with respect to FIG. 1 to 3 or 5, or only a tobacco rod, or e.g. as described with respect to FIG. 4. Smoking article 600 may comprise a variable length chamber, substantially as described in any of the embodiments above. A first part comprising a tobacco unit 601 is moveable relative to a second part of the smoking article comprising a sleeve 603. The tobacco unit 601 has a rearward end, which is surrounded by the sleeve 603. The variable length chamber is defined between the tobacco unit 601 and a second filter or stain-binder connected to the sleeve. Alternatively, the sleeve 603 may not movable relative to the tobacco unit 601, and may not define a variable length chamber.

FIG. 103 shows the smoking article 600 in a minimum ventilation state. The sleeve 603 comprises one or more ventilation flaps 606. Preferably, the sleeve 603 comprises a single ventilation flap 606. The flap 606 is flush with an exterior surface of the sleeve, and covers one or more ventilation apertures in the minimum ventilation state.

FIG. 104 shows the smoking article 600 in a maximum ventilation state, in which the ventilation flap 606 is opened. The ventilation flap 606 is configured to hinge open outwardly from the sleeve 603. The ventilation flap 606 is configured to be hinged open manually. The opened ventilation flap 606 uncovers one or more ventilation apertures 607 through which air can ingress into the smoking article.

The ventilation flap 606 is attached to the sleeve along a hinge line 608, about which the ventilation flap 606 is rotatable. Preferably, the flap 606 is integrally formed with the sleeve 603. The hinge line 608 extends circumferentially at a forward end of the ventilation flap 606. The ventilation flap 606 is formed by perforation or a cut in the sleeve 603, which defines at least one side of the ventilation flap 606 apart from the hinge line 608.

The sleeve 603 and flap 606 are formed from a blank, and rolled into a cylindrical tube. The ventilation flap 606 may be formed at an edge of the blank, and extend beyond an adjacent edge of the blank. Therefore, perforations or cuts are only needed to define some of the sides of the flap 606, the further sides defined by the edge of the blank. The ventilation flap 606 may be lifted in use by a free part extending beyond the adjacent edge of the blank.

A distal edge 609 of the ventilation flap 606 extends parallel to the hinge line 608. The ventilation flap 606 is preferably shaped as an irregular polygon, preferably having five sides. The distal edge 609 is longer than the hinge line 608. The surface area for the ventilation flap 606 is large compared to the relatively short hinge line 608, allowing the ventilation flap 606 to be easily opened.

The ventilation flap has been described as a five sided polygon. Alternatively, the ventilation flaps may have another shape, for example, any polygonal shape such as square, pentagonal, or a substantially circular or substantially oval shape.

One or more of the embodiments above describe ventilation apertures formed in a sleeve and/or in the tobacco unit. The ventilation apertures are formed such that air can flow into the sleeve or tobacco unit. In particular, the tobacco unit may comprise one or more layers of paper wrap surrounding a filter or chamber. The one or more layers of paper wrap may comprise a plugwrap and/or other material surrounding a filter comprising filtration material, and/or tipping paper joining a filter to a tobacco rod. The ventilation aperture extends through the one or more layers of paper wrap and any other material, such that the air can flow to the air permeable filtration material or chamber. The material in which the ventilation apertures are formed is substantially impermeable to air flow, or has a predetermined permeability to provide a base level of ventilation.

The ventilation aperture(s) of any embodiment may be in the form of a cut aperture, air permeable material or an aperture covered with an air permeable material. References to a ventilation aperture are intended to mean an area which is air permeable. An air permeable area, however formed, may be termed a ventilation area.

The ventilation apertures in the sleeve and/or tobacco unit may be formed by a laser. In particular, the laser may simultaneously generate aligned ventilation apertures in the sleeve and tobacco unit. Alternatively, the ventilation apertures may be formed as a slit by a mechanical cutting tool. Alternatively, the ventilation apertures may be formed as a cut-out area. Alternatively, the ventilation apertures may be formed by an air permeable material, which is either manufactured as a permeable material or made permeable by the addition of apertures or by processing.

The present invention may also comprise a method of manufacturing a smoking article according to any embodiment.

A smoking article according to any embodiment may further comprise a source of flavouring. The flavouring may be releasable as the first part is moved relative to the second part, or may be releasable by a separate action. The source of flavouring may provide any flavour, for example, menthol. The source of flavouring may be in a filter. The smoking article has a ventilation which is variable. The level or strength of the flavouring may vary as a result of the ventilation being varied.

In use, a smoking article according to any of the embodiments described is preferably packaged in a retracted state. In order to use, the user extends the smoking article by urging apart the sleeve and tobacco units in at least a longitudinal direction. The user may light the tobacco in a conventional manner.

The longitudinal extension and/or relative rotation of the first and second parts may be used to vary the ventilation of the smoking article.

In order to extinguish the smoking article, the user may press the lit tobacco end against any suitable extinguishing surface. When the user holds the sleeve to extinguish the cigarette, the tobacco unit will be urged into the sleeve along the longitudinal axis until the remaining tobacco unit is covered by the sleeve. The burnt tobacco rod is therefore not visible in a side view of the extinguished smoking article.

Any of the features of any embodiment may be combined with any of the features of any other embodiment. In particular, any of the embodiments of smoking article may or may not have a filter section adjoining the cylinder of tobacco, and/or may not have a filter section at the mouthpiece end of the sleeve. In particular, the sleeve may not have a filter attached to it, and may define a recess at the mouthpiece end or may have an edge at the mouthpiece end which is aligned with a rear end of the first filter. The restraining means or limiting means of any embodiment may be used with any other embodiment, to prevent or control longitudinal and/or rotational movement of the first part relative to the second part, or any part moveable over another part. The restraining means comprising a first and second engaging surface of any embodiment may be used with any other embodiment. The ventilation in a particular longitudinal or rotational position may be as described, or may be applicable to a different position, for example, by varying the location of one or more ventilation apertures.

In some embodiments, the first and second filters have been described as secured in an abutting or adjacent arrangement. Alternatively, a first part having the first filter may be fixed longitudinally to a second part having the second filter, with a fixed length chamber between the first and second filters.

The smoking article has been described as extendable. Alternatively, the smoking article may have a fixed overall length. The sleeve or filter may be rotated without allowing or actuating a change in the length of the smoking article. The restraining means may allow rotation of the sleeve, and not allow relative longitudinal movement, between a filter and a source of smokable material. The restraining means may be arranged such that the chamber is of a fixed length, which may be zero. The restraining means may allow relative rotation between two adjacent filter sections, and the relative rotation may select a degree of ventilation of the smoking article.

The invention claimed is:

1. A smoking article, comprising:

a first part; and, a second part movable relative to the first part;

wherein one of the first part and the second part comprises a tobacco rod and a first filter section whilst the other part comprises a sleeve and a second filter section, wherein one of the first part and second part includes material having one or more sets of first ventilation areas arranged in a line or an array, and the other of the first and second part includes material having one or more sets of second ventilation areas, wherein the relative rotational position of the first part to the second part is configured to vary the overlap between the first ventilation areas and the second ventilation areas to provide a variable flow system configured to variably control gaseous flow into the smoking article; and wherein the material of the first part and/or the material of the second part has a predetermined permeability provided by the addition of apertures, so as to provide a level of gaseous flow into the smoking article which is independent of the relative rotational position of the first part to the second part.

2. The smoking article as claimed in claim 1 wherein a said ventilation area in the first part is uncovered when aligned with a said ventilation area in the second part.

3. The smoking article as claimed in claim 1 wherein the first part comprises a first engaging surface and the second part comprises a second engaging surface, and the first and second engaging surfaces are configured to abut to limit or prevent relative rotational or longitudinal movement between the first and second parts.

4. The smoking article as claimed in claim 3 wherein the first part comprises a stop section having the first engaging surface, and the second part is configured to engage the first engaging surface to limit rotation between the first and second parts.

5. The smoking article as claimed in claim 3 wherein the first engaging surface is formed on a protrusion and the second engaging surface is formed at an end of a slot in which the protrusion is engaged, the first and second engaging surfaces configured to abut to limit relative rotational or longitudinal movement of the first and second parts.

6. The smoking article as claimed in claim 3 wherein at least one of a said ventilation area in the first part extends over approximately half of the circumference of the first part, and a said ventilation area in the second part extends approximately half of the circumference of the second part.

7. The smoking article as claimed in claim 3 wherein at least one of the first engaging surface is formed on an edge of a sheet material wrapped around the first part and the second engaging surface is formed within an exterior surface of the second part.

8. The smoking article as claimed in claim 3 wherein at least one of the first engaging surface is formed on an edge of a sheet material connecting a source of smokable material and a first filter, and the second engaging surface is formed within an exterior surface of the second part.

9. The smoking article as claimed in claim 1 wherein the sleeve comprises one of the material having a plurality of sets of first ventilation areas and the material having a plurality of sets of second ventilation areas, and said plurality of sets of first/second ventilation area circumferentially spaced.

10. The smoking article as claimed in claim 9 wherein a said set of ventilation areas of the sleeve is arranged over an area having a first dimension which is common to another set of ventilation areas of the sleeve, and a second dimension which is different to said another set of ventilation areas, such that the area of the said set of ventilation areas is different to said another set of ventilation areas.

11. The smoking article as claimed in claim 1 wherein an area of overlap between the first ventilation areas and the second ventilation areas determines the ventilation of the smoking article.

12. The smoking article as claimed in claim 1 wherein the sleeve is initially secured by a frangible connection.

13. The smoking article as claimed in claim 1 wherein an exterior surface of the first part has substantially the same diameter as an exterior surface of the second part.

14. The smoking article as claimed in claim 1 wherein the first ventilation areas are circumferentially spaced, and the second ventilation areas are circumferentially spaced, wherein the ventilation areas of the first and second parts are configured such that movement of the second part relative to the first part simultaneously changes an alignment of the ventilation areas of the first part with the ventilation areas of the second part.

15. The smoking article as claimed in claim 1 wherein the first part includes a protrusion alignable with a said ventilation area in the second part.

16. The smoking article as claimed in claim 1 wherein one of the first part and second part includes material having a plurality of sets of said first ventilation areas, and the other of the first and second part includes material having a plurality of sets of said second ventilation areas, wherein a ventilation is selected by selecting a number of sets of first ventilation areas aligned with a set of second ventilation areas.

17. The smoking article as claimed in claim 1 wherein one of the first part and second part includes material having a plurality of circumferentially spaced sets of said first or second ventilation areas, wherein ventilation is selected by aligning a set of ventilation areas in one of the first part and the second part with one or more ventilation areas in the other of the first part or the second part.

18. The smoking article as claimed in claim 1 wherein the smoking article includes a removable section covering one or more of the first ventilation areas, or one or more of the second ventilation areas.

19. The smoking article as claimed in claim 1 wherein the part including the sleeve is provided with said first ventilation areas and is rotatable around the part having the tobacco rod, the part having the tobacco rod including one or more sets of said second ventilation areas.

20. The smoking article as claimed in claim 1 wherein the first ventilation areas are longitudinally spaced and the second ventilation areas are longitudinally spaced, and wherein the first and second ventilation areas are configured such that movement of the second part relative to the first part simultaneously varies the alignment of the plurality of first ventilation areas with the second ventilation areas.

21. The smoking article as claimed in claim 1 wherein the first part includes a plurality of sets of said first or second ventilation areas, the first or second ventilation areas being longitudinally spaced, and the second part is slidable longitudinally around the first part, wherein the second part is configured to selectively cover one or more of the sets of first or second ventilation areas.

22. The smoking article as claimed in claim 1 wherein the flow system is a ventilation system configured to control any one or more of: ventilation into the smoking article, and gaseous flow through the smoking article.

* * * * *